US009801782B2

(12) United States Patent
Lurie et al.

(10) Patent No.: US 9,801,782 B2
(45) **Date of Patent: *Oct. 31, 2017**

(54) SUPPORT DEVICES FOR HEAD UP CARDIOPULMONARY RESUSCITATION

(71) Applicant: Keith G. Lurie, Minneapolis, MN (US)

(72) Inventors: Keith G. Lurie, Minneapolis, MN (US); Kanchana Sanjaya Gunesekera Karunaratne, Escondido, CA (US); Joseph Manno, La Jolla, CA (US); John P. Grimm, Santee, CA (US)

(73) Assignee: Keith G. Lurie, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/133,967

(22) Filed: Apr. 20, 2016

(65) Prior Publication Data

US 2016/0228326 A1 Aug. 11, 2016

Related U.S. Application Data

(63) Continuation-in-part of application No. 14/996,147, filed on Jan. 14, 2016, now abandoned, which is a (Continued)

(51) Int. Cl.

| | |
|---|---|
| ***A61H 31/00*** | (2006.01) |
| ***A61G 13/08*** | (2006.01) |
| ***A61G 13/12*** | (2006.01) |

(52) U.S. Cl.

CPC ..... *A61H 31/006* (2013.01); *A61G 13/08* (2013.01); *A61G 13/122* (2013.01); *A61G 13/129* (2013.01); *A61G 13/1215* (2013.01); *A61G 13/1225* (2013.01); *A61G 13/1255* (2013.01); *A61G 13/1285* (2013.01); (Continued)

(58) Field of Classification Search

CPC . A61M 16/0048; A61H 31/00; A61H 31/008; A61H 31/004–31/007; A61H 31/02; A61H 2031/001; A61H 2031/002; A61H 2031/003; A61H 2031/025

See application file for complete search history.

(56) References Cited

U.S. PATENT DOCUMENTS

| | | | |
|---|---|---|---|
| 1,995,583 | A | 3/1935 | Sanderson |
| 3,461,858 | A | 8/1969 | Michelson |

(Continued)

OTHER PUBLICATIONS

Non-Final Office Action dated Aug. 26, 2016, for U.S. Appl. No. 14/996,147, 15 pages.

(Continued)

*Primary Examiner* — LaToya M Louis

(74) *Attorney, Agent, or Firm* — Kilpatrick Townsend & Stockton LLP

(57) ABSTRACT

An elevation device used in the performance of cardiopulmonary resuscitation (CPR) includes a base and an upper support pivotably coupled to the base. The upper support is configured to elevate the individual's upper back, shoulders and head when pivoted. The upper support is expandable lengthwise. The upper support includes a neck support that is configured to support the individual's spine in a region of the individual's C7 and C8 vertebrae throughout elevation of the upper back, shoulders and head.

8 Claims, 58 Drawing Sheets

Related U.S. Application Data continuation-in-part of application No. 14/935,262, filed on Nov. 6, 2015, now Pat. No. 9,707,152, which is a continuation-in-part of application No. 14/677,562, filed on Apr. 2, 2015, which is a continuation of application No. 14/626,770, filed on Feb. 19, 2015.

(60) Provisional application No. 62/242,655, filed on Oct. 16, 2015, provisional application No. 61/941,670, filed on Feb. 19, 2014, provisional application No. 62/087,717, filed on Dec. 4, 2014, provisional application No. 62/000,836, filed on May 20, 2014.

(52) U.S. Cl.
CPC ..... *A61H 31/005* (2013.01); *A61H 31/007* (2013.01); *A61H 31/008* (2013.01); *A61H 2031/001* (2013.01); *A61H 2201/013* (2013.01); *A61H 2201/0173* (2013.01); *A61H 2201/0192* (2013.01); *A61H 2201/1604* (2013.01); *A61H 2201/1619* (2013.01); *A61H 2201/1623* (2013.01); *A61H 2201/5007* (2013.01); *A61H 2201/5023* (2013.01); *A61H 2201/5097* (2013.01); *A61H 2230/208* (2013.01); *A61H 2230/305* (2013.01)

(56) References Cited

U.S. PATENT DOCUMENTS 3,804,082 A * 4/1974 Tarjan ..... A61H 31/008 601/41
3,870,038 A 3/1975 Arblaster
3,985,126 A 10/1976 Barkalow
4,060,079 A 11/1977 Reinhold, Jr.
4,095,590 A 6/1978 Harrigan
4,194,732 A 3/1980 Liebman
4,534,075 A 8/1985 Schnitzler
4,915,095 A 4/1990 Chun
5,048,136 A * 9/1991 Popitz ..... A47C 21/046 128/870
5,316,907 A 5/1994 Lurie
5,400,448 A 3/1995 Zwickey
5,423,772 A 6/1995 Lurie
5,454,779 A 10/1995 Lurie et al.
5,490,820 A * 2/1996 Schock ..... A61H 9/0078 601/1
5,538,002 A 7/1996 Boussignac et al.
5,549,581 A 8/1996 Lurie
5,551,420 A 9/1996 Lurie et al.
5,588,422 A 12/1996 Lurie
5,618,665 A 4/1997 Lurie
5,634,222 A 6/1997 Zwickey
5,643,231 A 7/1997 Lurie
5,645,522 A 7/1997 Lurie et al.
5,692,498 A 12/1997 Lurie et al.
5,722,963 A 3/1998 Lurie
5,730,122 A 3/1998 Lurie
5,827,893 A 10/1998 Lurie
5,919,210 A 7/1999 Lurie
5,984,909 A 11/1999 Lurie
6,001,085 A 12/1999 Lurie
6,029,667 A 2/2000 Lurie
6,062,219 A 5/2000 Lurie et al.
6,078,834 A 6/2000 Lurie
6,142,962 A 11/2000 Mollenauer
6,155,257 A 12/2000 Lurie et al.
6,224,562 B1 5/2001 Lurie et al.
6,234,916 B1 5/2001 Carusillo et al.
6,234,985 B1 5/2001 Lurie et al.
6,277,107 B1 8/2001 Lurie
6,312,399 B1 11/2001 Lurie et al.
6,357,065 B1 3/2002 Adams
6,371,119 B1 4/2002 Zadini et al.
6,425,393 B1 7/2002 Lurie et al.
6,446,288 B1 * 9/2002 Pi ..... A47G 9/10 5/636
6,459,933 B1 10/2002 Lurie et al.
6,463,327 B1 10/2002 Lurie et al.
6,486,206 B1 11/2002 Lurie
6,526,973 B1 3/2003 Lurie et al.
6,587,726 B2 7/2003 Lurie et al.
6,604,523 B2 8/2003 Lurie et al.
6,656,166 B2 12/2003 Lurie
6,751,818 B2 6/2004 Troop
6,776,156 B2 8/2004 Lurie et al.
6,863,656 B2 3/2005 Lurie
6,935,336 B2 8/2005 Lurie et al.
6,938,618 B2 9/2005 Lurie et al.
6,986,349 B2 1/2006 Lurie
7,044,128 B2 5/2006 Lurie
7,056,296 B2 6/2006 Sherman et al.
7,060,041 B1 6/2006 Weil et al.
7,082,945 B2 8/2006 Lurie
7,174,891 B2 2/2007 Lurie et al.
7,185,649 B2 3/2007 Lurie
7,195,012 B2 3/2007 Lurie
7,195,013 B2 3/2007 Lurie
7,204,251 B2 4/2007 Lurie
7,210,480 B2 5/2007 Lurie et al.
7,275,542 B2 10/2007 Lurie et al.
7,296,312 B2 11/2007 Menkedick
7,311,668 B2 12/2007 Lurie et al.
7,569,021 B2 8/2009 Sebelius et al.
7,682,312 B2 3/2010 Lurie
7,766,011 B2 8/2010 Lurie
7,836,881 B2 11/2010 Lurie et al.
7,899,526 B2 3/2011 Benditt et al.
8,011,367 B2 9/2011 Lurie et al.
8,151,790 B2 4/2012 Lurie et al.
8,210,176 B2 7/2012 Metzger et al.
8,291,534 B2 * 10/2012 Karlson ..... A47G 9/10 5/632
8,408,204 B2 4/2013 Lurie
8,702,633 B2 4/2014 Voss et al.
8,752,220 B2 * 6/2014 Soderberg ..... A61G 7/015 5/424
8,755,902 B2 6/2014 Lurie et al.
2002/0002347 A1 1/2002 Kelly et al.
2002/0069878 A1 6/2002 Lurie et al.
2002/0170562 A1 11/2002 Lurie et al.
2003/0062040 A1 4/2003 Lurie et al.
2004/0016428 A9 1/2004 Lurie
2004/0058305 A1 3/2004 Lurie et al.
2004/0116840 A1 6/2004 Cantrell et al.
2004/0200474 A1 10/2004 Lurie
2004/0211415 A1 10/2004 Lurie
2004/0211416 A1 10/2004 Lurie
2004/0211417 A1 10/2004 Lurie
2004/0231664 A1 11/2004 Lurie et al.
2005/0165334 A1 7/2005 Lurie
2005/0199237 A1 9/2005 Lurie
2005/0217677 A1 10/2005 Lurie et al.
2005/0267381 A1 12/2005 Benditt
2006/0162077 A1 * 7/2006 McDaniel ..... A61G 7/015 5/611
2006/0277683 A1 12/2006 Lamire et al.
2007/0021683 A1 1/2007 Benditt et al.
2007/0277826 A1 12/2007 Lurie
2008/0045867 A1 2/2008 Jensen et al.
2008/0047555 A1 2/2008 Lurie et al.
2008/0255482 A1 10/2008 Lurie
2009/0062701 A1 3/2009 Yannopoulos et al.
2009/0277447 A1 11/2009 Voss et al.
2009/0308400 A1 * 12/2009 Wilson ..... A61F 5/3769 128/845
2010/0031961 A1 2/2010 Schmidt
2010/0179442 A1 7/2010 Lurie
2010/0319691 A1 12/2010 Lurie et al.
2011/0047709 A1 * 3/2011 Tarsaud ..... A61G 7/05776 5/710
2011/0098612 A1 4/2011 Lurie
2011/0160782 A1 6/2011 Lurie et al.

(56) References Cited

U.S. PATENT DOCUMENTS

| | | | | |
|---|---|---|---|---|
| 2011/0201979 | A1 | 8/2011 | Voss et al. | |
| 2011/0297147 | A1 | 12/2011 | Lick et al. | |
| 2012/0042881 | A1 | 2/2012 | Paulussen et al. | |
| 2012/0203147 | A1 | 8/2012 | Lurie et al. | |
| 2012/0260428 | A1 | 10/2012 | Franklin | |
| 2012/0266383 | A1 | 10/2012 | Pi | |
| 2012/0330199 | A1 | 12/2012 | Lurie et al. | |
| 2012/0330200 | A1 | 12/2012 | Voss et al. | |
| 2013/0231593 | A1 | 9/2013 | Yannopoulos et al. | |
| 2014/0005566 | A1 | 1/2014 | Homuth et al. | |
| 2014/0048061 | A1 | 2/2014 | Yannopoulos et al. | |
| 2014/0082842 | A1 | 3/2014 | Jackson | |
| 2014/0276269 | A1* | 9/2014 | Illindala ..... | A61H 31/008 601/41 |
| 2014/0363391 | A1 | 12/2014 | Yannopoulos et al. | |
| 2015/0057580 | A1 | 2/2015 | Illindala | |

OTHER PUBLICATIONS

International Preliminary Report on Patentability dated Aug. 23, 2016, for International Patent Application No. PCT/US2015/016651, 10 pages.

Non-Final Office Action dated Sep. 6, 2016, for U.S. Appl. No.14/677,562, 12 pages.

Final Office Action dated May 27, 2016, for U.S. Appl. No. 14/667,562, 9 pages.

Advisory Action dated Jul. 11, 2016, for U.S. Appl. No. 14/677,562, 4 pages.

ISR/WO dated Jul. 8, 2015 for International Patent Application filed on Feb. 19, 2015, all pages.

Voelckel et al "The effects of positive end-expiratory pressure during active compression decompression cardiopulmonary resuscitation with the inspiratory threshold valve." *Anesthesia and Analgesia*. Apr. 2001: 92(4): 967-74.

Debaty G, et al. "Tilting for perfusion: Head-up position during cardiopulmonary resuscitation improves brain flow in a porcine model of cardiac arrest." *Resuscitation*. 2015: 87: 38-43.

Lurie, Keith G. (2015) "The Physiology of Cardiopulmonary Resuscitation," Anesthesia & Analgesia, doi:10.1513/ANE.0000000000000926, in Ryu, et. al. "The Effect of Head Up Cardiopulmonary Resuscitation on Cerebral and Systemic Hemodynamics." *Resuscitation*. 2016: 102: 29-34.

Non-Final Office Action dated Jan. 6, 2016, for U.S. Appl. No. 14/677,562, 33 pages.

International Search Report and Written Opinion of PCT/US2016/057366 dated Mar. 13, 2017, all pages.

* cited by examiner

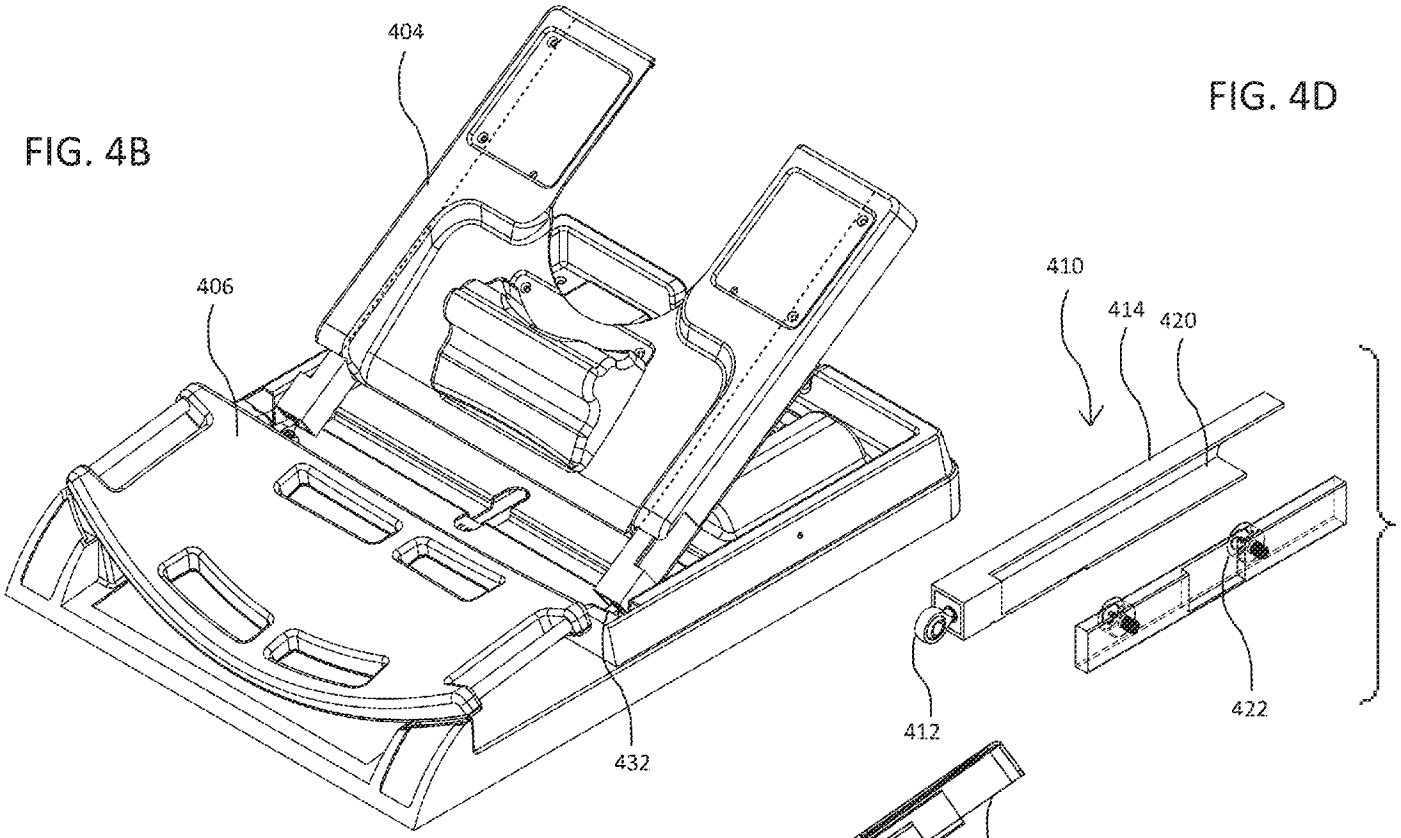
FIG. 4B
FIG. 4D
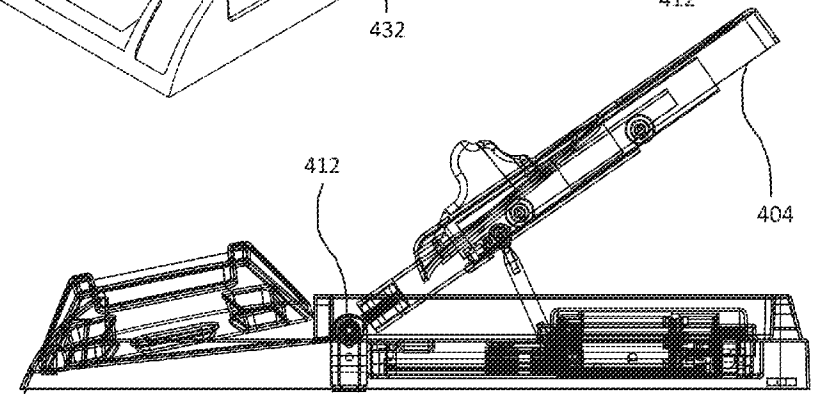
FIG. 4C

FIG. 22
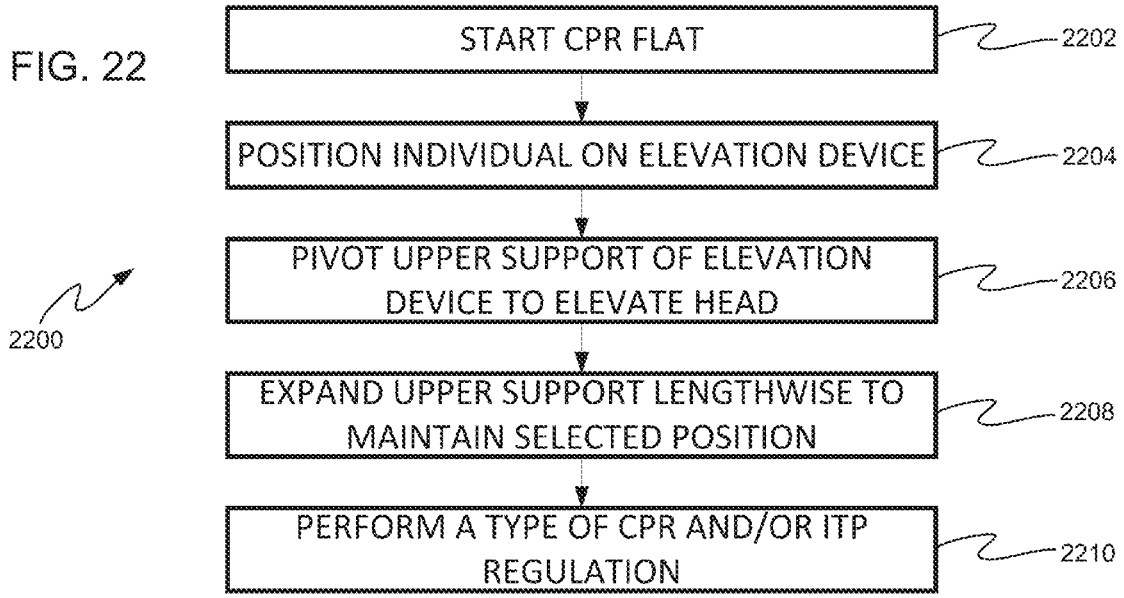
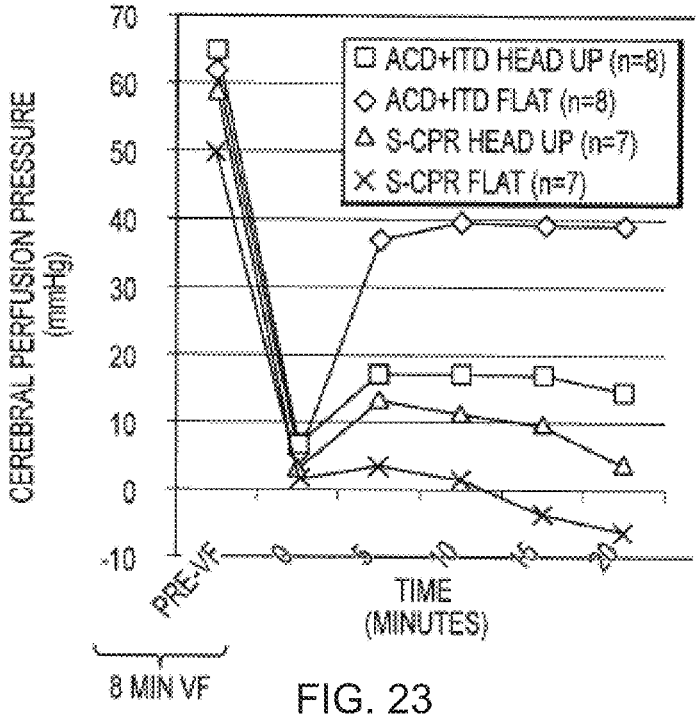
FIG. 23

24-HOUR CEREBRAL PERFORMANCE CATEGORY SCORE

| CPC SCORE | NEUROLOGICAL OUTCOME |
|---|---|
| 1 | DEAD |
| 2 | CANNOT BE RESUSCITATED |
| 3 | VERY BAD BRAIN FUNCTION |
| 4 | MODERATE BRAIN DAMAGE |
| 5 | MILD BRAIN DAMAGE |
| 6 | NORMAL |

SUPPORT DEVICES FOR HEAD UP CARDIOPULMONARY RESUSCITATION

CROSS-REFERENCES TO RELATED APPLICATIONS

This application claims priority to U.S. Provisional Application No. 62/242,655, filed Oct. 16, 2015, and is also a continuation in part of U.S. application Ser. No. 14/996,147, filed Jan. 14, 2016, which is a continuation in part of U.S. application Ser. No. 14/935,262, filed Nov. 6, 2015, which is a continuation in part of U.S. application Ser. No. 14/677,562, filed Apr. 2, 2015, which is a continuation of U.S. patent application Ser. No. 14/626,770, filed Feb. 19, 2015, which claims the benefit of U.S. Provisional Application No. 61/941,670, filed Feb. 19, 2015, U.S. Provisional Application No. 62/000,836, filed Feb. 19, 2014 and U.S. Provisional Application No. 62/087,717, filed Dec. 4, 2014, the complete disclosures of which are hereby incorporated by reference for all intents and purposes.

BACKGROUND OF THE INVENTION

The vast majority of patients treated with conventional (C) cardiopulmonary resuscitation (CPR) never wake up after cardiac arrest. Traditional closed-chest CPR involves repetitively compressing the chest in the med-sternal region with a patient supine and in the horizontal plane in an effort to propel blood out of the non-beating heart to the brain and other vital organs. This method is not very efficient, in part because refilling of the heart is dependent upon the generation of an intrathoracic vacuum during the decompression phase that draws blood back to the heart. Conventional (C) closed chest manual CPR (C-CPR) typically provides only 15-30% of normal blood flow to the brain and heart. In addition, with each chest compression, the arterial pressure increases immediately. Similarly, with each chest compression, right-side heart and venous pressures rise to levels nearly identical to those observed on the arterial side. The high right-sided pressures are in turn transmitted to the brain via the paravertebral venous plexus and jugular veins. The simultaneous rise of arterial and venous pressure with each C-CPR compression generates contemporaneous bi-directional (venous and arterial) high pressure compression waves that bombard the brain within the closed-space of the skull. This increase in blood volume and pressure in the brain with each chest compression in the setting of impaired cerebral perfusion further increases intracranial pressure (ICP), thereby reducing cerebral perfusion. These mechanisms have the potential to further reduce brain perfusion and cause additional damage to the already ischemic brain tissue during C-CPR.

To address these limitations, newer methods of CPR have been developed that significantly augment cerebral and cardiac perfusion, lower intracranial pressure during the decompression phase of CPR, and improve short and long-term outcomes. These methods may include the use of a load-distributing band, active compression decompression (ACD)+CPR, an impedance threshold device (ITD), active intrathoracic pressure regulation devices, and/or combinations thereof. However, despite these advances, most patients still do not wake up after out-of-hospital cardiac arrest.

BRIEF SUMMARY OF THE INVENTION

Embodiments of the invention are directed toward systems, devices, and methods of administering CPR to a patient in a head and thorax up position. Such techniques result in lower right-atrial pressures and intracranial pressure while increasing cerebral perfusion pressure, cerebral output, and systolic blood pressure (SBP) compared with CPR administered to an individual in the supine position. The configuration may also preserve a central blood volume and lower pulmonary vascular resistance. This provides a more effective and safe method of performing CPR for extended periods of time. The head and thorax up configuration may also preserve the patient in the sniffing position to optimize airway management and reduce complications associated with endotracheal intubation.

In one aspect, an elevation device for use in the performance of cardiopulmonary resuscitation (CPR) and after resuscitation is provided. The elevation device may include a base and an upper support pivotably coupled to the base. The upper support may be configured to elevate an individual's upper back, shoulders and head when pivoted. The upper support may be expandable and contractible lengthwise, during an elevation of the individual.

In another aspect, an elevation device may include a base and an upper support pivotably coupled to the base. The upper support may be configured to elevate an individual's upper back, shoulders and head when pivoted. The upper support may be expandable lengthwise. The upper support may define an area formed to receive the individual's head. The upper support may include a neck support that is configured to support an individual's spine in a region of the individual's C7 and C8 vertebrae throughout elevation of the upper back, shoulders and head. The elevation device may also include a thoracic plate configured to receive a chest compression device. The thoracic plate may be pivotably coupled to the base to permit the thoracic plate to be pivoted, thereby adjusting the position of the chest compression device.

In another aspect, a method for performing cardiopulmonary resuscitation (CPR) is provided. The method may include providing an elevation device that includes a base and an upper support pivotably coupled to the base. The upper support may include a neck pad. The method may also include positioning an individual on the elevation device such that the neck pad supports an individual's spine in a region of the individual's C7 and C8 vertebrae and pivoting the upper support to further elevate the head of the individual while the neck pad continues supporting the individual's spine in the region of the individual's C7 and C8 vertebrae. The method may further include expanding the upper support lengthwise to maintain a position of the individual with the neck pad supporting the individual's spine in the region of the individual's C7 and C8 vertebrae and performing one or more of a type of CPR or a type of intrathoracic pressure regulation while elevating the heart and the head.

In another aspect, a method for performing cardiopulmonary resuscitation (CPR) includes providing an elevation device that includes a base and an upper support pivotably coupled to the base. The method may also include positioning an individual on the elevation device and pivoting the upper support to further elevate the head of the individual. The method may further include expanding the upper support lengthwise and performing one or more of a type of CPR or a type of intrathoracic pressure regulation while elevating the heart and the head.

BRIEF DESCRIPTION OF THE DRAWINGS

FIG. 4B depicts the support structure of FIG. 4A in an elevated position according to embodiments.

FIG. 4C depicts the support structure of FIG. 4A in an elevated position according to embodiments.

FIG. 4D depicts a roller assembly of the support structure of FIG. 4A according to embodiments.

FIG. 22 depicts a flowchart of a process for performing CPR according to embodiments FIG. 23 is a graph depicting cerebral perfusion pressures from pigs undergoing CPR over time with differential head and heart elevation during C-CPR and active compression decompression (ACD)+ITD CPR according to embodiments.

DETAILED DESCRIPTION OF THE INVENTION

Figure 1A:
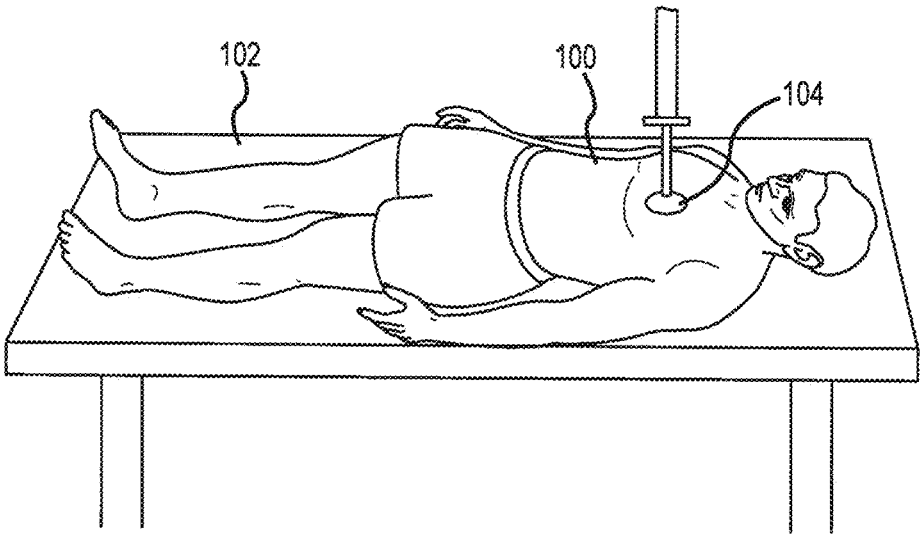
FIG. 1A is a schematic of a patient receiving CPR in a supine configuration according to embodiments.

One aspect of the invention involves CPR techniques where the entire body, and in some cases at least the head, shoulders, and heart, of a patient is tilted upward. This improves cerebral perfusion and cerebral perfusion pressures after cardiac arrest. In some cases, CPR with the head and heart elevated may be performed using any one of a variety of manual or automated conventional CPR devices (e.g. active compression-decompression CPR, load-distributing band, or the like) alone or in combination with any one of a variety of systems for regulating intrathoracic pressure, such as a threshold valve that interfaces with a patient's airway (e.g., an ITD), the combination of an ITD and a Positive End Expiratory Pressure valve (see Voelckel et al "The effects of positive end-expiratory pressure during active compression decompression cardiopulmonary resuscitation with the inspiratory threshold valve." *Anesthesia and Analgesia*. 2001 April: 92(4): 967-74, the entire contents of which is hereby incorporated by reference). or a Bousignac tube alone or coupled with an ITD (see U.S. Pat. No. 5,538,002, the entire contents of which is hereby incorporated by reference). In some cases, the systems for regulating intrathoracic pressure may be used without any type of chest compression. When CPR is performed with the head and heart elevated, gravity drains venous blood from the brain to the heart, resulting in refilling of the heart after each compression and a substantial decrease in ICP, thereby reducing resistance to forward brain flow. This maneuver also reduces the likelihood of simultaneous high pressure waveform simultaneously compressing the brain during the compression phase. While this may represent a potential significant advance, tilting the entire body upward, or at least the head, shoulders, and heart, has the potential to reduce coronary and cerebral perfusion during a prolonged resuscitation effort since over time gravity will cause the redistribution of blood to the abdomen and lower extremities.

It is known that the average duration of CPR is over 20 minutes for many patients with out-of-hospital cardiac arrest. To prolong the elevation of the cerebral and coronary perfusion pressures sufficiently for longer resuscitation efforts, in some cases, the head may be elevated at between about 10 cm and 30 cm (typically about 20 cm) while the thorax, specifically the heart and/or lungs, is elevated at between about 3 cm and 8 cm (typically about 5 cm) relative to a supporting surface and/or the lower body of the individual. Typically, this involves providing a thorax support and a head support that are configured to elevate the respective portions of the body at different angles and/or heights to achieve the desired elevation with the head raised higher than the thorax and the thorax raised higher than the lower body of the individual being treated. Such a configuration may result in lower right-atrial pressures while increasing cerebral perfusion pressure, cerebral output, and systolic blood pressure SBP compared to CPR administered to an individual in the supine position. The configuration may also preserve a central blood volume and lower pulmonary vascular resistance.

The head up devices (HUD) described herein mechanically elevate the thorax and the head, maintain the head and thorax in the correct position for CPR when head up and supine using an expandable and retractable thoracic back plate and a neck support, and allow a thoracic plate to angulate during head elevation so the piston of a CPR assist device always compresses the sternum in the same place and a desired angle (such as, for example, a right angle) is maintained between the piston and the sternum during each chest compression. Embodiments were developed to provide each of these functions simultaneously, thereby enabling maintenance of the compression point at the anatomically correct place when the patient is flat (supine) or their head and chest are elevated.

Figure 1B:
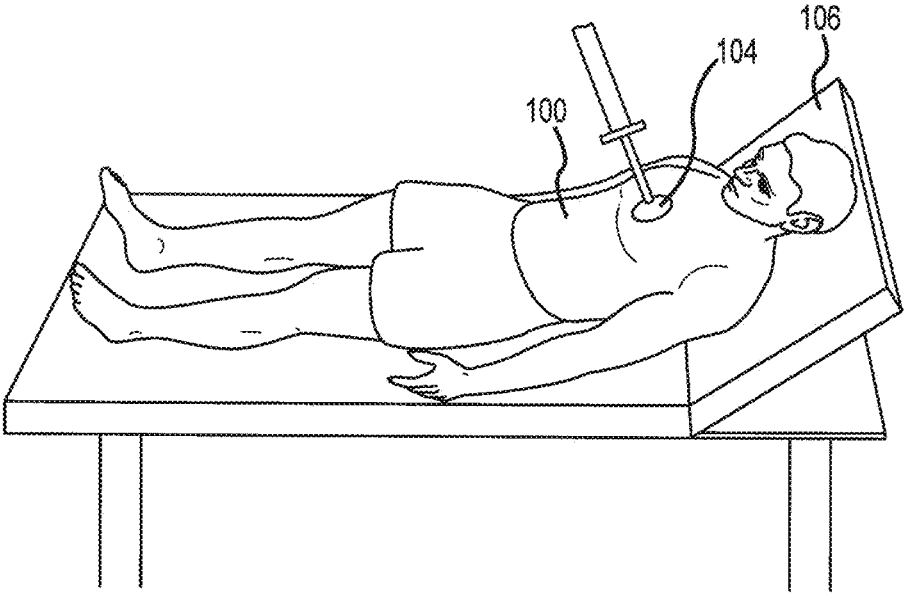
FIG. 1B is a schematic of a patient receiving CPR in a head and thorax up configuration according to embodiments.

Turning now to FIG. 1A, a demonstration of the standard supine (SUP) CPR technique is shown. Here, a patient 100 is positioned horizontally on a flat or substantially flat surface 102 while CPR is performed. CPR may be performed by hand and/or with the use of an automated CPR device and/or ACD+CPR device 104. In contrast, a head and thorax up (HUP) CPR technique is shown in FIG. 1B. Here, the patient 100 has his head and thorax elevated above the rest of his body, notably the lower body. The elevation may be provided by one or more wedges or angled surfaces 106 placed under the patient's head and/or thorax, which support the upper body of the patient 100 in a position where both the head and thorax are elevated, with the head being elevated above the thorax. HUP CPR may be performed with ACD alone, with the ITD alone, with the ITD in combination with conventional standard CPR alone, and/or with ACD+ITD together. Such methods regulate and better control intrathoracic pressure, causing a greater negative intrathoracic pressure during CPR when compared with conventional manual CPR. In some embodiments, HUP CPR may also be performed in conjunction with extracorporeal membrane oxygenation (ECMO).

Figures 2A, 2B, 2C:
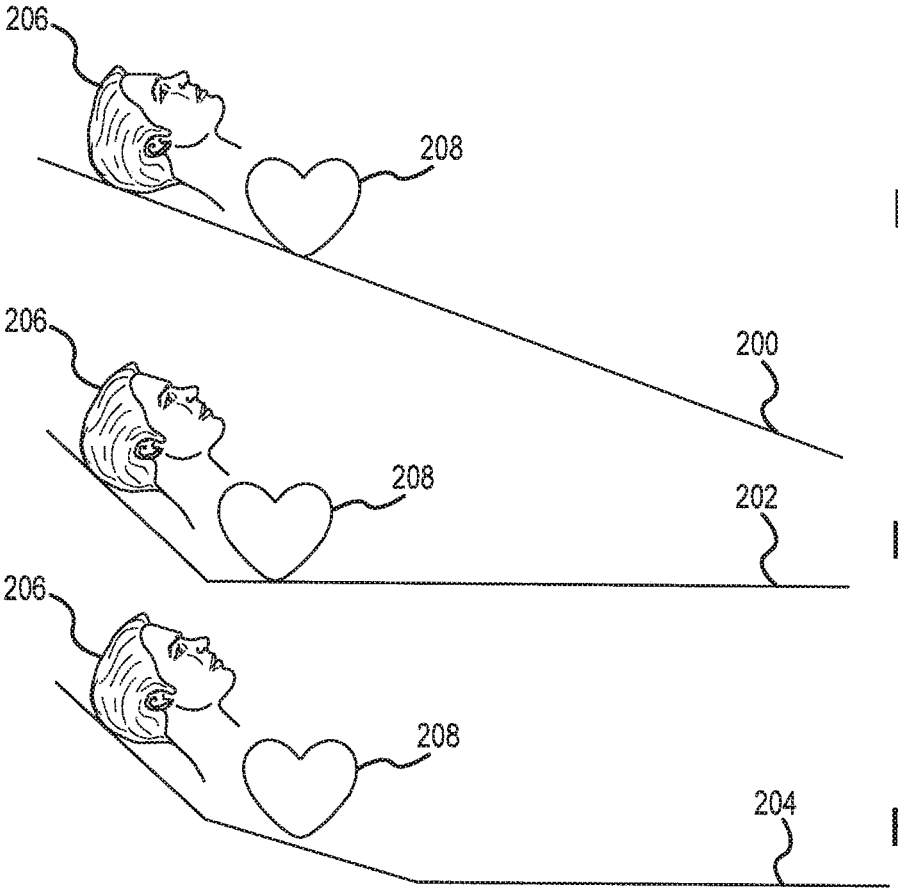
FIG. 2A is a schematic showing a configuration of head up CPR according to embodiments.
FIG. 2B is a schematic showing a configuration of head up CPR according to embodiments.
FIG. 2C is a schematic showing a configuration of head up CPR according to embodiments.

FIGS. 2A-2C demonstrate various set ups for HUP CPR as disclosed herein. Configuration 200 in FIG. 2A shows a user's entire body being elevated upward at a constant angle. As noted above, such a configuration may result in a reduction of coronary and cerebral perfusion during a prolonged resuscitation effort since blood will tend to pool in the abdomen and lower extremities over time due to gravity. This reduces the amount of effective circulating blood volume and as a result blood flow to the heart and brain decrease over the duration of the CPR effort. Thus, configuration 200 is not ideal for administration of CPR over longer periods, such as those approaching average resuscitation effort durations. Configuration 202 in FIG. 2B shows only the patient's head 206 being elevated, with the heart and thorax 208 being substantially horizontal during CPR. Without an elevated thorax 208, however, systolic blood pressures and coronary perfusion pressures are lower as lungs are more congested with blood when the thorax is supine or flat. This, in turn, increases pulmonary vascular resistance and decreases the flow of blood from the right side of the heart to the left side of the heart when compared to CPR in configuration 204. Configuration 204 in FIG. 2C shows both the head 206 and heart/thorax 208 of the patient elevated, with the head 206 being elevated to a greater height than that heart/thorax 208. This results in lower right-atrial pressures while increasing cerebral perfusion pressure, cerebral output, and systolic blood pressure compared to CPR administered to an individual in the supine position, and may also preserve a central blood volume and lower pulmonary vascular resistance. Typically, the CPR is performed with ACD and/or with an ITD.

Figure 3:
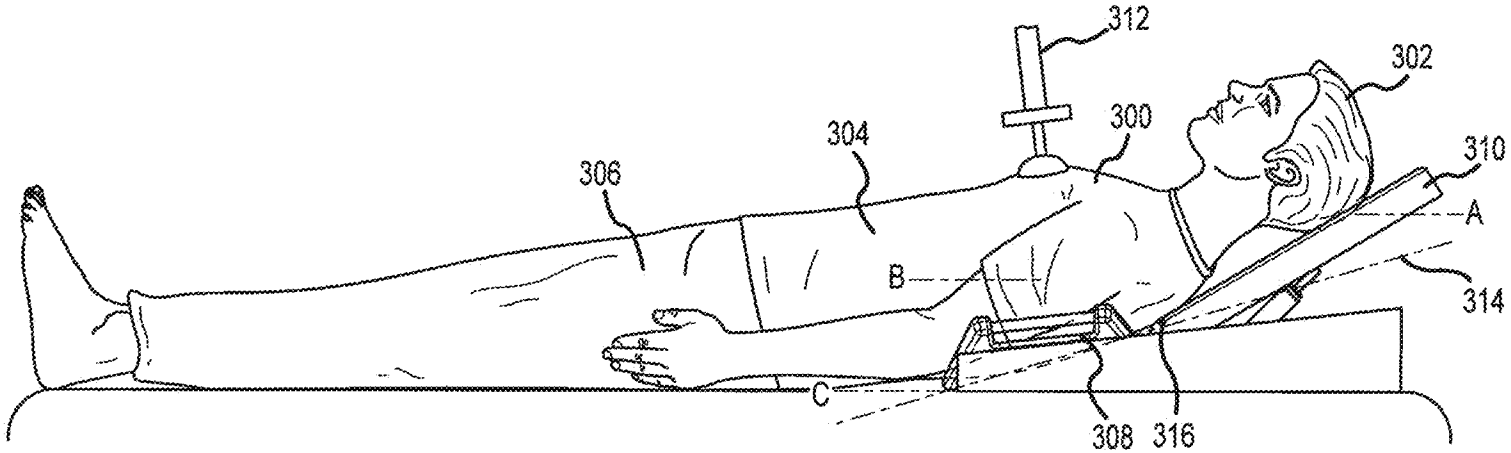
FIG. 3 shows a patient receiving CPR in a head and thorax up configuration according to embodiments.

FIG. 3 depicts a patient 300 having the head 302 and thorax 304 elevated above the lower body 306. This may be done, for example, by using one or more supports to position the patient 300 appropriately. Here thoracic support 308 is positioned under the thorax 304 to elevate the thorax 304 to a desired height B, which is typically between about 3 cm and 8 cm. Upper support 310 is positioned under the head 302 such that the head 302 is elevated to a desired height A, typically between about 10 cm and 30 cm. Thus, the patient 300 has its head 302 at a higher height A than thorax at height B, and both are elevated relative to the flat or supine lower body at height C. Typically, the height of thoracic support 308 may be achieved by the thoracic support 308 being at an angle of between about 0° and 15° from a substantially horizontal plane with which the patient's lower body 306 is aligned. Upper support 310 is often at an angle between about 15° and 45° above the substantially horizontal plane. In some embodiments, one or both of the upper support 310 and thoracic support 308 is adjustable such that an angle and/or height may be altered to match a type a CPR, ITP regulation, and/or body size of the individual. As shown here, thoracic plate or support 308 is fixed at an angle, such as between 0° and 15° from a substantially horizontal plane. The upper support 310 may adjust by pivoting about an axis 314. This pivoting may involve a manual adjustment in which a user pulls up or pushes down on the upper support 310 to set a desired position. In other embodiments, the pivoting may be driven by a motor or other drive mechanism. For example, a hydraulic lift coupled with an extendable arm may be used. In other embodiments, a screw or worm gear may be utilized in conjunction with an extendable arm or other linkage. Any adjustment or pivot mechanism may be coupled between a base of the support structure and the upper support 310 In some embodiments, a neck support may be positioned on the upper support to help maintain the patient in a proper position.

As one example, the lower body 306 may define a substantially horizontal plane. A first angled plane may be defined by a line formed from the patient's chest 304 (heart and lungs) to his shoulder blades. A second angled plane may be defined by a line from the shoulder blades to the head 302. The first plane may be angled about between 5° and 15° above the substantially horizontal plane and the second plane may be at an angle of between about 15° and 45° above the substantially horizontal plane. In some embodiments, the first angled plane may be elevated such that the heart is at a height of about 4-8 cm above the horizontal plane and the head is at a height of about 10-30 cm above the horizontal plane.

The type of CPR being performed on the elevated patient may vary. Examples of CPR techniques that may be used include manual chest compression, chest compressions using an assist device such as assist device 312, either automated or manually, ACD CPR, a load-distributing band, standard CPR, stutter CPR, and the like. Such processes and techniques are described in U.S. Pat. Pub. No. 2011/0201979 and U.S. Pat. Nos. 5,454,779 and 5,645,522, all incorporated herein by reference. Further various sensors may be used in combination with one or more controllers to sense physiological parameters as well as the manner in which CPR is being performed. The controller may be used to vary the manner of CPR performance, adjust the angle of inclination, provide feedback to the rescuer, and the like. Further, a compression device could be simultaneously applied to the lower extremities to squeeze venous blood back into the upper body, thereby augmenting blood flow back to the heart. Further, a rigid or semi-rigid cushion could be simultaneously inserted under the thorax at the level of the hart to elevate the heart and provide greater back support during each compression.

Additionally, a number of other procedures may be performed while CPR is being performed on the patient in the torso-elevated state. One such procedure is to periodically prevent or impede the flow in respiratory gases into the lungs. This may be done by using a threshold valve, sometimes also referred to as an impedance threshold device (ITD) that is configured to open once a certain negative intrathoracic pressure is reached. The invention may utilize any of the threshold valves or procedures using such valves that are described in U.S. Pat. Nos. 5,551,420; 5,692,498; 5,730,122; 6,029,667; 6,062,219; 6,155,257; 6,234,916; 6,224,562; 6,526,973; 6,604,523; 6,986,349; and 7,204,251, the complete disclosures of which are herein incorporated by reference.

Another such procedure is to manipulate the intrathoracic pressure in other ways, such as by using a ventilator or other device to actively withdraw gases from the lungs. Such techniques as well as equipment and devices for regulating respirator gases are described in U.S. Pat. Pub. No. 2010/0031961, incorporated herein by reference. Such techniques as well as equipment and devices are also described in U.S. patent application Ser. Nos. 11/034,996 and 10/796,875, and also U.S. Pat. Nos. 5,730,122; 6,029,667; 7,082,945; 7,185,649; 7,195,012; and 7,195,013, the complete disclosures of which are herein incorporated by reference.

In some embodiments, the angle and/or height of the head and/or heart may be dependent on a type of CPR performed and/or a type of intrathoracic pressure regulation performed. For example, when CPR is performed with a device or device combination capable of providing more circulation during CPR, the head may be elevated higher, for example 10-30 cm above the horizontal plane (10-45 degrees) such as with ACD+ITD CPR. When CPR is performed with less efficient means, such as manual conventional standard CPR, then the head will be elevated less, for example 5-20 cm or 10 to 20 degrees.

A variety of equipment or devices may be coupled to or associated with the structure used to elevate the head and torso to facilitate the performance of CPR and/or intrathoracic pressure regulation. For example, a coupling mechanism, connector, or the like may be used to removably couple a CPR assist device to the structure. This could be as simple as a snap fit connector to enable a CPR assist device to be positioned over the patient's chest. Examples of CPR assist devices that could be used with the support structure (either in the current state or a modified state) include the Lucas device, sold by Physio-Control, Inc. and described in U.S. Pat. No. 7,569,021, the entire contents of which is hereby incorporated by reference, the Defibtech Lifeline ARM—Hands-Free CPR Device, sold by Defibtech, the Thumper mechanical CPR device, sold by Michigan Instruments, automated CPR devices by Zoll, such as the AutoPulse, as also described in U.S. Pat. No. 7,056,296, the entire contents of which is hereby incorporated by reference, and the like.

Similarly, various commercially available intrathoracic pressure devices could be removably coupled to the support structure. Examples of such devices include the Lucas device (Physio-control) such as is described in U.S. Pat. No. 7,569,021, the Weil Mini Chest Compressor Device, such as described in U.S. Pat. No. 7,060,041 (Weil Institute), the entire contents of which are hereby incorporated by reference, the Zoll AutoPulse, and the like.

As an individual's head is elevated using a support structure or other elevation device, the individual's thorax is forced to constrict and compress, which causes a more magnified thorax migration during the elevation process. This thorax migration may cause the misalignment of a chest compression device, which leads to ineffective, and in some cases, harmful, chest compressions. It can also cause the head to bend forward thereby potentially restricting the airway. Thus, maintaining the individual in a proper position throughout elevation, without the compression and contraction of the thorax, is vital to ensure that safe and effective CPR can be performed. Embodiments of the following support structures provide upper supports that may expand and contract, such as by sliding along a support frame to permit the thorax to move freely upward and remain elongate, rather than contract, during the elevation process. For example, the upper support may be supported on rollers with minimal friction. As the head, neck, and/or shoulders are lifted, the upper support may slide away from the thoracic compression, which relieves a buildup of pressure on the thorax and minimizes thoracic compression and migration. Additionally, such support structures are designed to maintain optimal airway management of the individual, such as by supporting the individual in the sniffing position throughout elevation.

In traditional CPR the patient is supine on an underlying flat surface while manual or automated CPR is implemented. During automated CPR, the chest compression device may migrate due to limited stabilization to the underlying flat surface, and may often require adjustment due to the migration of the device and/or body migration. This may be further exaggerated when the head and shoulders are raised. The support structures described herein offer a more substantial platform to support and cradle the chest compression device, such as, for example, a LUCAS device, providing stabilization assistance and preventing unwanted migratory motion, even when the upper torso is elevated. The support structures described herein provide the ability to immediately commence CPR in the lowered/supine position, continuing CPR during the gradual, controlled rise to the "Head-Up/Elevated" position. Such support structures provide ease of patient positioning and alignment for automated CPR devices. Correct positioning of the patient is important and readily accomplished with guides and alignment features, such as a shaped shoulder profile, a neck/shoulder support, a contoured thoracic plate, as well as other guidelines and graphics. The support structures may incorporate features that enable micro adjustments to the position of an automated CPR device position, providing control and enabling accurate placement of the automated CPR device during the lift process. In some embodiments, the support structures may establish the sniffing position for intubation when required, in both the supine position and during the lifting process. Features such as stationary pads and adjustable cradles may allow the reduction of neck extension as required while allowing ready access to the head for manipulation during intubation.

Figure 4A:
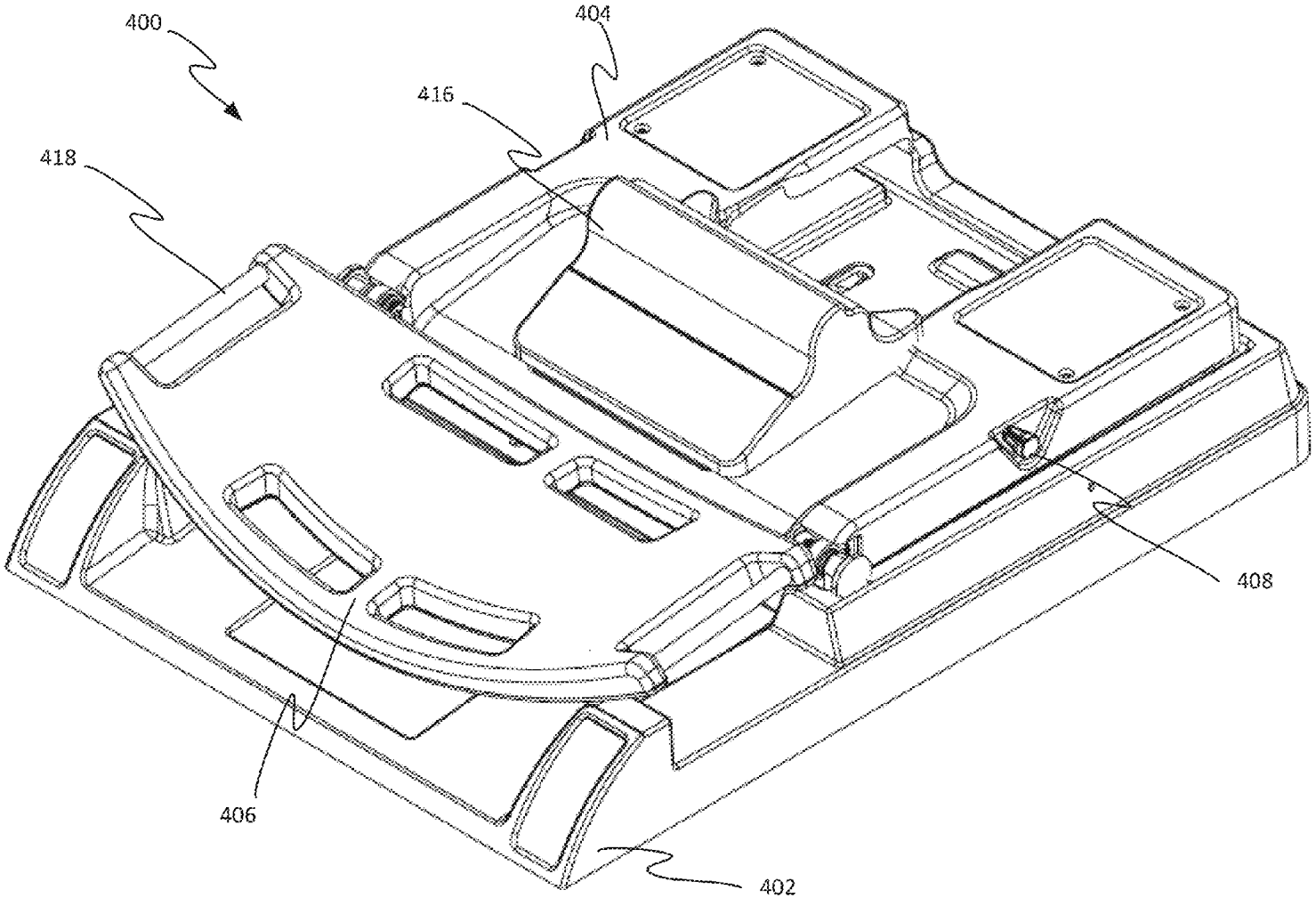
FIG. 4A depicts a support structure in a storage state according to embodiments.

Turning to FIGS. 4A-4H, a support structure 400 for elevating a patient's head and heart is shown. FIG. 4A is an isometric view of support structure 400 in a stowed configuration. Support structure 400 includes a base 402 that supports and is coupled with an upper support 404 and a thoracic plate 406. Upper support 404 may be configured to support a patient's upper back, shoulders, neck, and/or head before, during, and/or after CPR administration. Upper support 404 may include a neck pad or neck support 416, as well as areas configured to receive a patient's upper back, shoulders, neck, and/or head. In some embodiments, the neck support 416 is shaped to engage the region of the individual's C7-C8 vertebrae. The contoured shape ensures that the body does not slip or side off of neck support 416. The C7-C8 region of the spine is a critical contact point of the body as it effectively allows the upper body to freely slide/migrate upward or away from thoracic plate 406 during the elevation process to minimize thoracic compression. Thoracic compression is a leading cause of migration of the contact point of an automated CPR device, which leads to ineffective chest compressions. By adequately supporting the individual in the C7-C8 region, the upper body is free to move and the thoracic cavity may expand, rather than contract. In some embodiments, neck support 416 is formed from a firm material, such as firm foam, plastic, and/or other material. The firmness of neck support 416 provides adequate support for the individual, while resisting deformation under the load of the individual. In some embodiments, the upper support 404 may include a shaped area, such as a cutout, and indentation, and/or other shaped feature. The shaped area 426 may serve as a guide for proper head and/or shoulder placement. Additionally, the shaped area 426 may promote positioning the individual in the sniffing position by allowing the individual's head to lean downward, providing an optimally open airway. In some embodiments, the shaped area 426 may define an opening that allows the head to extend at least partially through the upper support to further promote the sniffing position. In some embodiments, the upper support 404 may also include a coupling for an ITD device to be secured to the support structure 400, or any of the other intrathoracic pressure regulation devices described herein.

The thoracic plate 406 may be contoured to match a contour of the patient's back and may include one or more couplings 418. Couplings 418 may be configured to connect a chest compression device to support structure 400. For example, couplings 418 may include one or more mating features that may engage corresponding mating features of a chest compression device. As one example, a chest compression device may snap onto or otherwise receive the couplings 418 to secure the chest compression device to the support structure 400. Any one of the devices described above could be coupled in this manner. The couplings 418 may be angled to match an angle of elevation of the thoracic plate 406 such that the chest compression is secured at an angle to deliver chest compressions at an angle substantially orthogonal to the patient's sternum, or other desired angle. In some embodiments, the couplings 418 may extend beyond an outer periphery of the thoracic plate 406 such that the chest compression device may be connected beyond the sides of the patient's body. In some embodiments, mounting 406 may be removable. In such embodiments, thoracic plate 406 may include one or more mounting features (not shown) to receive and secure the mounting 406 to the support structure 400.

Typically, thoracic plate 406 may be positioned at an angle of between about 0° and 15° relative to a horizontal plane and at a height of between about 3 cm and 8 cm above the horizontal plane at a point of the thoracic plate 406 disposed beneath the patient's heart. Upper support 404 is often within about 15° and 45° relative to the horizontal plane and between about 10 cm and 40 cm above the horizontal plane, typically measured from the tragus of the ear as a guide point. In some embodiments, when in a stowed position thoracic plate 406 and upper support 404 are at a same or similar angle, with the upper support 404 being elevated above the thoracic plate 406, although other support structures may have the first portion and second portion at different angles in the stowed position. In the stowed position, thoracic plate 406 and/or upper support 404 may be near the lower ends of the height and/or angle ranges.

In an elevated position, upper support 404 may be positioned at angles above 15° relative to the horizontal plane. Support structure 400 may include one or more elevation mechanisms 430 configured to raise and lower the thoracic plate 406 and/or upper support 404. For example, elevation mechanism 430 may include a mechanical and/or hydraulic extendable arm configured to lengthen or raise the upper support 404 to a desired height and/or angle, which may be determined based on the patient's body size, the type of CPR being performed, and/or the type of ITP regulation being performed. The elevation mechanism 430 may manipulate the support structure 400 between the storage configuration and the elevated configuration. The elevation mechanism 430 may be configured to adjust the height and/or angle of the upper support 404 throughout the entire ranges of 15° and 45° relative to the horizontal plane and between about 10 cm and 40 cm above the horizontal plane. In some embodiments, the elevation mechanism 430 may be manually manipulated, such as by a user lifting up or pushing down on the upper support 404 to raise and lower the second portion. In other embodiments, the elevation mechanism 430 may be electrically controlled such that a user may select a desired angle and/or height of the upper support 404 using a control interface. While shown here with only an adjustable upper support 404, it will be appreciated that thoracic plate 406 may also be adjustable.

The thoracic plate 406 may also include one or more mounting features 418 configured to secure a chest compression device to the support structure 404. Here, upper support 404 is shown in an initial, stored configuration. In such a configuration, the upper support 404 is at its lowest position and in a contracted state, with the upper support 404 at its nearest point relative to the thoracic plate 406.

As described in the support structures above, upper support 404 may be configured to elevate a patient's upper back, shoulders, neck, and/or head. Such elevation of the upper support 404 is shown in FIGS. 4B and 4C.

Upper support 404 may be configured to be adjustable such that the upper support 404 may slide along a longitudinal axis of base 402 to accommodate patients of different sizes as well as movement of a patient associated with the elevation of the head by upper support 404. Upper support 404 may be spring loaded or biased to the front (toward the patient's body) of the support structure 400. Such a spring force assists in managing movement of the upper support 404 when loaded with a patient. Additionally, the spring force may prevent the upper support 404 from moving uncontrollably when the support structure 400 is being moved from one location to another, such as between uses. Support structure 400 may also include a lock mechanism 408. Lock mechanism 408 may be configured to set a lateral position of the upper support 404, such as when a patient is properly positioned on the support structure 400. By allowing the upper support 404 to slide relative to the base 402 (and thus lengthen the upper support), the patient may be maintained in the "sniffing position" throughout the elevation process. Additionally, less force will be transmitted to the patient during the elevation process as the upper support 404 may slide to compensate for any changes in position of the patient's body, with the spring force helping to smooth out any movements and dampen larger forces.

Figure 4E:
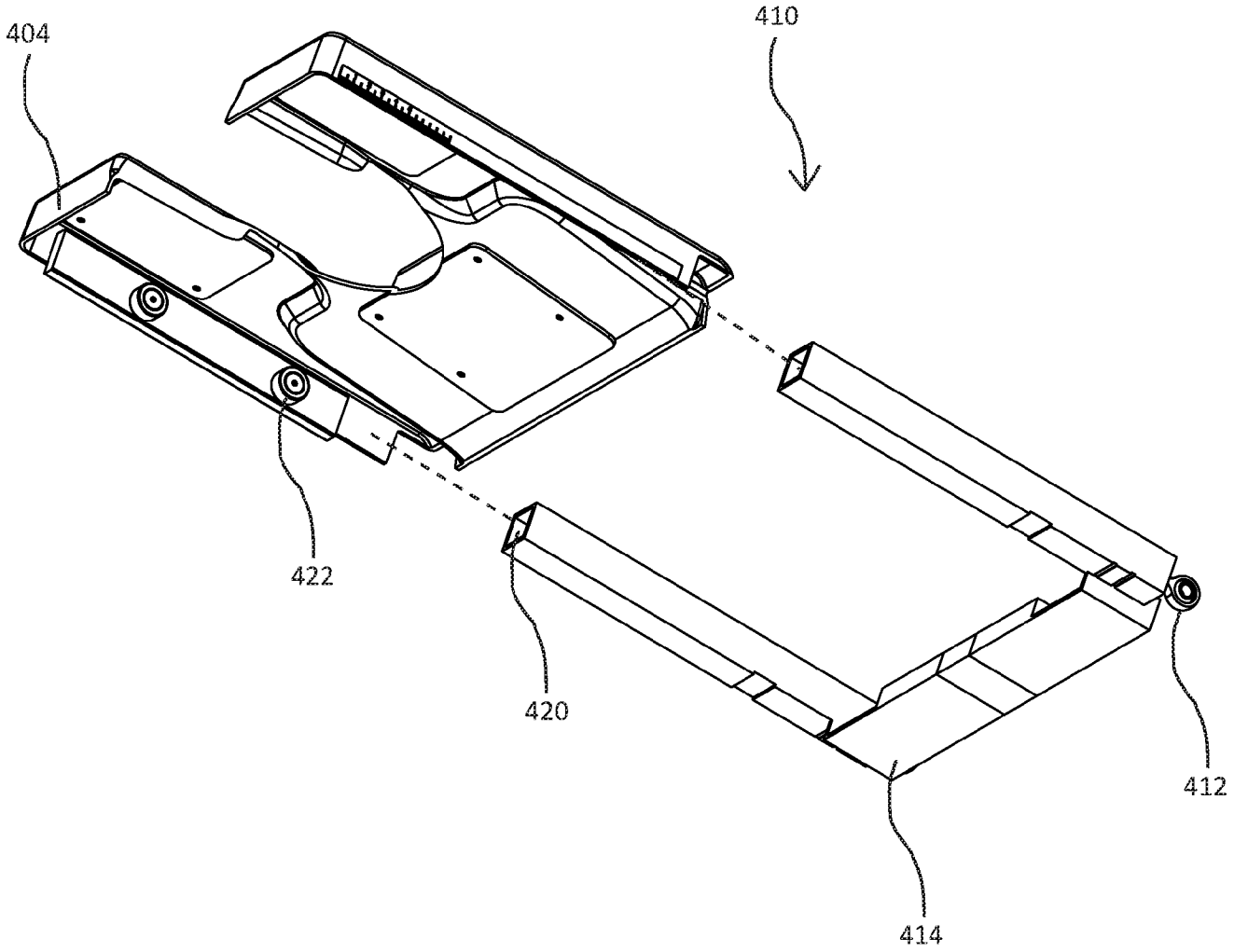
FIG. 4E depicts a roller assembly of the support structure of FIG. 4A according to embodiments.

In some embodiments, a mechanism that enables the sliding of the upper support 404 while the upper support 404 is elevated may allow the upper support 404 to be slidably coupled with the base, while in other embodiments, the mechanism may be included as part of the upper support 404 itself. For example, FIGS. 4D and 4E show one such sliding mechanism 410. Here, sliding mechanism 410 may include a pivotable coupling 412 that extends from a roller track 414 and is coupleable with a corresponding pivot point 432 of base 402. Pivotable coupling 412 enables the entire roller track 414 and upper support 404 to be pivoted to elevate the upper support 404 (and the patient's upper back, shoulders, neck, and/or head). In some embodiments, the elevation of the upper support 404 may be controlled with a motor and switch assembly, such as described above with regards to support structure 800. Roller track 414 may include one or more tracks or rails 420 that extend away from pivotable coupling 412. Rails 420 may be configured to engage and/or receive corresponding rollers 422 on upper support 404. Oftentimes, rails 420 and roller track 414 may be formed integral with upper support 404. In other embodiments, the rollers 422 may be formed on an underside of upper support 404, oftentimes near an outer edge of the upper support 404. The rollers 422 may engage the roller track 414, which may be positioned near and within the outer edges of the upper support 404. In some embodiments, the track 414 may be positioned on an underside of upper support 404 such that the track 414 and other moving parts are out of the way of users of the support structure 400. For example, one or more tracks 414 may be positioned at or near an outer edge of upper support 404, possibly on an underside of the upper support 404. In other embodiments, one or more tracks 414 may be near a center of the underside of the upper support 404. Rollers 422 may roll along the rails 420 and allow the upper support 404 to slide along the roller track 414 to adjust a lateral position of the upper support 404, e.g., to allow upper support 404 to expand and contract. Oftentimes, the sliding mechanism 410 may include one or more springs or other force dampening mechanisms that bias movement of the upper support 404 toward the thoracic plate 406. The spring force may be linear and be between about 0.25 kgf and about 1.5 kgf or other values that are sufficient to prevent unexpected motion of the upper support 404 in the absence of a patient while still being small enough to not inhibit the sliding of the upper support 404 when a patient is being elevated by support structure 400. The sliding mechanism 410 accommodates the upward motion of the patient's upper body during the elevation process in a free manner that insures minimal stress to the upper thorax by allowing upper support 404 to expand lengthwise as the patient's upper body is being elevated, thereby minimizing the deflection and compression of the thorax region and enabling the "sniffing position" to be maintained throughout the elevation or lifting process as the patient's upper body shifts upward.

While shown with roller track 414 as being coupled with the base 402 and rollers 422 being coupled with the upper support 404, it will be appreciated that other designs may be used in accordance with the present invention. For example, a number of rollers may be positioned along a rail that is pivotally coupled with the base. The upper support may then include a track that may receive the rollers such that the upper support may be slid along the rollers to adjust a position of the upper support. Other embodiments may omit the use of rollers entirely. In some embodiments, the mechanism may be a substantially friction free sliding arrangement, while in others, the mechanism may be biased toward the thoracic plate 406 by a spring force. As one example, the upper support may be supported on one or more pivoting telescopic rods that allow a relative position of the upper support to be adjusted by extending and contracting the rods.

Figures 4F, 4H:
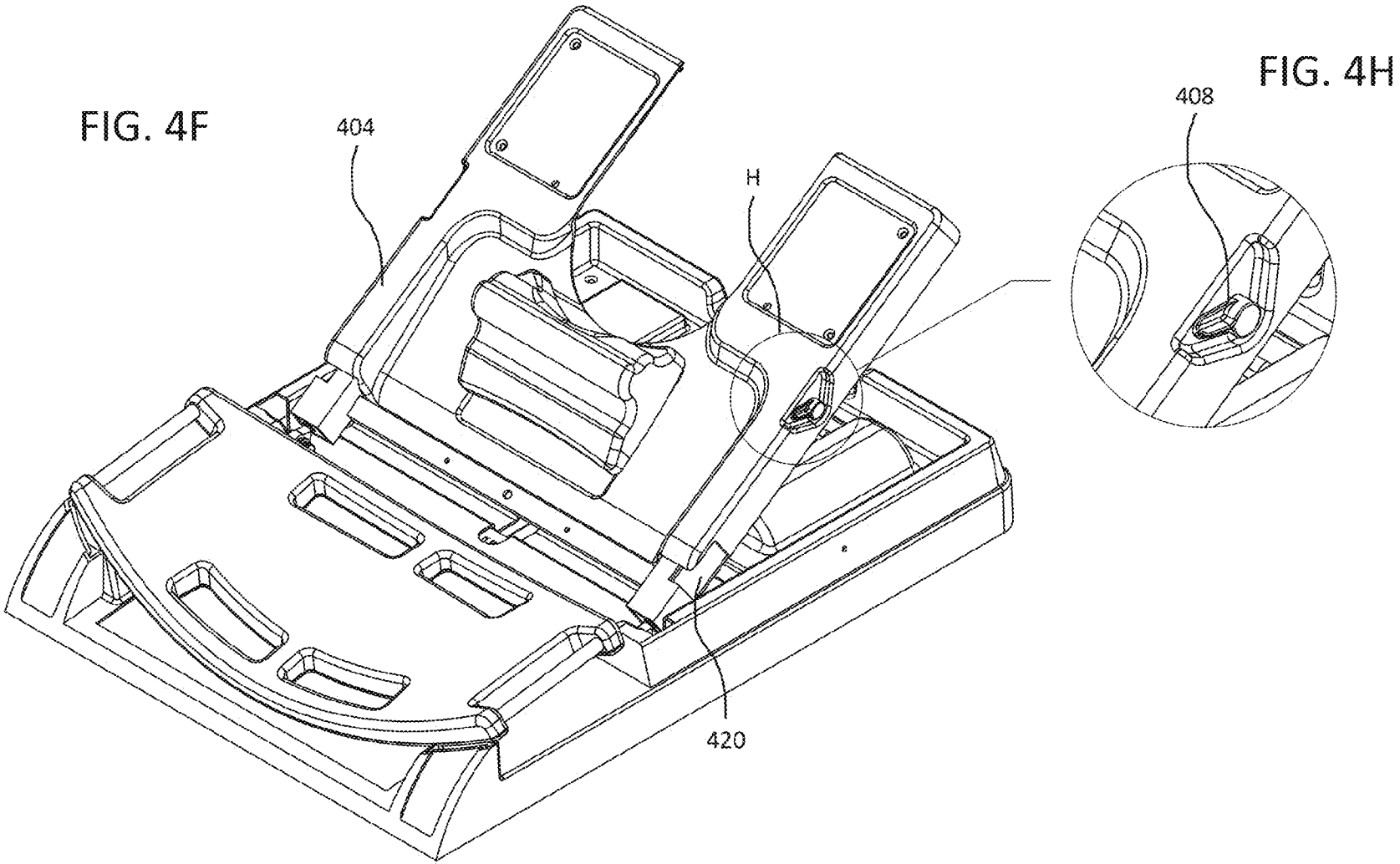
FIG. 4F depicts the support structure of FIG. 4A in an extended elevated position according to embodiments.
FIG. 4H depicts a lock mechanism of the support structure of FIG. 4A according to embodiments.

FIG. 4F shows a locking mechanism 424 of support structure 400 in an elevated extended position. Locking mechanism 424, when engaged, locks the function of rollers 422 such that a lateral position of the upper support 404 is maintained. Locking mechanism 424 may be engaged and/or disengaged at any time during the elevation and/or CPR administration processes to allow adjustments of position of the patient to be made. In some embodiments, the locking mechanism 424 functions by applying friction, engaging a ratcheting mechanism, and/or applying a clamping force to prevent the upper support 404 from moving. In the elevated extended position, the upper support 404 is angularly elevated above the base 402, such as by pivoting the upper support 404 about the pivotable coupling 412. The upper support 404 is positioned along the roller track 414 at a distance from the thoracic plate 406. In some embodiments, this may result in a portion of the roller track 414 being exposed as the upper support 404 is extended along the track 414.

Figure 4G:
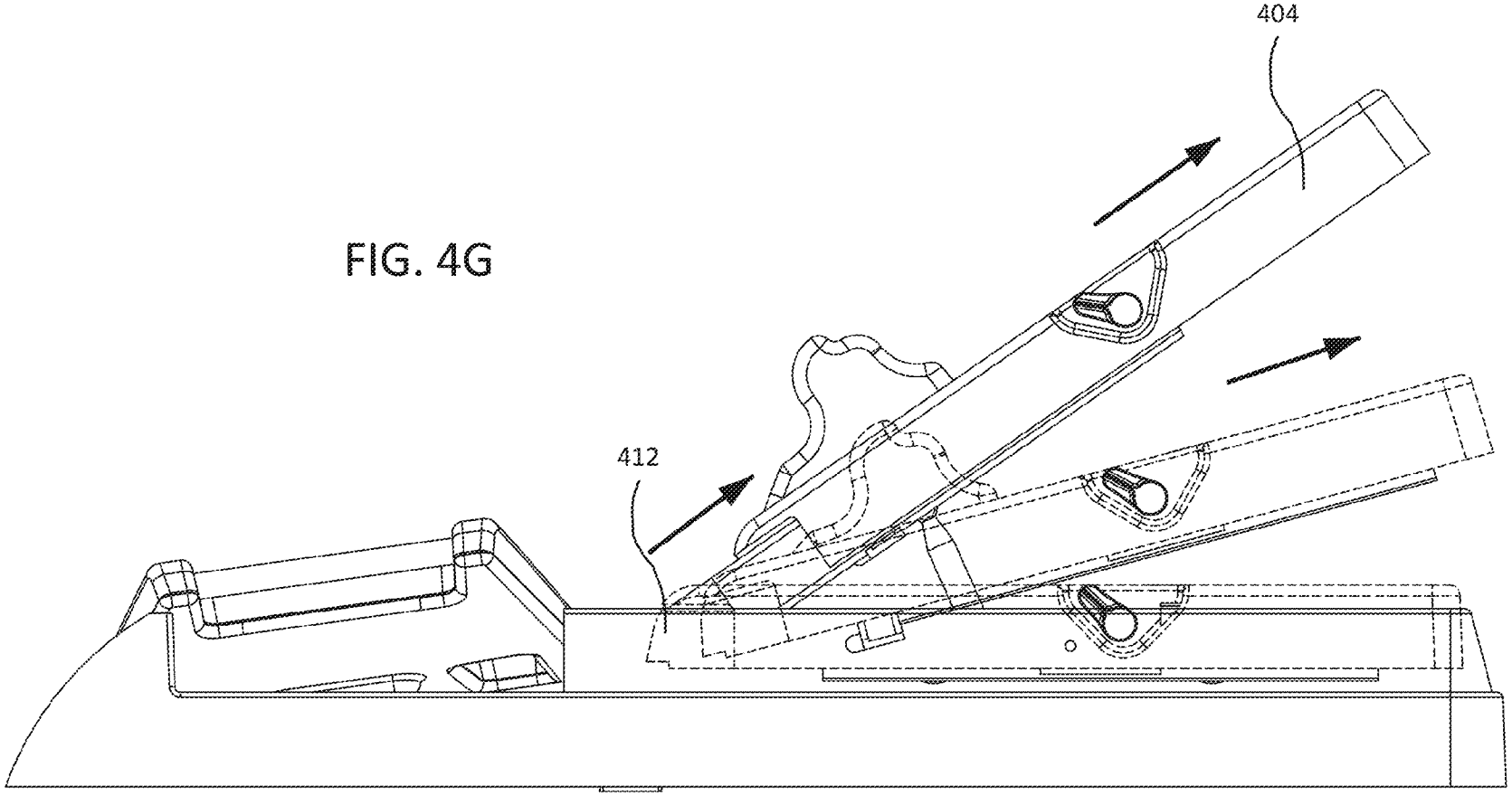
FIG. 4G depicts possible movement of the support structure of FIG. 4A from a storage position to an extended elevated position according to embodiments.

FIG. 4G shows possible movement of the upper support 404 during the elevation process. As noted above, the support structure 400 and patient's body having different radii of curvature. The movement provided by the adjustable upper support 404 allows the upper support 404 to conform to the movement of the body to maintain proper support of the patient in the "sniffing position." The upper support 404 may initially be in a storage state. As the patient is positioned on the support structure 400 and the upper support 404 is elevated, the upper support 404 may begin to slide away from the thoracic plate 406 in the direction of the arrow to accommodate the changing body position of the patient. Throughout the elevation process, the upper support 404 may continue to extend away from the thoracic plate 406 until the full elevation is reached. At this point, the patient will be maintained in the "sniffing position" in the elevated position, with the upper support 404 extended at some distance from the thoracic plate 406, effectively making the support structure 400 longer than when the patient was in a supine position. At this point, the physician or other user may make any small adjustments to the position of the upper support 404 by sliding the upper support 404 along the roller track 414 and/or the user may lock the upper support 404 in the position using locking mechanism 408 as shown in FIG. 4H. Adjustments may be necessary to assist in airway management and/or intubation.

Figure 4I:
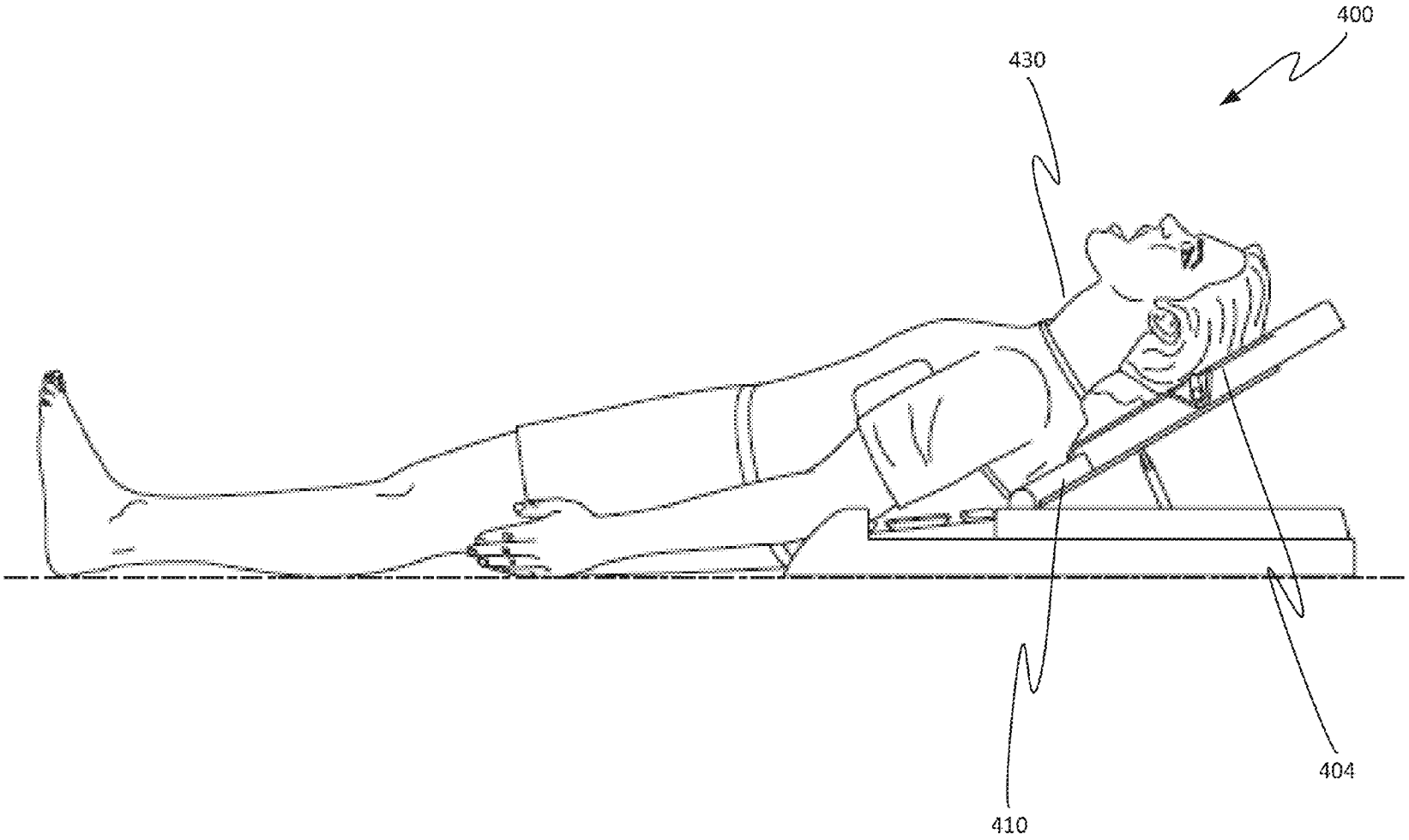
FIG. 4I depicts a patient maintained in the sniffing position using the support structure of FIG. 4A according to embodiments.

FIG. 4I shows a patient 430 positioned on the support structure 400. Here, upper support 404 is extended along the roller track 410 as it is elevated, thereby maintaining the patient in the proper "sniffing position." Here, the thoracic plate 406 provides a static amount of elevation of the thorax, specifically the heart, in the range of about 3 cm to 7 cm. Such an elevation of the thorax promotes increased blood flow through the brain. As seen here, there are three primary contact points for the individual. The neck support 416 contacts the spine in the region of the C7-C8 vertebrae, the thoracic plate 406 contacts the back in line with the sternum, and the lower body (legs and buttocks) rest on a support surface. The lower body contact may provide stability and anchor the patient and the support structure 400. It will be recognized that other contact points may exist as a result of individuals of different body sizes and other physiological factors. As shown here, the head of the individual may extend at least partially through the upper support 404, such as by being positioned within shaped area 426. This may help promote the sniffing position. Additionally, the individual may be properly positioned by positioning armpit supports 428 under the individual's underarms. This will not only help properly position the individual, but armpit supports 428 may help prevent the individual from sliding down the support structure 400, thus keeping the individual properly aligned with a chest compression device.

In some embodiments, a chest compression/decompression system may be coupled with a support structure. Proper initial positioning and orientation, as well as maintaining the proper position, of the chest compression/decompression system, is essential to ensure there is not an increased risk of damage to the patient's rib cage and internal organs. This correct positioning includes positioning and orienting a piston type automated CPR device. Additionally, testing has shown that such CPR devices, even when properly positioned, may shift in position during administration of head up CPR. Such shifts may cause an upward motion of the device relative to the sternum, and may cause an increased risk of damage to the rib cage, as well as a risk of ineffective CPR. If a piston of the CPR or chest compression/decompression device has an angle of incidence that is not perpendicular to the sternum (thereby resulting in a force vector that will shift the patient's body), there may be an increased risk of damage to the patient's rib cage and internal organs. However, it will be appreciated that certain chest compression devices may be designed to compress the chest at other angles.

The degree of upward shift was studied in normal human volunteers. During the elevation to a head up position, subjects were moved out of the initial sniffing position. This was due to the upper torso curling during the lifting or elevation of the patient's upper body. Such torso curling also created a significant thoracic shift, meaning that as the upper body and head lifted, the thoracic plate and chest pivoted forward. The shift is significant when a support structure is used in conjunction with an automated chest compression or active compression decompression (ACD) CPR device, such as the LUCAS device, as the thoracic shift effectively changes an angle of the plunger and/or suction cup of the ACD CPR device relative to the thorax. Such an angle change may cause the plunger to be out of alignment, which may result in undesired effects. The results of thoracic shift were tested using a support structure having an extendable upper support. Table 1 shows the thoracic shift measured in 11 subjects using the support structure. The listed shifts represent a distance change of where the plunger contacts the subject's chest when the subject is manipulated between supine and head up positions.

TABLE 1

Thoracic Shift of Subjects With Only Extendable Upper Support

| Gender | Height | Weight | Thoracic Shift 1 (mm) | Thoracic Shift 2 (mm) |
|---|---|---|---|---|
| M | 6' | 177 | 17.5 | 17 |
| M | 6'1" | 200 | 17.5 | 17.5 |
| M | 6' | 172 | 7.5 | 8 |
| M | 5'11" | 195 | 21 | 20 |
| M | 6'4" | 260 | 9.5 | 10 |
| M | 6'2" | 240 | 14 | 14 |
| M | 5'10" | 188 | 17 | 17.5 |
| M | 5'11" | 190 | 22 | 23 |
| F | 5'6" | 135 | 18 | 18 |
| F | 5'2" | 135 | 12.7 | 12.7 |
| F | 5'7" | 218 | 12.7 | 12.7 |

To record the thoracic shift, each subject was positioned on the support structure positioned on a table. The subject's nipple line was positioned approximately at a center of the thoracic plate of the support structure. The upper support of the support structure was adjusted, insuring that the subject was in the sniffing position. A plunger of an active compression decompression device (LUCAS device) was lowered and positioned on the subject's chest according to device requirements. The position of the suction cup of the plunger was marked on the subject using a marker while in the supine position (with a lower edge of the suction cup as a trace edge). The position of the sliding upper support of the support structure was recorded. The support structure was then elevated to 15° above the horizontal plane defined by the table. A new position of the suction cup was marked on the subject while in the elevated position. The position of the sliding upper support was again recorded. The support structure was then elevated to 30° above the horizontal plane. The position of the suction cup was again marked on the subject's chest. The subject was then lowered to the supine position and the process was repeated two times with the LUCAS suction cup in the same starting position. The process was then repeated another two times with the subject's arms strapped to the LUCAS device. In some of these test subjects, the center of the piston moved as little as 0.95 cm to over 2.0 cm. The potential for piston movement is a potential significant clinical concern. Based upon this study in human cadavers, a means to adjust the compression piston angle with the chest during elevation of the heart and thorax is needed to avoid damage during CPR.

Figure 5A:
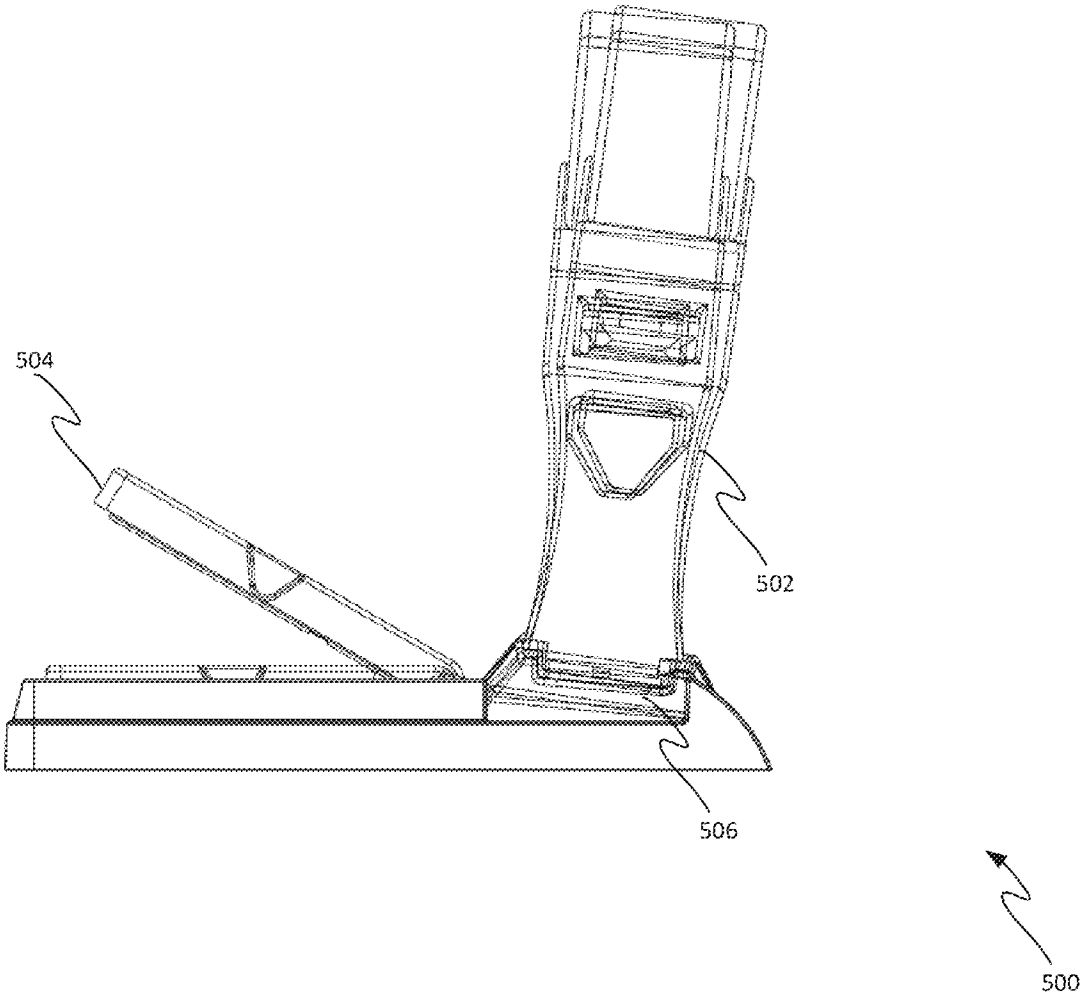
FIG. 5A depicts a support structure with a tilting thoracic plate according to embodiments.

FIGS. 5A-5E depict a support structure 500 for coupling with a chest compression/decompression or CPR device 502 while combating the effects of the thoracic shift and thoracic misalignment caused by improperly aligning the CPR device and/or improperly maintaining such position and alignment. Support structure 500 may include similar features as support structure 400, as well as the other support structures described herein. FIG. 5A shows an upper support 504 of support structure 500 that is in an elevated position. During elevation, a thoracic plate 506 is tilted to control a corresponding shift of the thorax relative to CPR device 502. For example, a lever, cam, or other connection may link the tilt of the thoracic plate 506 with the elevation of the upper support 504, thereby causing the CPR device 502 to move down and at a slightly forward angle. This tilting insures that the thorax and sternum are properly aligned with a piston of the CPR device 502 to provide safe and effective head up CPR. Oftentimes proper alignment involves the piston being perpendicular, or substantially perpendicular, to the sternum, however in other cases non-perpendicular alignments may be desirable. In some embodiments, the thoracic plate 506 may have a default angle relative to a horizontal plane of between about 0° and 10°. The tilt may provide an additional 2°-15° of tilt to accommodate the shifting thorax of the patient and to maintain proper alignment of the CPR device 502.

Figure 5B:
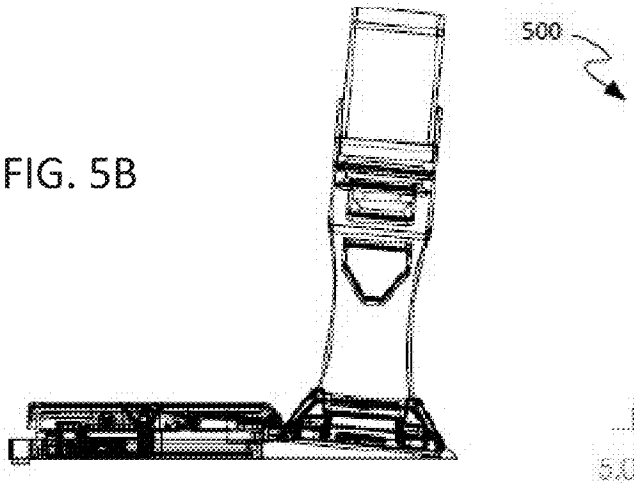
FIG. 5B depicts the support structure of FIG. 5A in a lowered position according to embodiments.
Figure 5C:
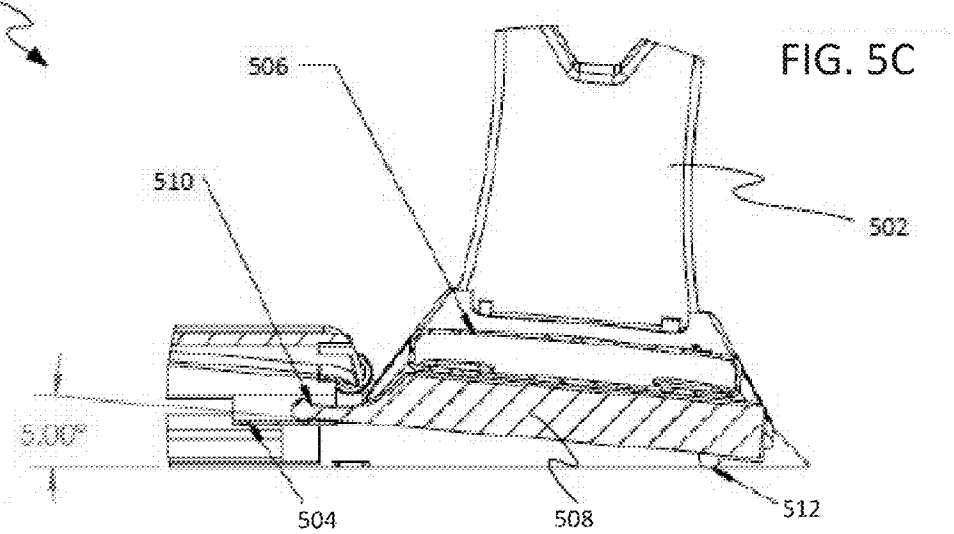
FIG. 5C depicts the support structure of FIG. 5A in a lowered position according to embodiments.
Figure 5D:
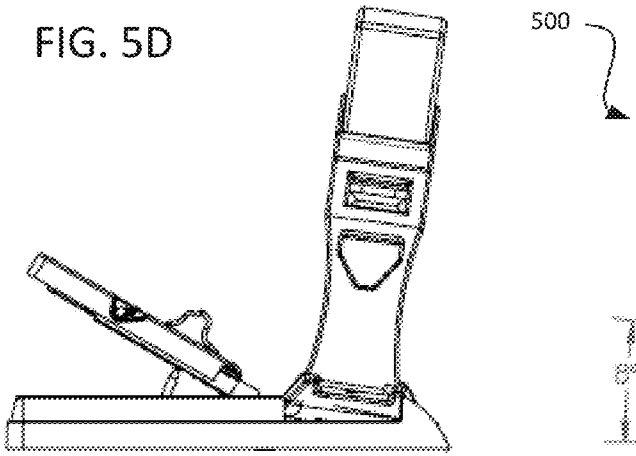
FIG. 5D depicts the support structure of FIG. 5A in a raised position according to embodiments.
Figure 5E:
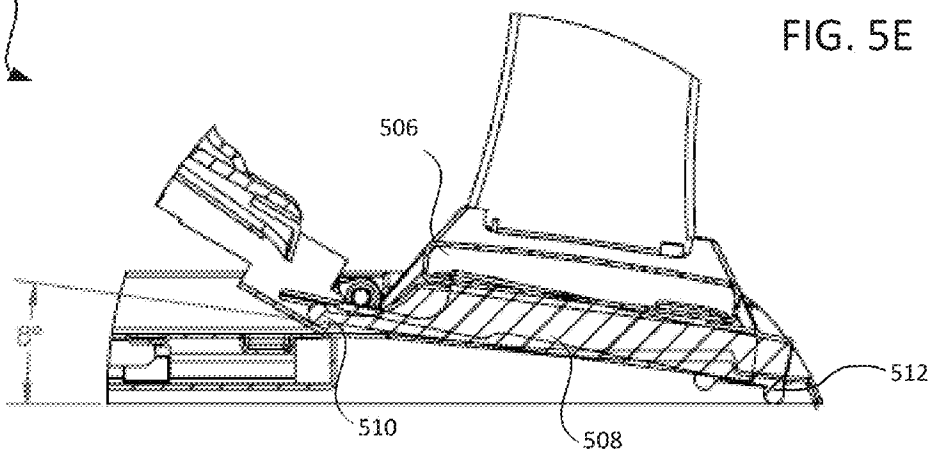
FIG. 5E depicts the support structure of FIG. 5A in a raised position according to embodiments.

FIG. 5B shows the upper support 504 in a lowered position. In the lowered position, the thoracic plate 506 has a default angle of elevation of approximate 5°, although it will be appreciated that other default angles may be utilized in accordance with the present invention, such as, for example, in the range of about 0° to about 15°. As seen in FIG. 5C, the thoracic plate 506 is attached to a carriage 518 that is attached by rollers 510 and pivots 512 to the upper support 504. For example, the roller 510 may be disposed on a rail 540 of upper support 504. The upper support 504 may be elevated to the position shown in FIG. 5D. In some embodiments, upper support 504 may be extended along a length of the support structure 500 during elevation of the upper support 504. As seen in FIG. 5E, during elevation of the upper support 504, the roller 510 and carriage 518 are lifted upward by the movement of the rail 540, thereby lifting and/or tilting the thoracic plate 506 (here by 3° to a total angle of 8°), which causes a similar change in position or orientation of the CPR device 502. The synchronization of movement of the upper support 504, thoracic plate 506, and CPR device 502 insures that the CPR device 502 is maintained at a proper position and angle of incidence relative to the sternum throughout the head up CPR process to manage thoracic shift. The proper position and alignment of a plunger of the CPR device 502 are necessary to prevent damage to the patient's thorax. The plunger should be positioned between about 2 and 5 cm above the base of the sternum and must stay within about 1 cm of its initial position. The plunger must be angled within about 20-25 degrees of perpendicular relative to the patient's sternum. In other words, the plunger may be positioned at an angle of between about 70 and 110° relative to the patient's chest. In some embodiments, this angle may be adjusted or otherwise controlled to achieve desired compression/decompression effects on the patient. In conjunction with this position, it is desirable for the individual's thorax to be raised between about 3 cm and 7 cm, at the location of the heart, above a horizontal plane on which the lower body is supported. Additionally, the head may be raised between about 15 cm and 25 cm above the horizontal plane, and the individual may be in the sniffing position.

Figure 6A:
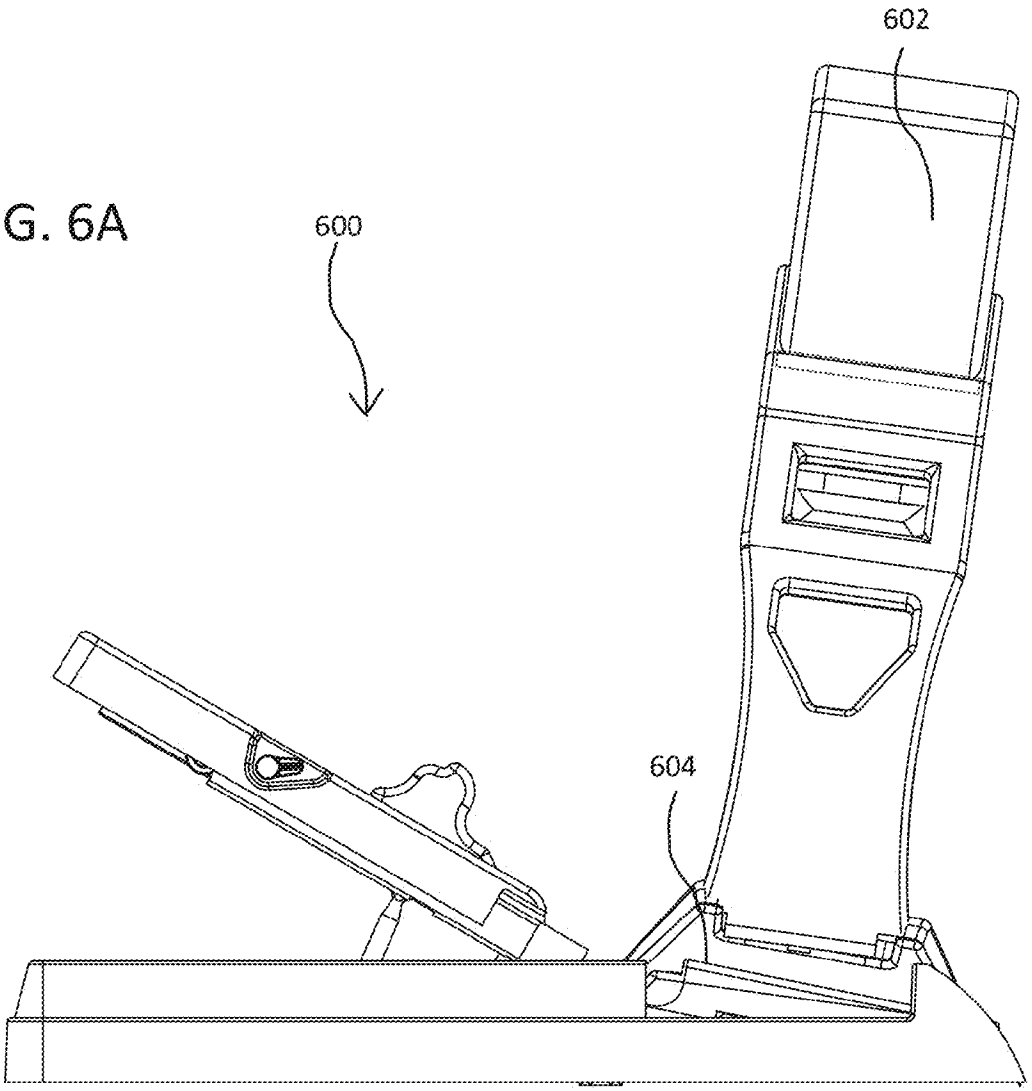
FIG. 6A depicts a support structure with a tilting and shifting thoracic plate according to embodiments.
Figures 6B, 6C:
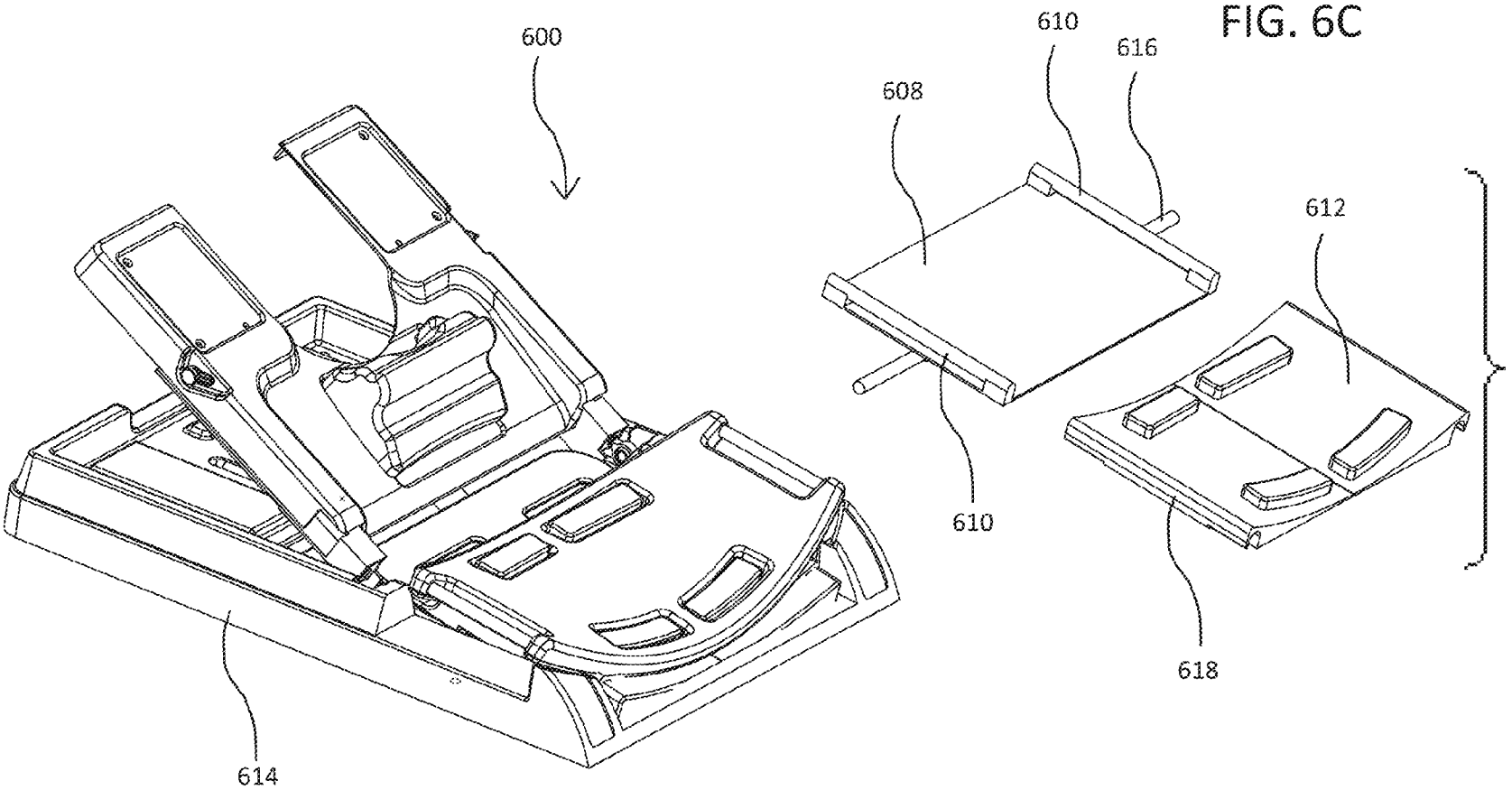
FIG. 6B depicts a pivoting base of the support structure of FIG. 6A with a according to embodiments.
FIG. 6C depicts a pivoting base and cradle of the support structure of FIG. 6A with a according to embodiments.

FIGS. 6A-6E depict a support structure 600 for coupling with a chest compression/decompression or CPR device 602 while combating the effects of the thoracic shift and thoracic misalignment caused by improperly aligning the CPR device 602 and/or improperly maintaining such position and alignment. Support structure 600 may include similar features as support structures 400 and 500, as well as the other support structures described herein. For example, support structure 600 may include an upper support that is extendable along a length of the support structure 600 during elevation of the upper support. FIGS. 6A and 6B show support structure 600 having an independently adjustable thoracic plate 606. The natural tendency of the sternum, as the body is lifted/elevated, is to migrate in a downward direction due to the natural curving motion of the upper body. Support structure 600 includes an automatic and/or manual adjustment mechanism that allows a lengthwise position and/or an angular position of the thoracic plate 606 to be adjusted to account for the migrating sternum. Such an adjustment mechanism may be locked to set a position of the thoracic plate 606 and/or unlocked to allow adjustments to be made at any time during the elevation and/or CPR administration processes.

Figure 6D:
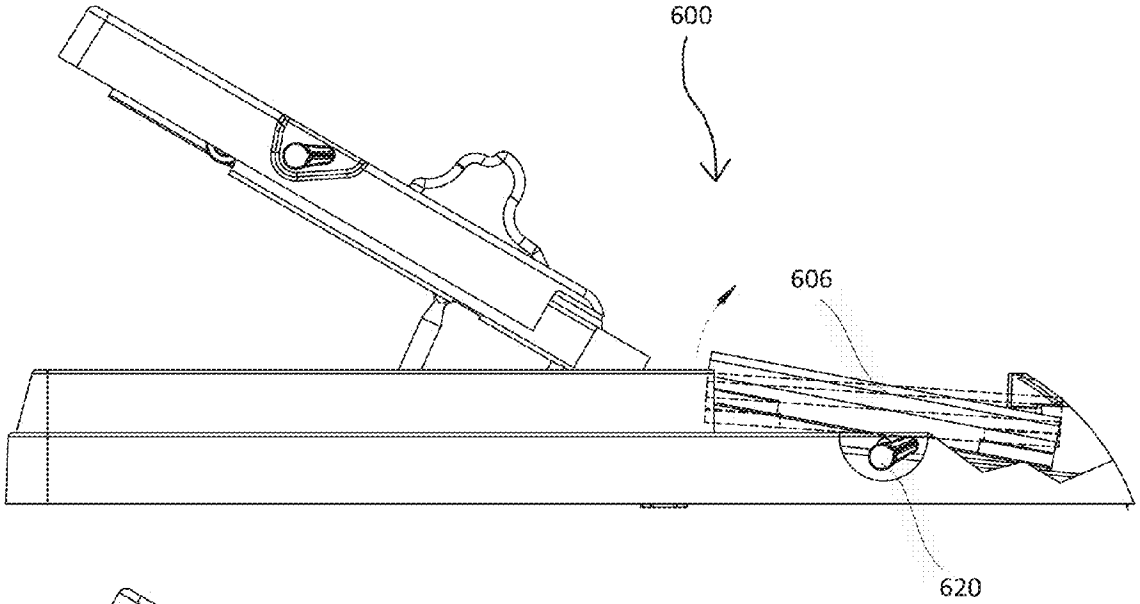
FIG. 6D demonstrates the pivoting ability of the supports structure of FIG. 6A according to embodiments.
Figure 6E:
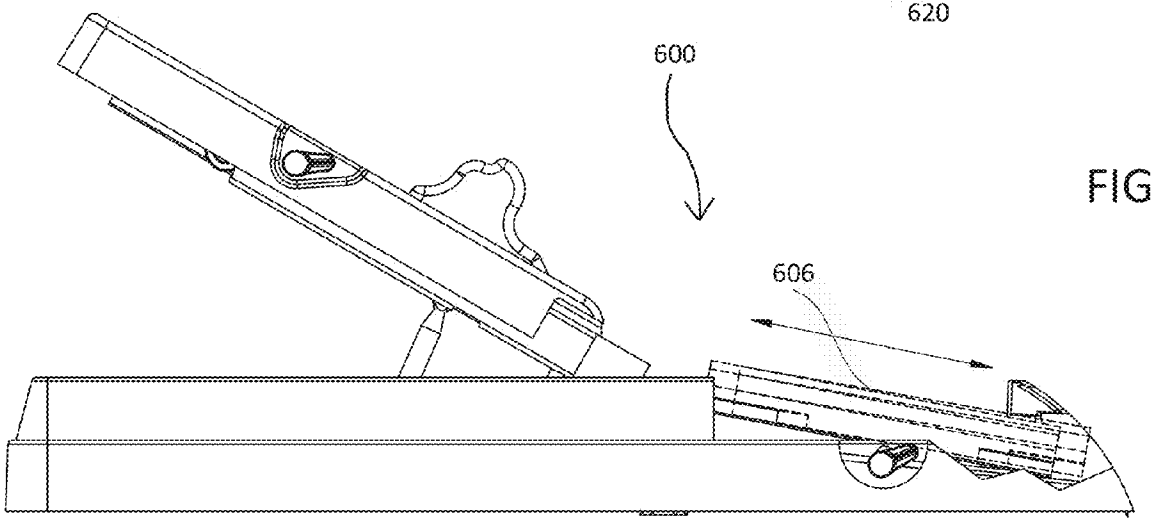
FIG. 6E demonstrates the shifting ability of the supports structure of FIG. 6A according to embodiments.

Thoracic plate 606 includes a pivoting base 608. As shown in FIG. 6C, pivoting base 608 may include one or more rails or tracks 610 that may guide a corresponding roller, track, or other guide 618 of the thoracic plate 606 and/or a base 612 of the thoracic plate 606. Pivoting base 608 may pivotably engage with a cradle or other mating feature of a base 614 of the support structure 600. For example, pivoting base 608 may include one or more rods 616 that may be received in corresponding cradles or channels in base 614. The rods 616 may rotate or otherwise pivot within the channels to allow the pivoting base 608 to pivot about the axis of the rods 616. Such pivoting allows the thoracic plate 604 to be pivoted to adjust an angle of the CPR device 602 relative to the patient's sternum once properly elevated as shown in FIG. 6D. The tracks 610 may be engaged with guide 618 to allow the thoracic plate 606 and/or base 612 to be slid laterally along the pivoting base 608. This allows the CPR device 602 to be laterally aligned with the patient's sternum while elevated as indicated in FIG. 6E. A locking lever 620 may be included to lock one or both of the pivoting and the lateral movement of the thoracic plate 606 once a desired orientation is achieved. In some embodiments, the thoracic plate 606 may have a freedom of adjustability of between about +/−7° of tilt or pivot relative to its default position and/or between about +/−1.5 inches of lateral movement relative to its default position.

During administration of various types of head and thorax up CPR, it is advantageous to maintain the patient in the sniffing position where the patient is properly situated for endotracheal intubation. In such a position, the neck is flexed and the head extended, allowing for patient intubation, if necessary, and airway management. During elevation of the upper body, the sniffing position may require that a center of rotation of an upper support structure supporting the patient's head be co-incident to a center of rotation of the upper head and neck region. The center of rotation of the upper head and neck region may be in a region of the spinal axis and the scapula region. Maintaining the sniffing position of the patient may be done in several ways.

In some embodiments, the motors may be coupled with a processor or other computing device. The computing device may communicate with one or more input devices such as a keypad, and/or may couple with sensors such as flow and pressure sensors. This allows a user to select an angle and/or height of the heart and/or head. Additionally, sensor inputs may be used to automatically control the motor and angle of the supports based on flow and pressure measurements, as well as a type of CPR and/or ITP regulation.

To confirm the effectiveness of the use of devices such as the support structure 600 described above, a study was performed using 20 human cadavers. The study confirmed that such a device is capable of elevating the head and thorax while at the same time assuring that the chest compression device, suction cup and piston, sternal interface remained at right angles to the cadaver and did not migrate upwards or downwards on the chest during chest elevation. Chest x-rays were used to assess if the correct position was maintained between the body and the CPR device so CPR would be performed orthogonally to the body according to AHA Guidelines, and not orthogonally to the ground. A HUD, similar to support structure 600, was used to automatically elevate the head and shoulders and thorax. This HUD was coupled to a LUCAS device to standardize the chest compression. The suction cup of the LUCAS device was positioned as recommended by the manufacturer. Several anatomical reference points were recorded in the supine and head up positions for the chest and the head.

In the supine position, a mark was drawn on the cadaver skin at the LUCAS cup lower point. After elevation, the LUCAS cup lower point movement was compared to this reference line and the result was recorded. Prior to the performance of CPR, there was essentially no movement of the lower cup point relative to the reference line, indicating that the support structure was appropriately designed to prevent any migration of the LUCAS cup relative to the patient's chest during the elevation process.

CPR was also performed on some cadavers with the LUCAS device to confirm that during actual chest compression the cup lower point stayed at the skin mark. Elevation of the head and thorax using the HUD was performed. The movement of the body to the main part of the HUD was recorded with arms immobilized in this manner.

A series of X-rays were performed to demonstrate that during CPR the LUCAS device remained orthogonal to the sternum. There was no movement at all of the suction cup on the sternum on 20 cadavers in any direction with elevation of the head and thorax with the HUD. The study also found that the difference of angle with each cadaver between the LUCAS and the body was not significantly different in the supine and the head up position. It is important to note that the HUD itself, even in the flat position, elevated the heart and head about 5 cm relative to the flat surface upon which the HUD rested, whereas the lower back, buttocks and legs, which were not on the HUD itself but resting on a flat surface, were not elevated at all.

One result of this study is that during elevation of the head and thorax with the HUD, CPR could be continued at the recommended compression point and angle on all cadavers at the anatomically AHA recommended location with no migration of the compression location. The CPR compression point and the sternal manubrium rose significantly relative to the floor or bed. The head also elevated as expected. The HUD, by its design, enables the performance of CPR at the correct spot and at the correct angle relative to the chest when the head and thorax are both supine and elevated.

Figure 7:
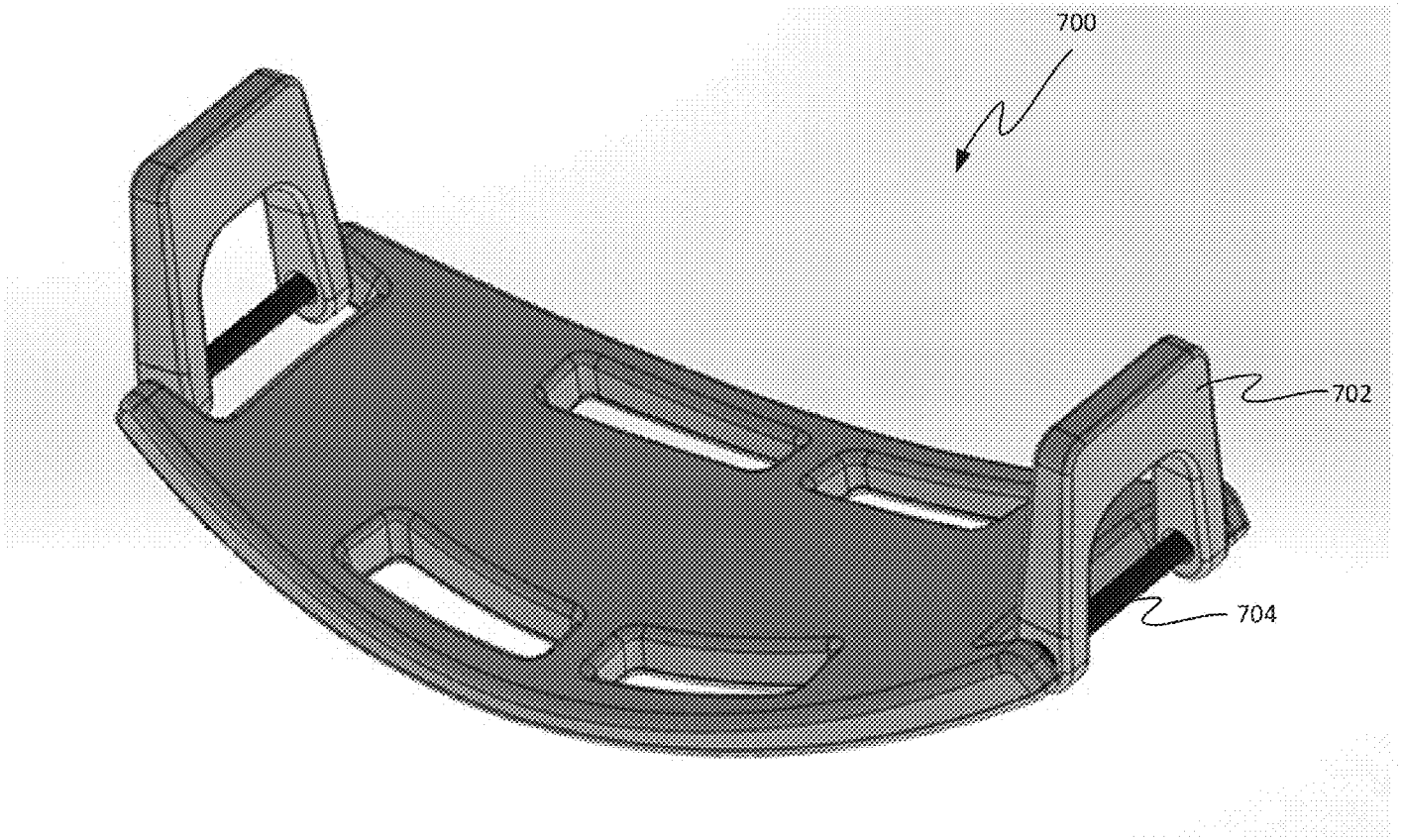
FIG. 7 depicts stabilizing mechanisms of a thoracic plate according to embodiments.

In some embodiments, a support structure may include additional patient positioning aids. For example, a thoracic plate 700 of FIG. 7 includes armpit supports 702. Armpit supports 702 may be coupled with couplings 704 for receiving a chest compression or other CPR device and/or may be positioned elsewhere on a support device. Armpit supports 702 are configured to rest below a patient's underarms between the torso and the upper arms to help maintain the patient in the proper position relative to the thoracic plate 700 and the support device (not shown). Additionally, the armpit supports 702 may stabilize the patient, preventing the patient from slipping downward on the support structure during elevation and/or the administration of CPR.

Figure 8:
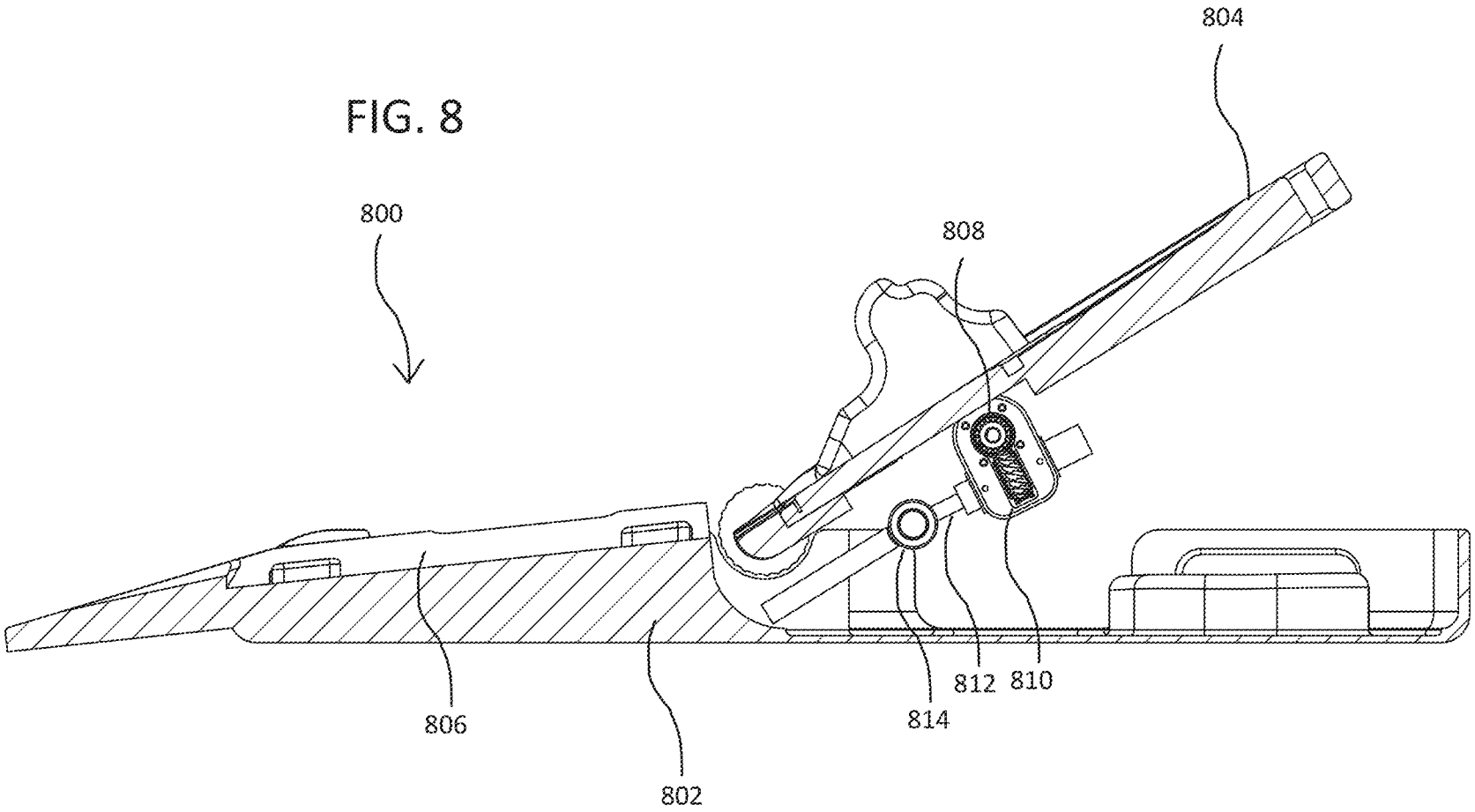
FIG. 8 depicts an elevation mechanism of a support structure according to embodiments.

FIG. 8 depicts a support structure 800 for elevating an individual's head, heart, and/or neck. Support structure 800 may be similar to the support structures described above and may include a base 802, an upper support 804, and a thoracic plate 806. In some embodiments, the upper support may be elevated using an elevation device, such as gas springs (not shown) that utilize stored spring energy or an electric motor 808. Electric motor 808 may be battery powered and/or include a power cable. During operation, electric motor 808 may raise, lower, and/or maintain a position of the upper support 804. Here, the electric motor 808 operates through a gearbox to generate right angle linear motion. This occurs by the motor shaft having a worm gear attached to it. This worm gear drives a right angle worm wheel 810 that has a lead nut pressed into it. The rotation of the worm wheel/lead nut assembly causes a lead screw 812 to move in a direction perpendicular to the original motor shaft. As lead screw 812 extends, it pushes against a fixed linkage that has pivots at each end, thereby forcing the elevation of the upper support by pivoting about joint 814 to raise and lower the upper support 804. It will be appreciated that other elevation mechanisms may be utilized to raise and lower the upper support. In some embodiments, as the upper support 804 is elevated, it may extend along a length of the support structure 800 to accommodate movement of the patient as described elsewhere herein.

In some embodiments, the support structure 800 may include a rail (not shown) that extends at least substantially horizontally along the upper support 804 and/or the thoracic plate 806, with a fixed pivot point near the thoracic plate 806, such as near a pivot point of the thoracic plate 806. The rail is configured to pivot about the fixed pivot point and is coupled with the thoracic plate 806 such that pivoting of the rail causes a similar and/or identical pivot or tilt of the thoracic plate 806. A collar (not shown) may be configured to slide along a length of the rail. The collar may include a removable pin (not shown) that may be inserted through an aperture defined by the collar, with a portion of the pin extending into one of a series of apertures defined by a portion of the upper support 804. By inserting the pin into one of the series of apertures on the upper support 804, pivoting or tilting of the rail, and thus the thoracic plate 806, is effectuated by the elevation of the upper support 804. By moving the position of the pin closer to the fixed pivot point, a user may reduce the angle that the thoracic plate 806 pivots or tilts, while moving the pin away from the fixed pivot point increases the degree of elevation of the rail, and thus increases the amount of tilting of the thoracic plate 806 while still allowing both the thoracic plate 806 and the upper support 804 to return to an initial supine position. In this manner, a user may customize an amount of thoracic plate tilt that corresponds with a particular amount of elevation. For example, with a pin in a middle position along the rail, elevating the upper support 804 to a 45° angle may cause a corresponding forward tilt of the thoracic plate 806 of 12°. By moving the pin to a position furthest from the fixed pivot point along the rail, upper support 804 to a 45° angle may cause a corresponding forward tilt of the thoracic plate 806 of 20°. It will be appreciated that any combination of upper support 804 and thoracic plate 806 elevation and/or tilting may be achieved to match a particular patient's body size and that the above numbers are merely two examples of the customization achievable using a pin and rail mechanism.

Figure 9:
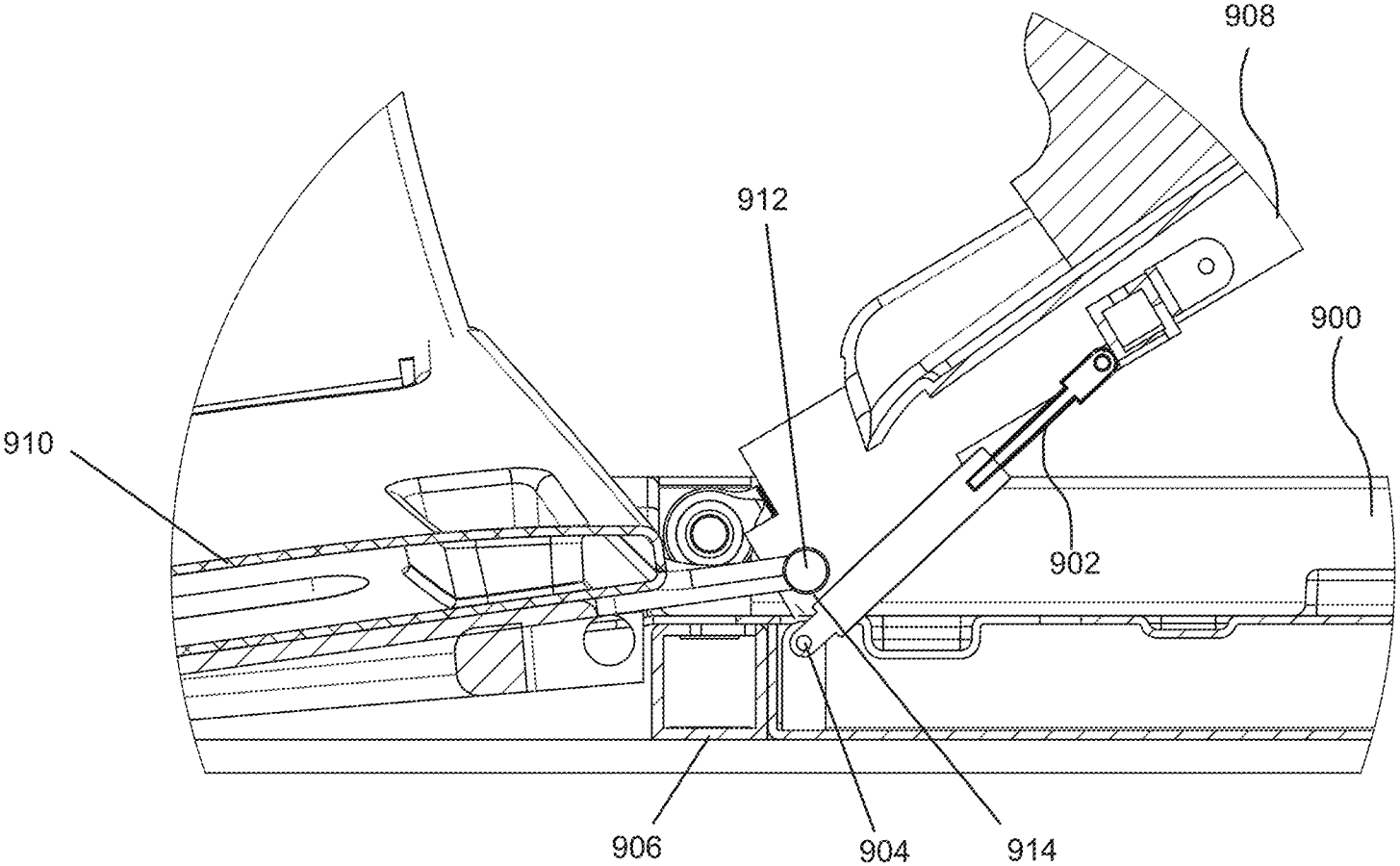
FIG. 9 depicts an elevation mechanism of a support structure according to embodiments.

For example, a gas strut may be used to elevate the upper support 804 in a similar manner. FIG. 9 depicts a support structure 900 that utilizes a gas strut 902. Ends of the gas strut 902 may be positioned on support structure 900 similar to the ends of the motor mechanism in the embodiment of FIG. 8. For example, one end of the strut 902 may be positioned at a pivot point 904 near a base 906 of the support structure 900, while the other end is fixed to a portion of an upper support 908 of the support structure 900. The strut 902 may be extended or contracted, just as the lead screw extends and contracts, which drives elevation changes of the upper support 908. In some embodiments, an angle of a thoracic plate 910 may be adjusted as a result of the elevation of the upper support 908 changing. A roller or other support 912 of the thoracic plate 910 may be positioned on a rail 914 or other support feature of the upper support. In the lower or supine position, the rail 914 supports the roller 912 at a low level, and maintains the thoracic plate 910 at an initial angle relative to a horizontal plane. As the upper support 908 is elevated, so is the rail 914. The elevation of rail 914 forces roller 912 upward, thereby tilting the thoracic plate 910 away from the upper support 910 and increasing an angle of the thoracic plate 910 relative to the horizontal plane, which may help combat thoracic shift. For example, elevating the upper support 910 from a lowest position to a fully raised position may result in the thoracic plate 910 tilting between 3 and 10 degrees. In some embodiments, as the upper support 910 is elevated, it may extend along a length of the support structure 900 to accommodate movement of the patient as described elsewhere herein.

Figure 10:
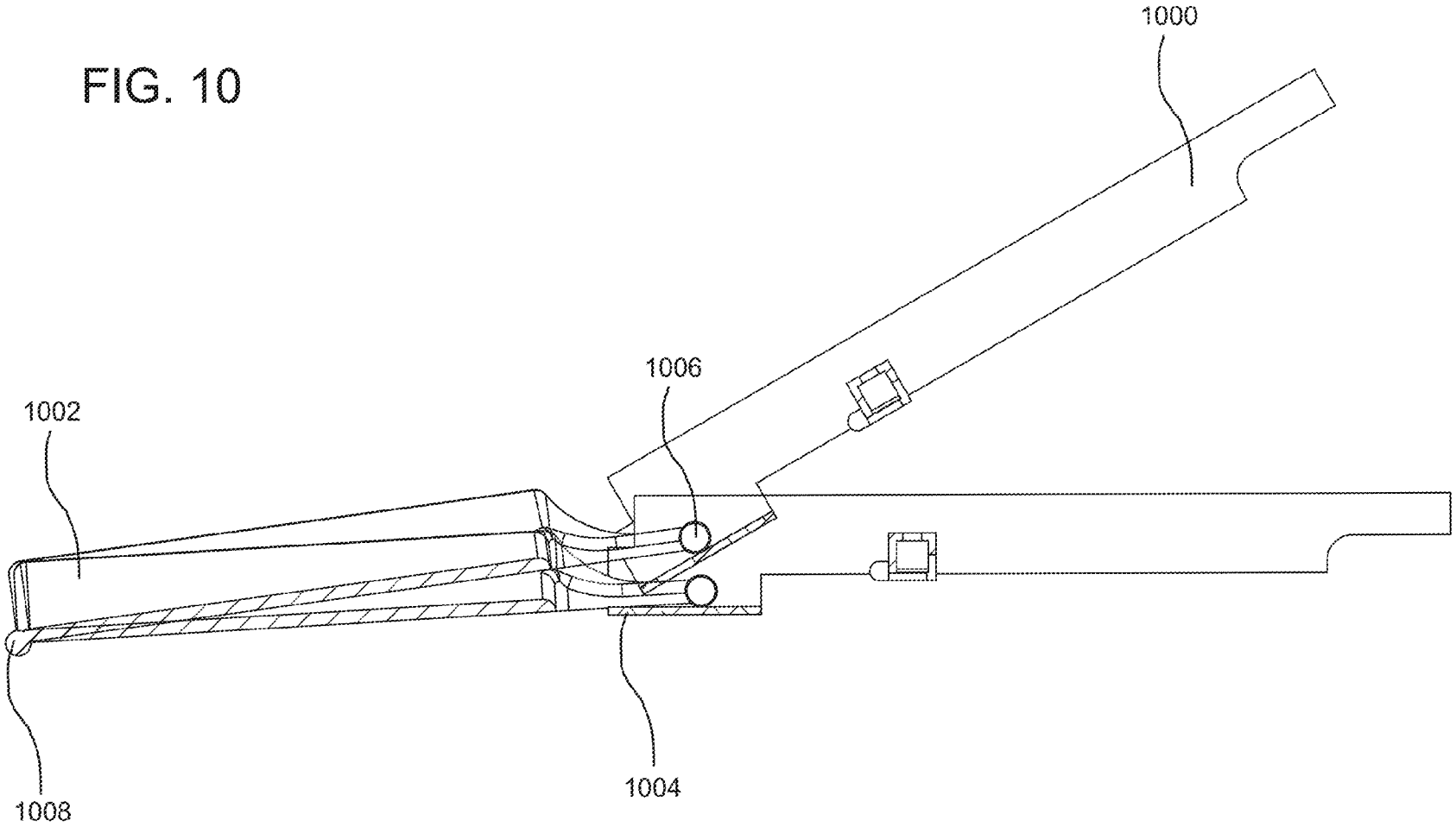
FIG. 10 depicts a simplified view of an elevation/tilt mechanism of a support structure according to embodiments.

FIG. 10 provides a simplified view of an elevation/tilt mechanism, similar to that used in support structure 900. An upper support 1000 is pivotally coupled with a thoracic plate 1002 such that as the upper support 1000 is elevated from an at least substantially horizontal or supine position to an elevated position, the thoracic plate 1002 is tilted in a direction away from the upper support 1000. The upper support 1000 includes a track or rail 1004 that is elevated along with the upper support 1000. A roller 1006 or other support mechanism is included on an extension 1004 of the thoracic plate 1002. The roller 1006 is positioned atop the rail 1004 such that as the rail 1004 is elevated, the roller 1006 is lifted upwards. This upward lift causes a proximal edge of the thoracic plate 1002 closest to the upper support 1000 to be raised while a distal edge 1008 of the thoracic plate 1002 stays in place and serves as a pivot point, causing the thoracic plate 1002 to tilt away from the upper support. In this manner, the thoracic plate 1002 may be tilted to combat thoracic shift merely by elevating the upper support 1000.

Figure 11A:
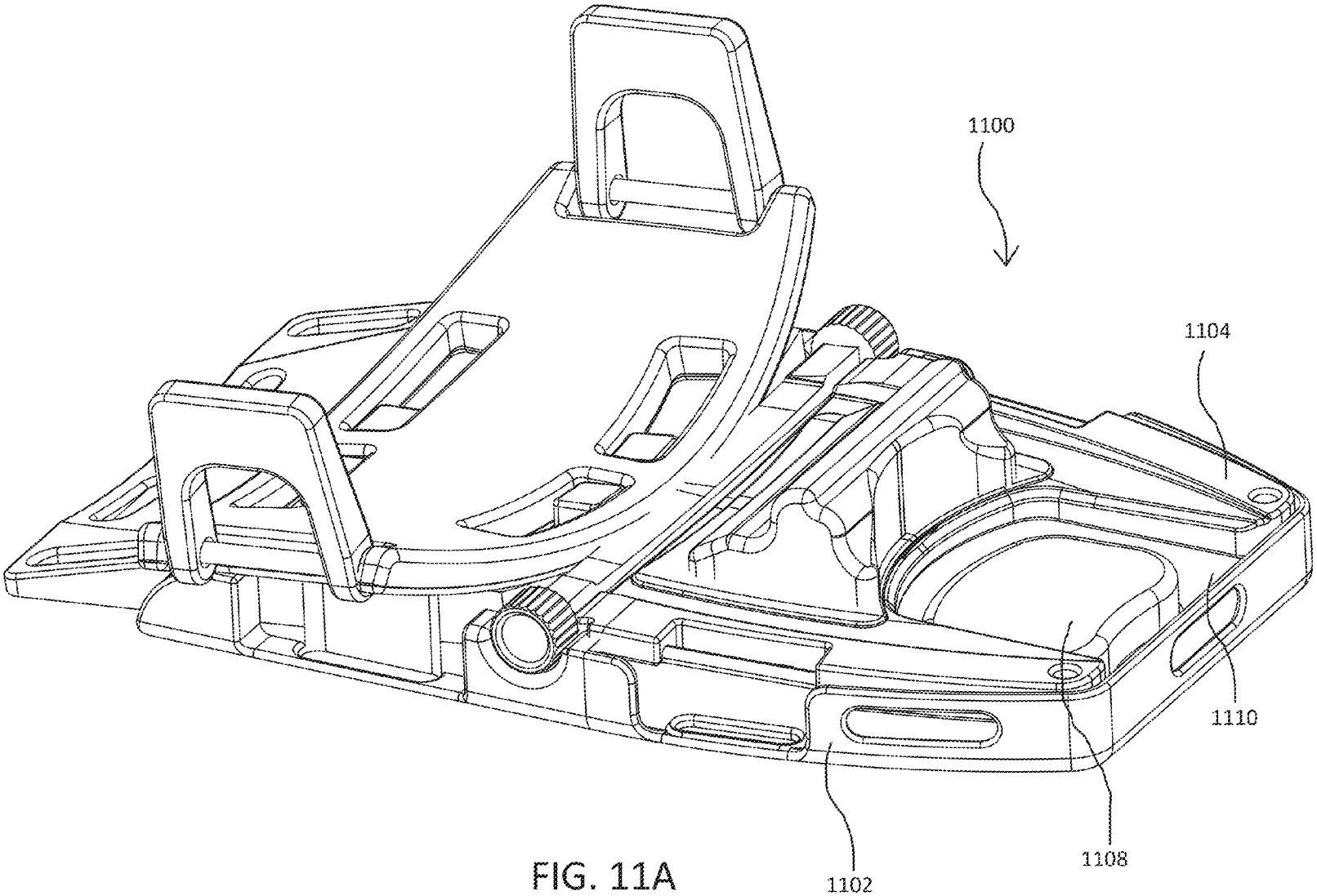
FIG. 11A depicts a support structure having a head pad according to embodiments.
Figure 11B:
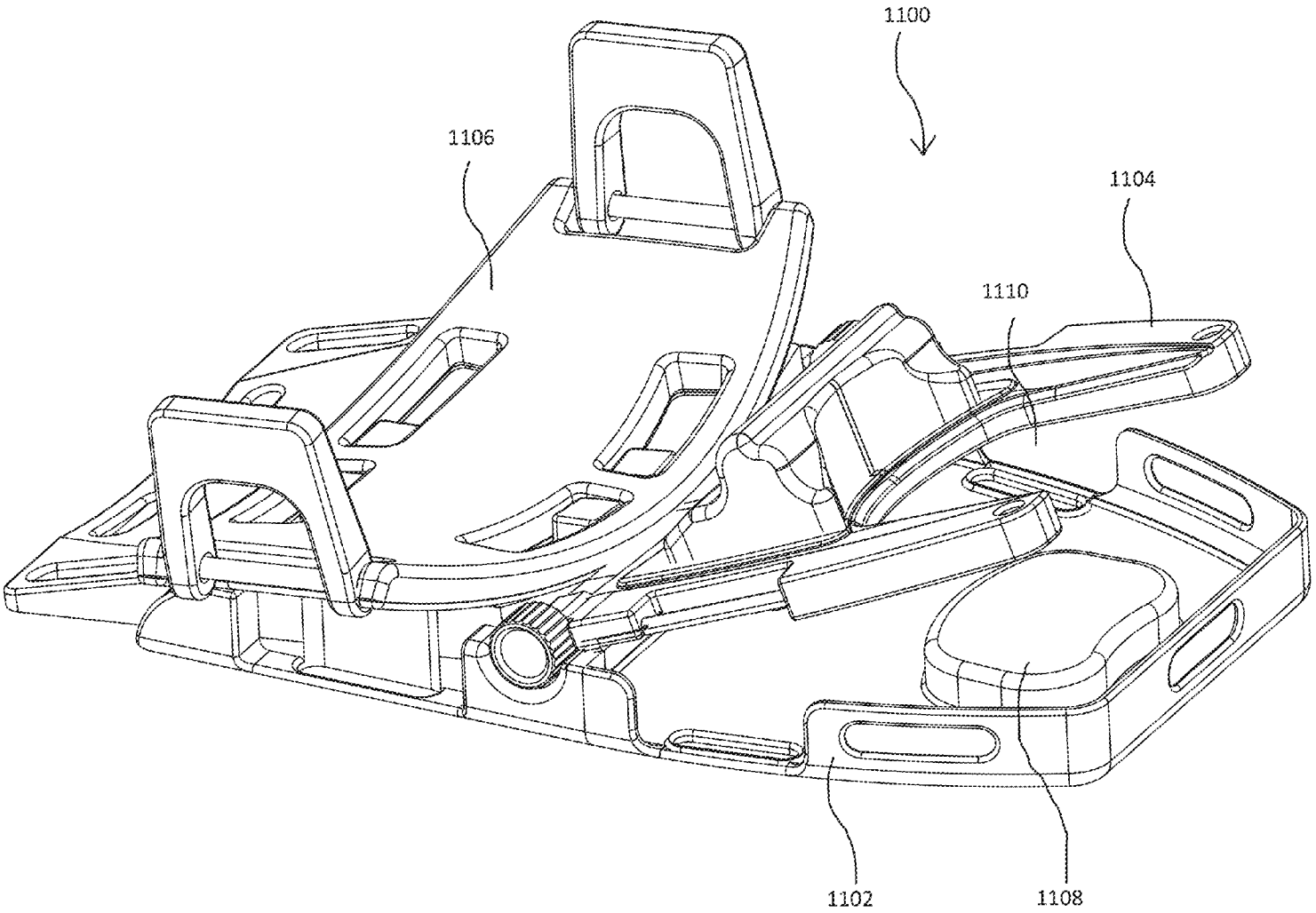
FIG. 11B depicts another view of the support structure of FIG. 11A according to embodiments

In some embodiments, additional support may be needed for a patient's head as it extends through an opening of the shaped area of an upper support to prevent the neck from hyperextending and to maintain the patient in the sniffing position. FIGS. 11A and 11B show a support structure 1100 having a base 1102, an upper support 1104, and a thoracic plate 1106 similar to those described above. Base 1102 includes a pillow or pad 1108. Pad 1108 is aligned with an opening 1110 of a shaped area for the patient's head, thus providing head support for the patient. Pad 1108 may be made of foam or other material that may support the patient's head while the upper support 1104 is in a lowered or relatively supine position. As the upper support 1104 is elevated, the patient's head will lift from pad 1108, which stays with base 1102 as seen in FIG. 11B. In some embodiments, pad 1108 may be contoured to match the shape of a head and/or to help maintain the head in a proper alignment by preventing the head from twisting sideways. For example, a U-groove and/or V-groove shape along a longitudinal axis of the pad 1108 may ensure that the head is properly aligned.

Figure 12A:
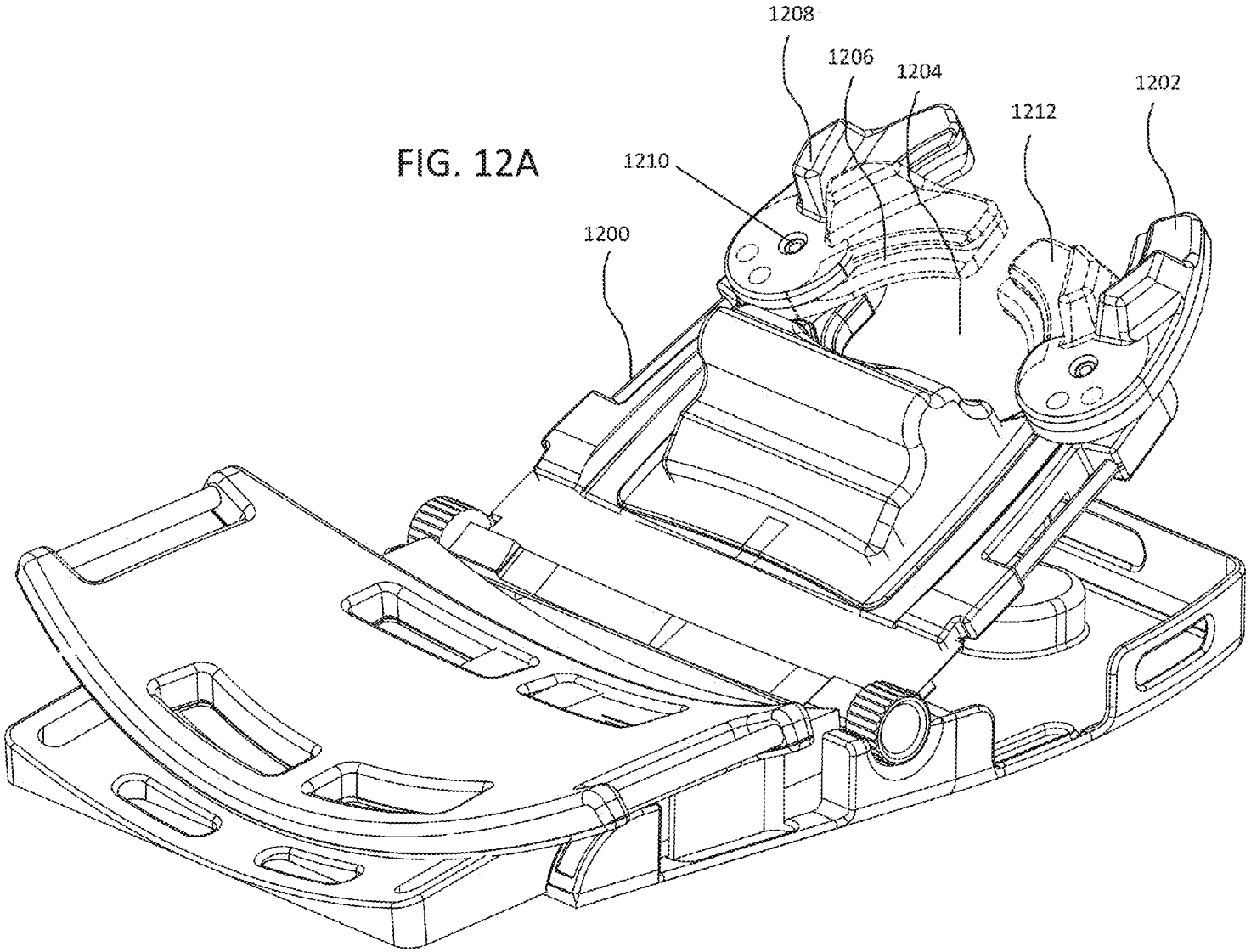
FIG. 12A depicts a head cradle of a support structure according to embodiments.

In some embodiments, additional head support may be desired during the elevation of the upper support, which may also cause the upper support to extend along a length of the support structure. FIG. 12A depicts an upper support 1200 having movable flaps 1202 that can be pivoted about a pivot point 1210 to a cradling position 1212. In cradling position 1212, flaps 1202 may be suspended below and cradle the patient's head while the upper support 1200 is elevated. Such cradling may prevent the hyperextension of the patient's neck and promote the sniffing position as the patient's head is positioned within opening 1204. Flaps 1202 may be positioned by a user to sit within a part of opening 1204 to support the patient's head. For example, the flaps 1202 may be pivoted from a first position where they form an uppermost portion of the upper support 1200 to a second position within opening 1204 where the flaps 1202 may support the patient's head. In some embodiments, the flaps 1202 may include a lower portion 1206 that actually supports the head. The lower portion 1206 has a surface that is below a main surface 1208 of the upper support 1200. This allows the patient's head to be supported below the main surface 1208 to promote the sniffing position for proper airway management. In some embodiments, flaps 1202 may be pivotable in a downward position to further adjust a height and level of support of the head.

Figure 12B:
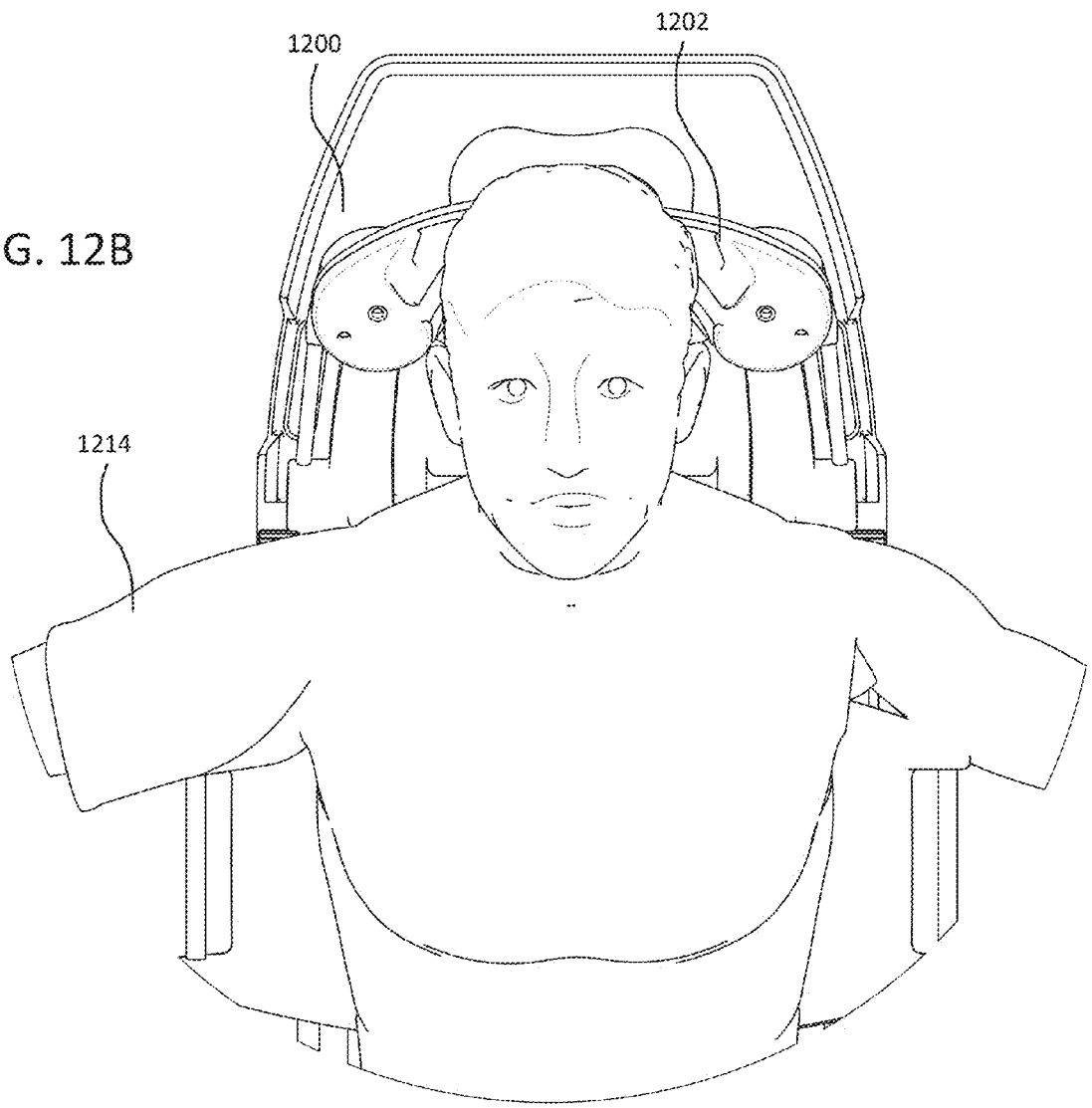
FIG. 12B depicts a patient's head positioned on the head cradle of the support structure of FIG. 12A according to embodiments.

FIG. 12B shows a patient 1214 positioned on the upper support 1200 with his head being supported by flaps 1202. Here, flaps 1202 have both been pivoted to a position below the patient's head such that as the patient 1214 is elevated, his head is supported sufficiently that his neck does not hyperextend. The flaps 1202 may be positioned to maintain the patient 1214 in the sniffing position throughout elevation of the upper support 1200.

It will be appreciated that other cradle mechanisms may be used in conjunction with the support structures described herein. For example, an adjustable plate may be coupled with the upper support, allowing a user to adjust a height of the plate to provide a desired level of support. Other embodiments may include a net or cage that may extend below an opening of the upper support to maintain the head in a desired position. In some embodiments, a cradle mechanism may be coupled with the upper support using surgical tubing, a bungee cable, or other flexible or semi-rigid material to provide support for patients of different sizes.

Figure 13A:
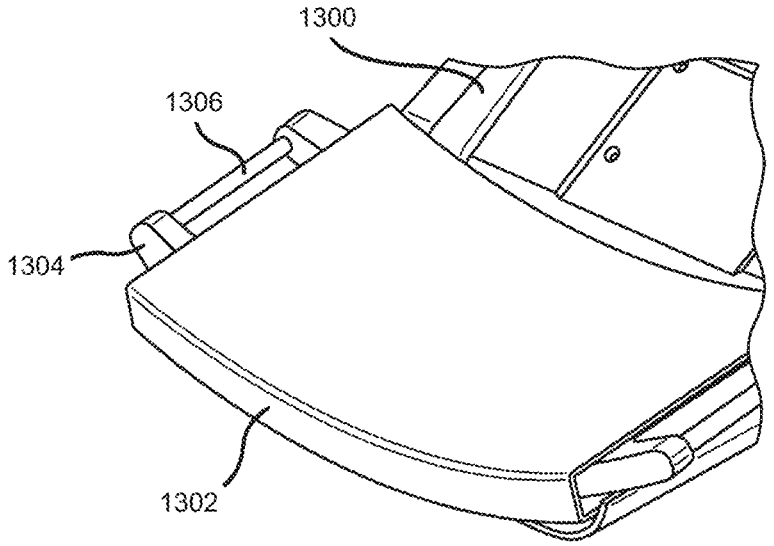
FIG. 13A shows a support structure having a sleeve for receiving a thoracic plate of a chest compression device according to embodiments.
Figure 13B:
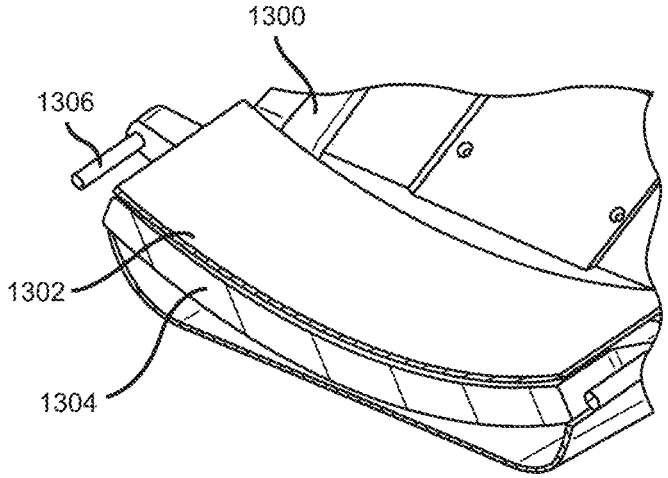
FIG. 13B shows a cross-section of the support structure of FIG. 13A with a thoracic plate inserted within the sleeve according to embodiments.

FIGS. 13A-13G depict one embodiment of coupling a chest compression device to a support structure. For example, FIG. 13A shows a support structure 1300, such as the support structures described herein, having a sleeve 1302 or other receiving mechanism for receiving a thoracic plate 1304 of a chest compression device. By utilizing a sleeve 1302, thoracic plate 1304 may be slid into position within the support structure 1300 while a patient is already positioned on top of the support structure 1300. Thus, there is no need to move the patient or the support structure 1300 in order to couple a chest compression device. Thoracic plate 1304 may be configured to be slidingly inserted within an interior of sleeve 1302. Thoracic plate 1304 may also include one or more mounting features 1306. For example, a mounting feature 1306 may extend beyond sleeve 1302 on each side such that a corresponding mating feature of a chest compression device may be engaged to secure the chest compression device to the support structure. FIG. 13B shows a cross-section of sleeve 1302 with thoracic plate 1304 inserted therein. The interior of sleeve 1302 may be contoured to match a contour of thoracic plate 1304 such that thoracic plate 1304 is firmly secured within sleeve 1302, as a chest compression device needs a solid surface to stabilize the device during chest compression delivery.

Figure 13C:
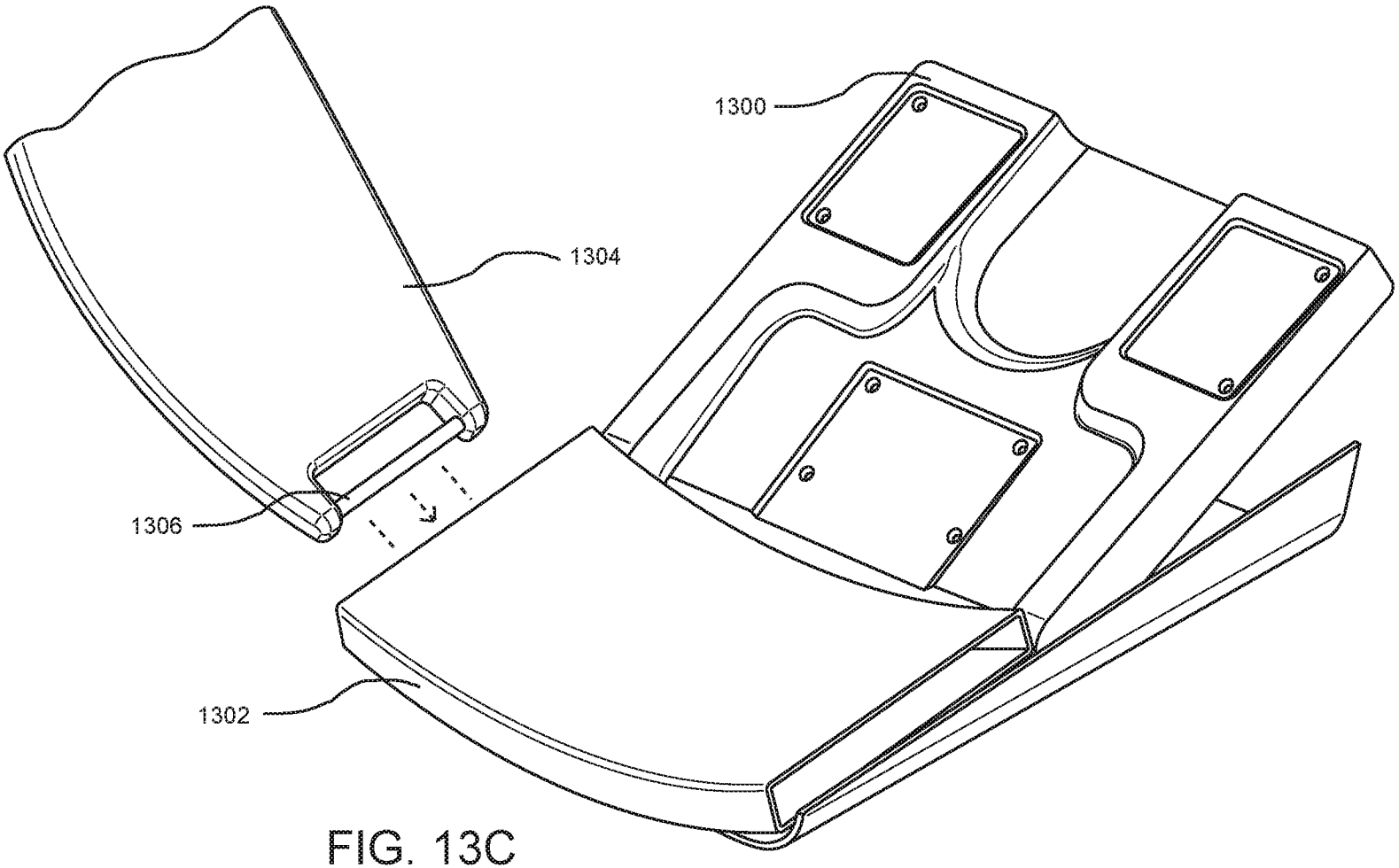
FIG. 13C depicts the support structure of FIG. 13A with the thoracic plate being slid into the sleeve according to embodiments.
Figure 13D:
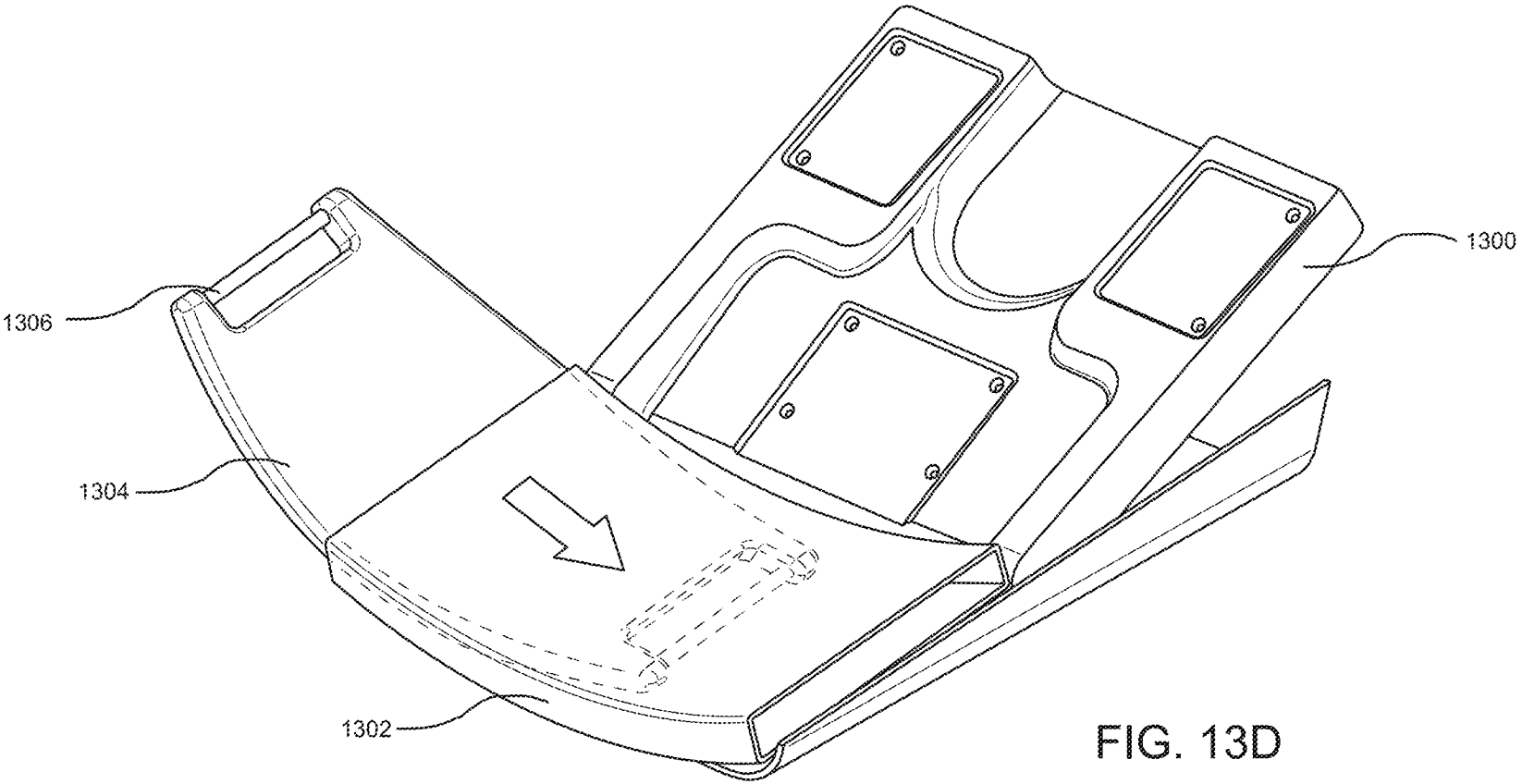
FIG. 13D shows the support structure of FIG. 13A with the thoracic plate partially inserted within the sleeve according to embodiments.
Figure 13E:
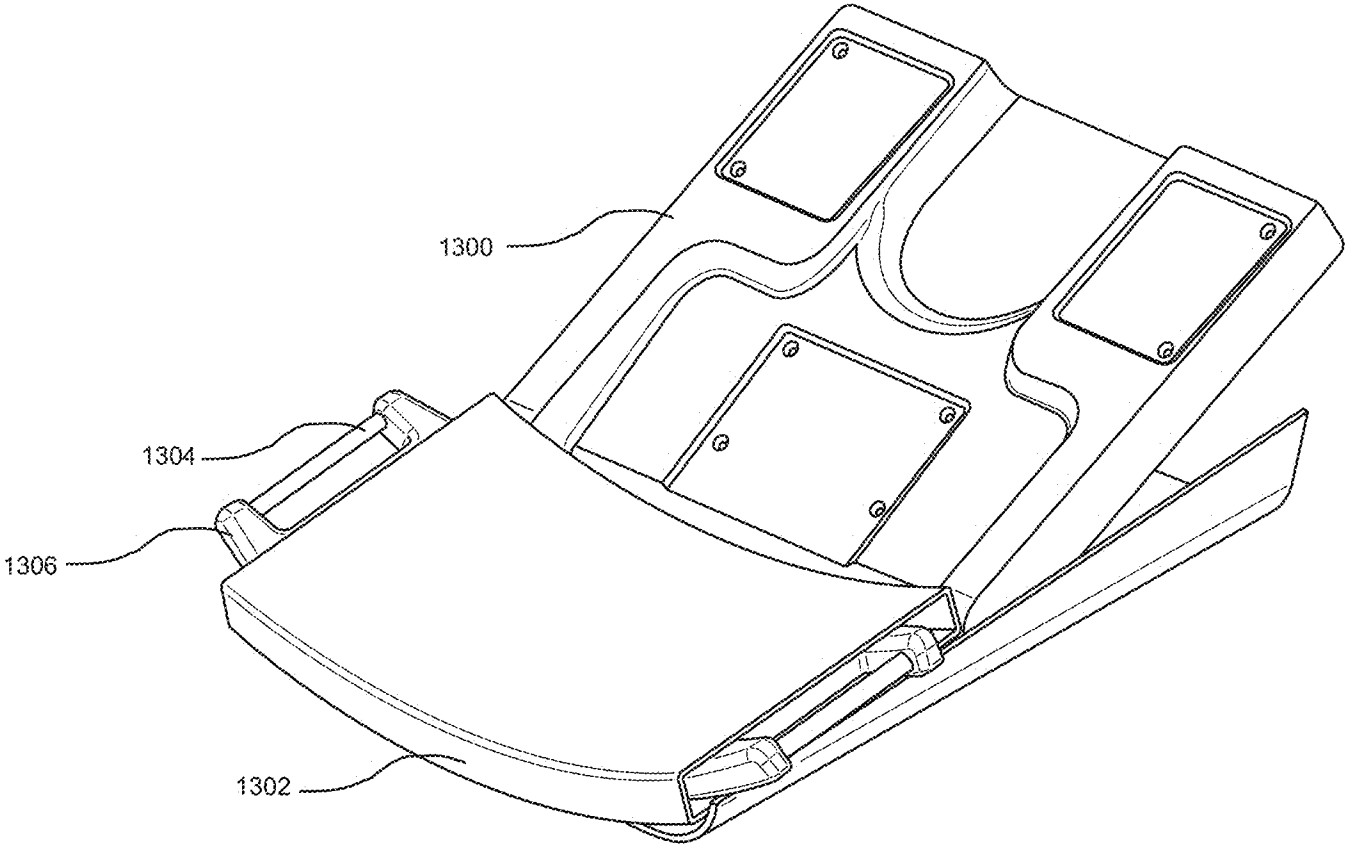
FIG. 13E shows the support structure of FIG. 13A with the thoracic plate fully inserted into the sleeve according to embodiments.

FIG. 13C depicts thoracic plate 1304 being slid into sleeve 1302. A first end of the thoracic plate 1304 may be inserted into an opening of sleeve 1302 and pushed through until the mounting feature 1306 extend beyond the outer periphery of sleeve 1302. As noted above, the contour of the thoracic plate 1304 and the interior of the sleeve 1302 may largely match, allowing the thoracic plate 1304 to be easily pushed and/or pulled through the sleeve 1302. FIG. 13D shows the thoracic plate 1304 partially inserted within the sleeve 1302. Thoracic plate 1304 may be pushed further into sleeve 1302 or may be pulled out. For example, a user may grasp the mounting features 1306 to pull the thoracic plate 1304 out of sleeve 1302. FIG. 13E shows thoracic plate 1304 fully inserted into sleeve 1302. Here, a user may grasp the thoracic plate 1304, such as by grasping one or more of mounting features 1306 and pull on one end of the thoracic plate 1304 to remove the thoracic plate from the sleeve 1302.

Figure 13F:
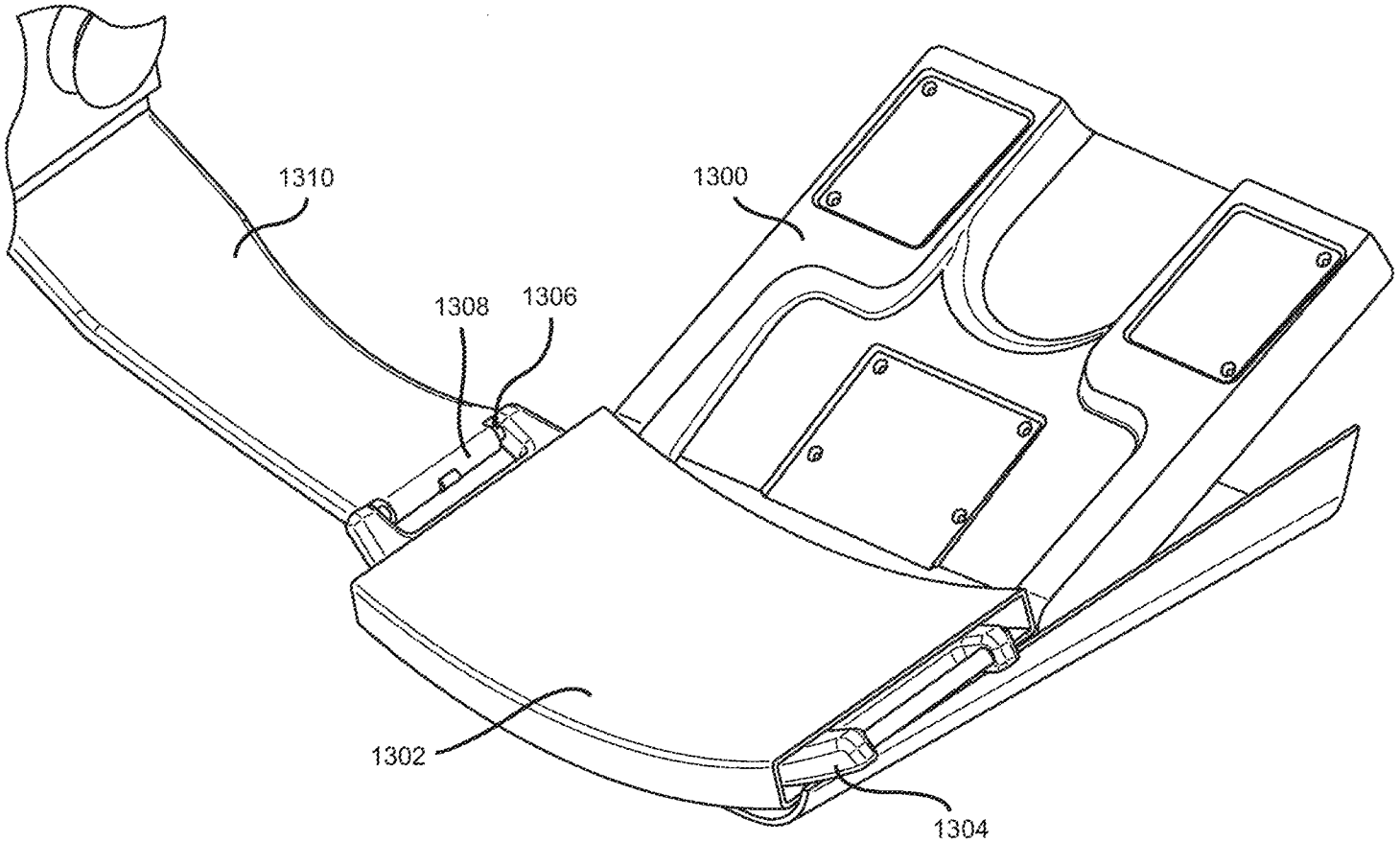
FIG. 13F depicts the support structure of FIG. 13A with a chest compression device being coupled with the support structure according to embodiments.
Figure 13G:
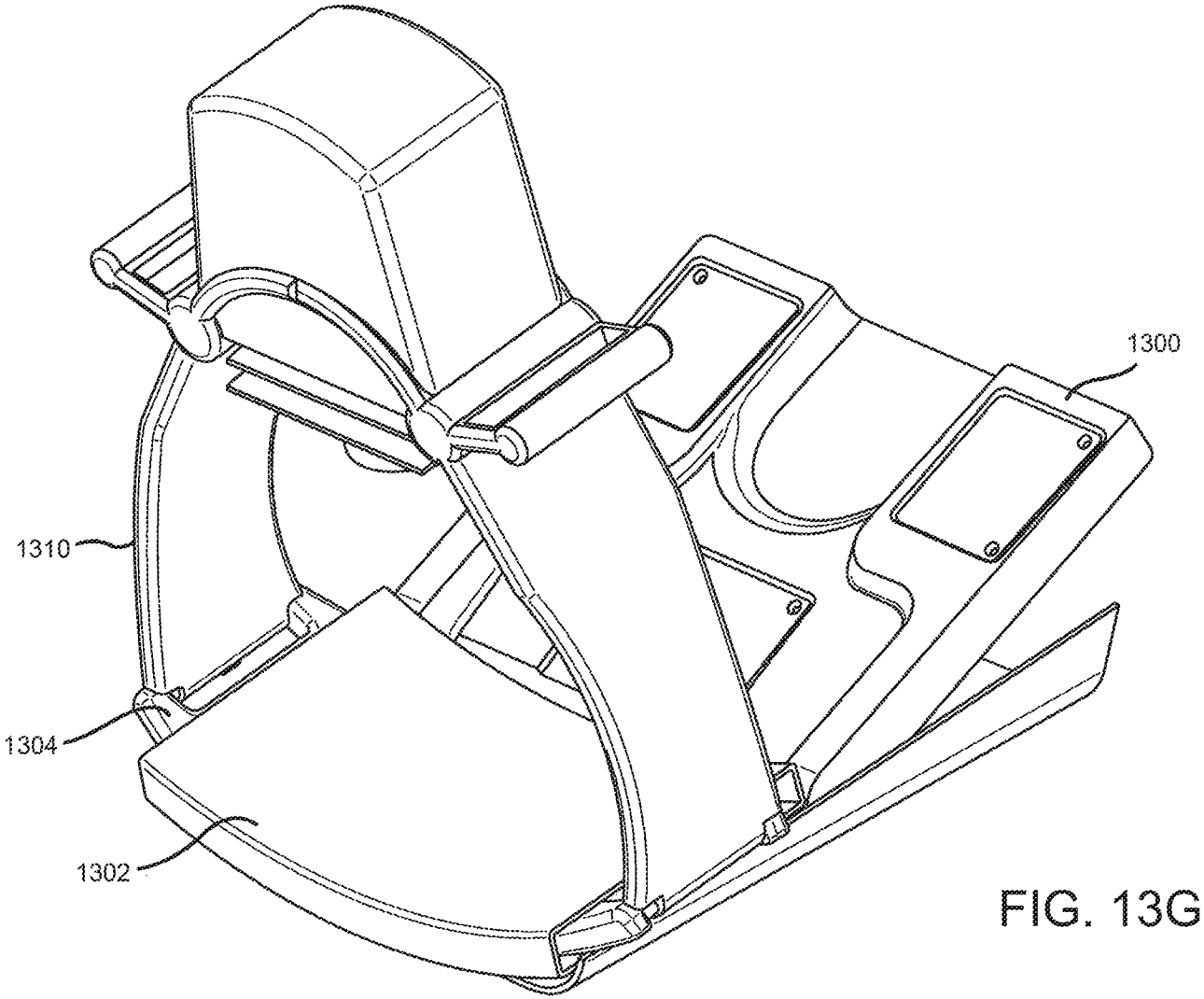
FIG. 13G shows the support structure of FIG. 13A with the chest compression device fully coupled with the support structure according to embodiments.

FIG. 13F depicts a chest compression-decompression device 1310 being coupled with the support structure 1300. Here, one end of the chest compression device 1310 includes a mating feature 1308 that may engage with the mounting feature 1306 to secure the chest compression-decompression device 1310 onto the support structure 1300. For example, mounting feature 1306 may be a bar or rod that is graspable by a clamp or jaws of mating feature 1308. In other embodiments, the mounting feature 1306 and/or mating feature 1308 may be clips, snap connectors, magnetic connectors, or the like. Oftentimes, pivotable connectors are useful such that the first end of the chest compression-decompression device 1310 may be coupled to the support structure 1300 prior to rotating the chest compression-decompression device 1310 over the patient's chest and coupling the second end of the chest compression-decompression device 1310. In other embodiments, both ends of the chest compression-decompression device 1310 may be coupled at the same, or nearly the same time. FIG. 13G shows chest compression-decompression device 1310 fully coupled with the support structure 1300. In this embodiment, the CPR device has a suction cup attached to the compression-decompression piston. Other means may also be used to link the CPR device to the skin during the decompression phase, including an adhesive material. As shown in FIG. 13G, mounting features 1306 and/or mating features 1308 may be positioned and aligned such that the chest compression-decompression device 1310 is coupled at an angle perpendicular to a surface of the sleeve 1302 and/or thoracic plate 1304. In other words, the chest compression-decompression device 1310 is coupled to the support structure 1300 at a substantially perpendicular angle to a portion of the support structure 1300 that supports the heart and/or thorax of a patient. This ensures that any chest compressions delivered by the chest compression device are angled properly relative to the patient's chest and heart.

While shown here as a sleeve, it will be appreciated that some embodiments may utilize a channel or indentation to receive a thoracic plate of a chest compression device. Other embodiments may include one or more fastening mechanisms, such as snaps, clamps, magnets, hook and loop fasteners, and the like to secure a thoracic plate onto a support structure. In some embodiments, a thoracic plate may be permanently built into the support structure. For example, a thorax-supporting or lower portion of a support structure may be shaped to match a patient's back and may include one or more mounting features that may engage or be engaged with corresponding mounting features of a chest compression device.

Figure 14A:
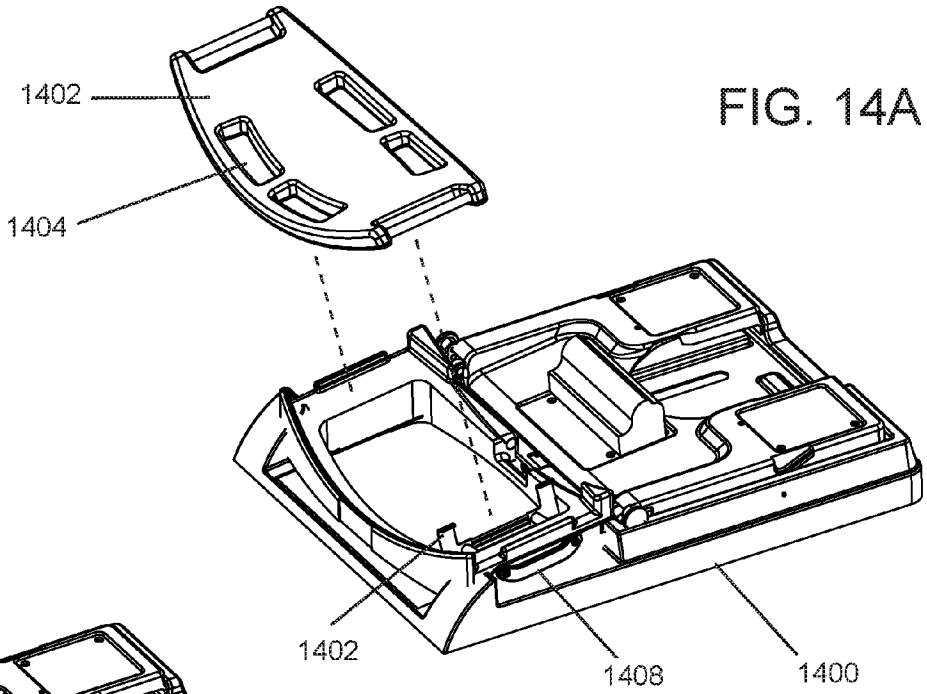
FIG. 14A depicts an exploded view of a support structure with a separable thoracic plate according to embodiments.
Figure 14B:
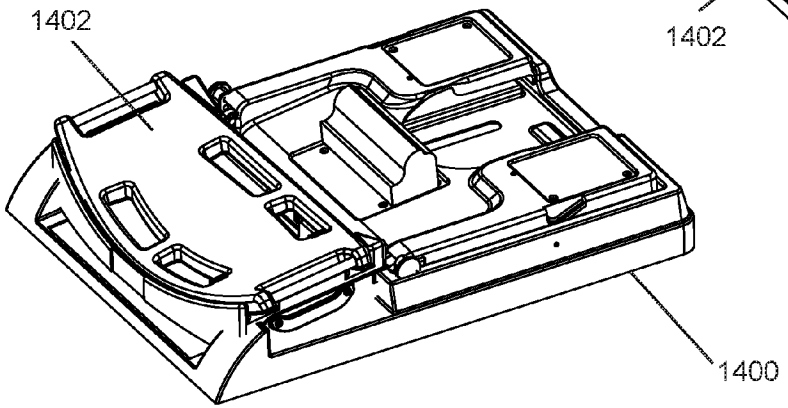
FIG. 14B depicts an assembled view of the support structure of FIG. 14A according to embodiments.
Figure 14C:
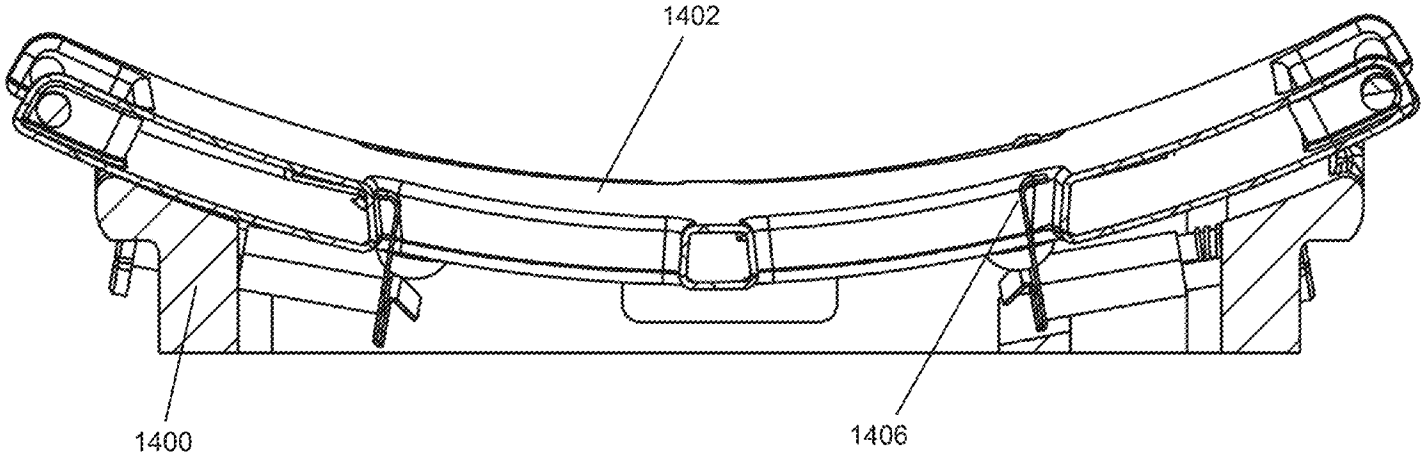
FIG. 14C depicts a cross section of the support structure of FIG. 14A showing an upper clamping arm in a receiving position according to embodiments.
Figure 14D:
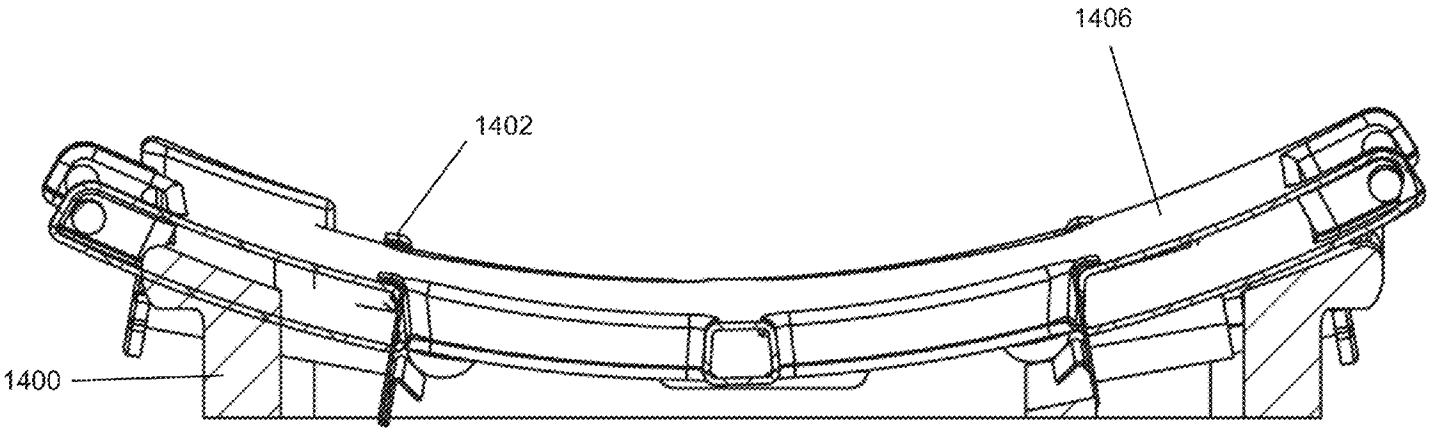
FIG. 14D depicts a cross section of the support structure of FIG. 14A showing an upper clamping arm in a locked position according to embodiments.

FIGS. 14A-14D depict an embodiment of an alternative mechanism for securing a thoracic plate to a support structure. As seen in FIGS. 14A and 14B, thoracic plate 1402 may be clipped into position on support structure 1400. When first brought into contact with support structure 1400, apertures 1404 of thoracic plate 1402 may be positioned over one or more clamping arms 1406 of the support structure 1400. Oftentimes, each side of the support structure 1400 includes one or more clamping arms that are controllable independent of clamping arms on the other side of the support structure, however in some embodiments both sides of clamping arms may be controllable using a single actuator. Clamping arms 1406 may be slidable and/or pivotable by actuating one or more buttons, levers, or other mechanisms 1408, which may be positioned on or extending from an outside surface of the support structure 1400. For example, the mechanism 1408 may be moved toward the support structure 1400 to maneuver the clamping arms 1406 from a receiving position that allows the clamping arms 1406 to be inserted within apertures 1404 and to be moved away from the support structure to maneuver the clamping arms 1406 to a locked position in which the clamping arms 1406 contact a portion of the thoracic plate 1402 proximate to the apertures 1404. As seen in FIG. 14C, in the receiving position clamping arms 1406 are disengaged from the thoracic plate 1402 allowing it to be positioned on or removed from the support structure 1400. As shown in FIG. 14D, clamping arms 1406 are in the locked position, with the mechanism 1408 in a position pulled away from the surface of the support structure 1400. Ends of the clamping arms 1406 may overlap with and engage a top surface of the thoracic plate 1402, thereby maintaining the thoracic plate 1402 in position relative to the support structure 1400.

In some embodiments, the thoracic plate 1402 may be positioned on the support structure 1400 by manipulating both sides of clamping arms 1406 and setting the thoracic plate 1402 on top of the support structure 1400 with the apertures 1404 aligned with the clamping arms 1406. The mechanisms 1408 for each of the sides of clamping arms 1406 may then be manipulated to move the clamping arms 1406 into the locked position. This may be done simultaneously or one by one.

Figure 15A:
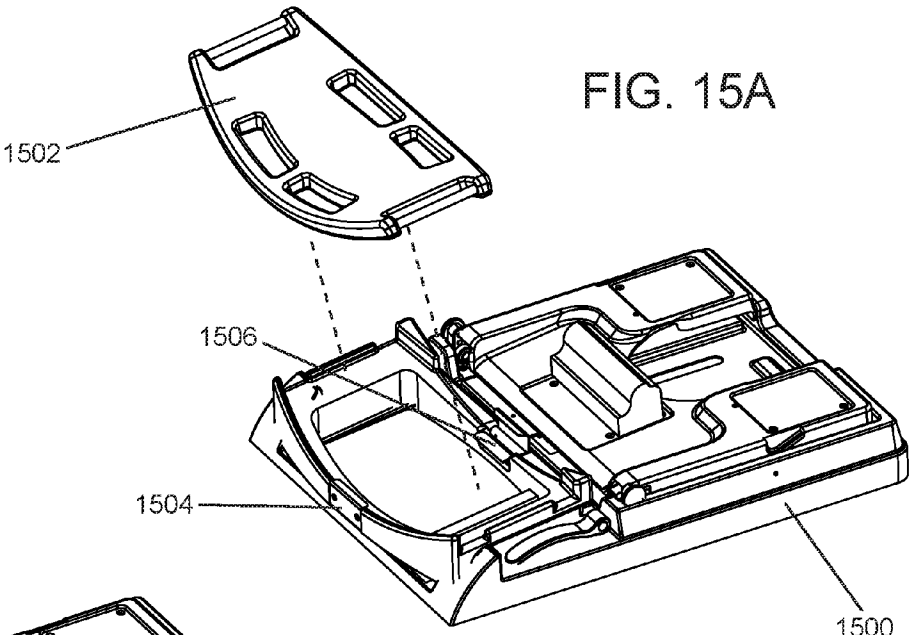
FIG. 15A depicts an exploded view of a support structure with a separable thoracic plate according to embodiments.
Figure 15B:
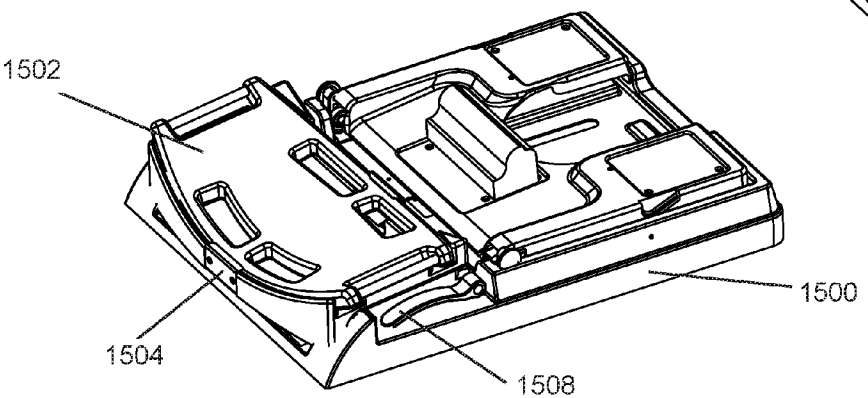
FIG. 15B depicts an assembled view of the support structure of FIG. 15A according to embodiments.
Figure 15C:
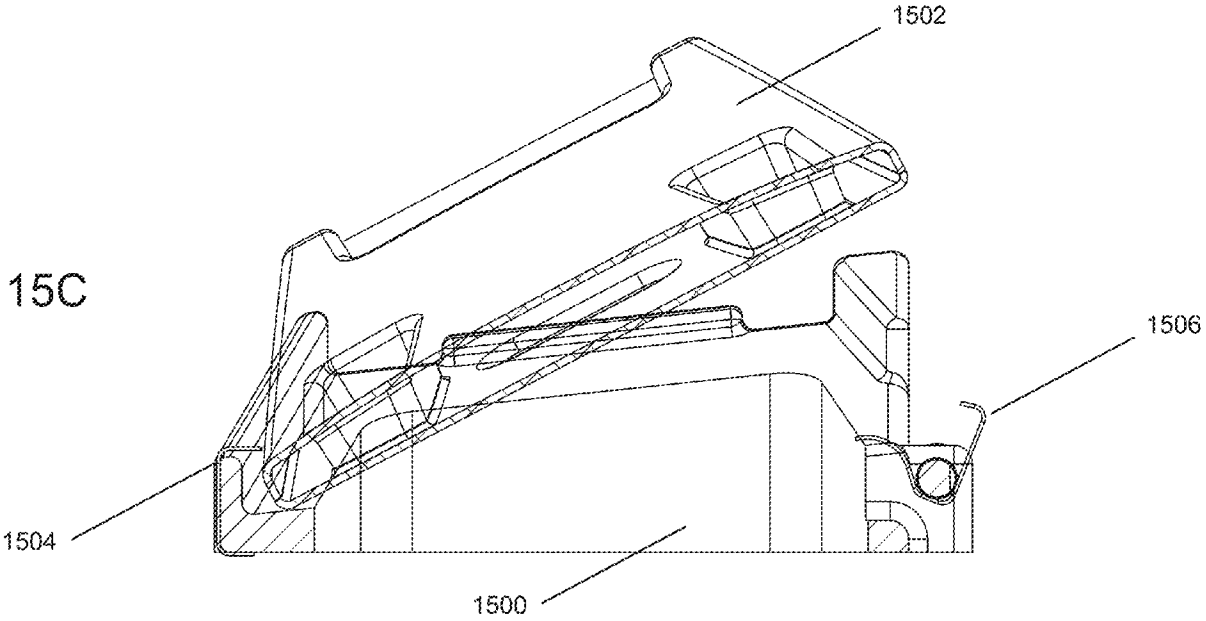
FIG. 15C depicts a cross section of the support structure of FIG. 15A showing clamping arms in a receiving position according to embodiments.
Figure 15D:
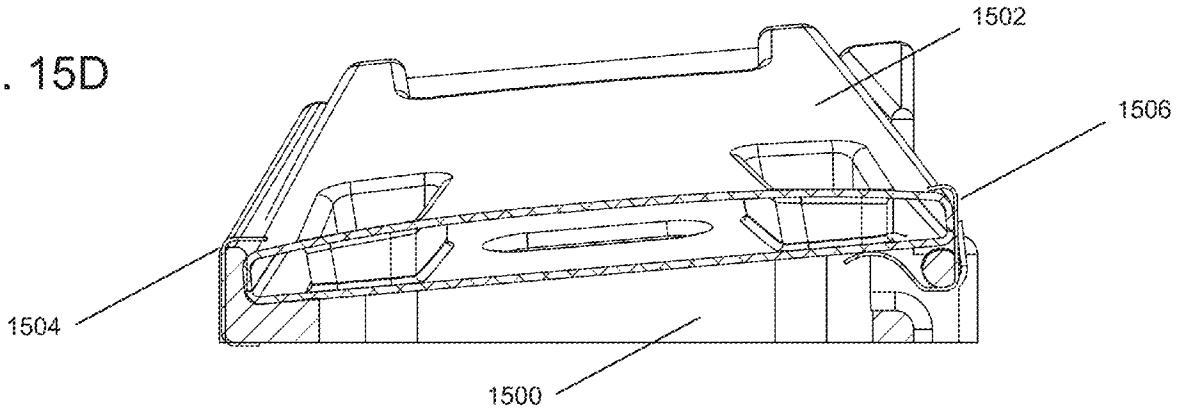
FIG. 15D depicts a cross section of the support structure of FIG. 15A showing clamping arms in a locked position according to embodiments.
Figure 15E:
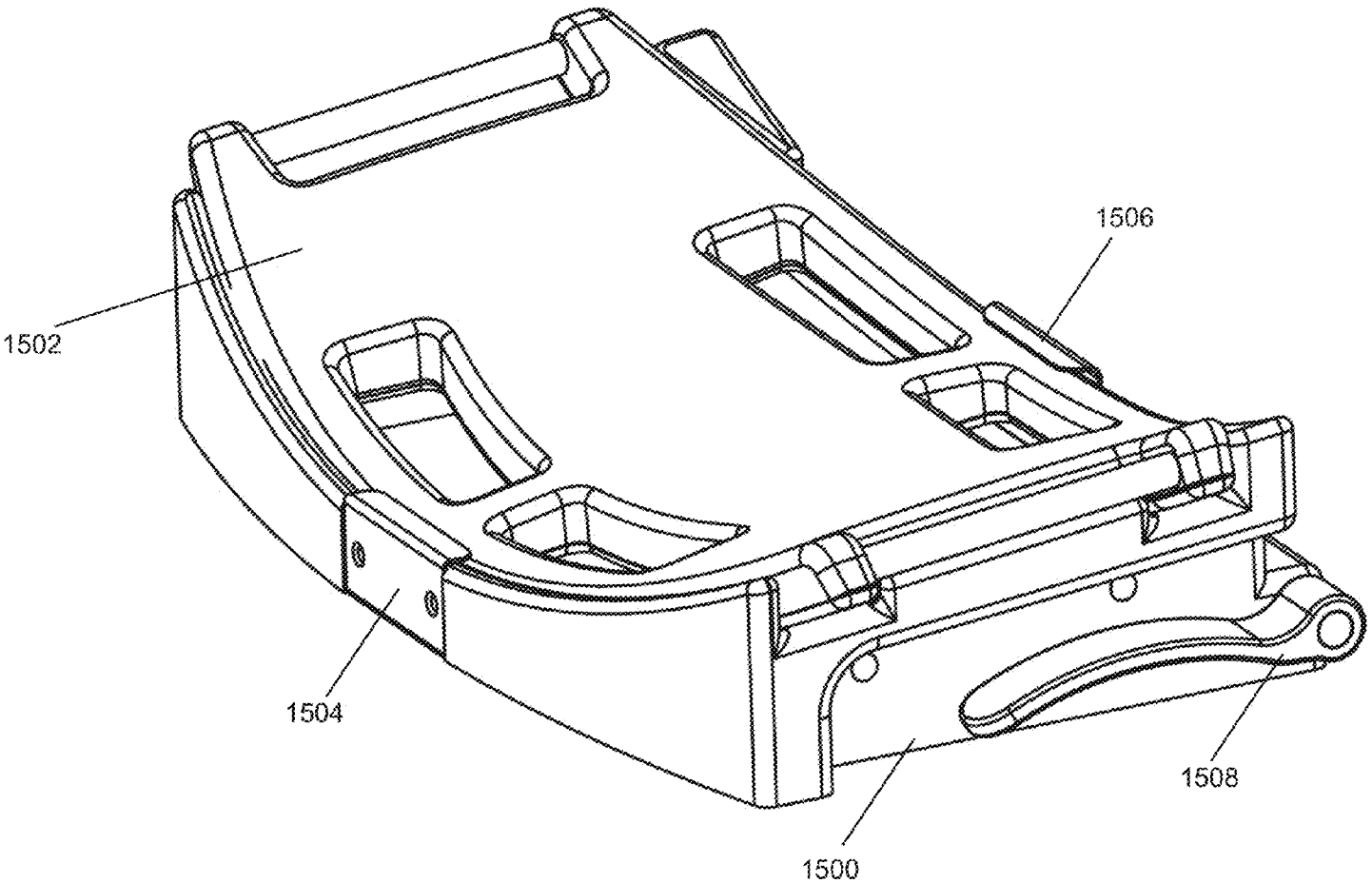
FIG. 15E depicts the support structure of FIG. 15A with clamping arms in a locked position according to embodiments.

FIGS. 15A-15E depict another alternate mechanism for securing a thoracic plate to a support structure. As seen in FIGS. 15A and 15B, thoracic plate 1502 may be clipped into position or removed from support structure 1500. In contrast to support structure 1400, support structure 1500 may secure outer edges of the thoracic plate 1502, rather than edges proximate to the apertures of the thoracic plate 1502. Support structure 1500 includes a lower clamp 1504 and an upper clamp 1506, although it will be appreciated that more than one clamp may be present at each location. Here, lower clamp 1504 is fixed in position while upper clamp 1506 may be slidable and/or pivotable in a direction away from the lower clamp 1504 to provide sufficient area in which to insert the thoracic plate 1502. The sliding and/or pivoting movement of the upper clamp 1506 may be controlled by lever 1508 or another mechanism, which may be positioned near an outer side of the support structure 1500, thus providing access to the lever 1508 even when a patient is being supported on the support structure 1500. In some embodiments, the lever 1508 may be spring biased or utilize cams to maintain the lever 1508 in either extreme position. To secure the thoracic plate 1502, the lever 1508 may be manipulated to slide, pivot, and/or otherwise move the upper 1506 away from the lower clamp 1504 as shown in FIG. 15C. A lower edge of the thoracic plate 1502 may then be positioned against and underneath a lip of the lower clamp 1504 such that the lip prevents the thoracic plate 1502 from moving away from the support structure 1500. The rest of the thoracic plate 1502 may then be positioned against the support structure 1500 and the lever 1508 may be maneuvered such that the upper clamp 1506 moves toward lower clamp 1504 as shown in FIG. 15D. This allows a lip of the upper clamp 1506 to engage with a top surface of the thoracic plate 1502. Once in this position, the thoracic plate 1502 is maintained in the desired position by the lips of both the upper clamp 1506 and lower clamp 1504 as seen in FIG. 15E.

Figure 16A:
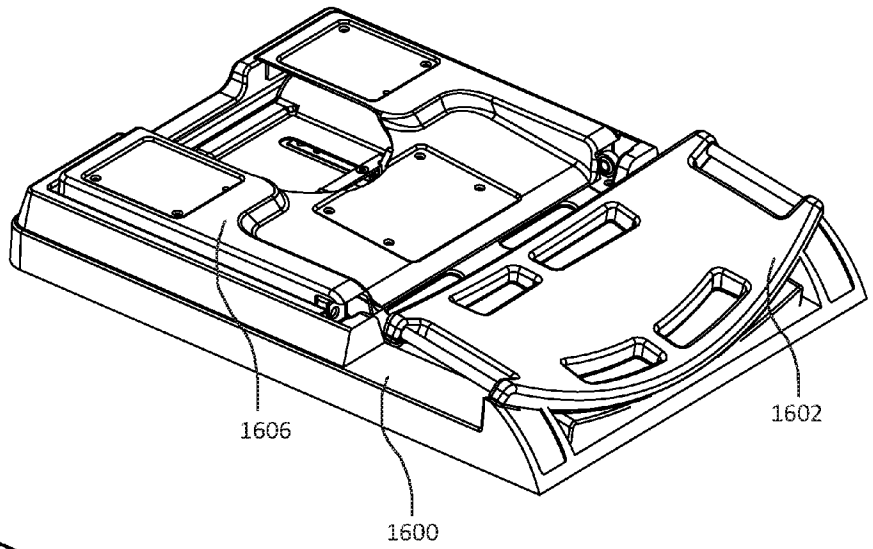
FIG. 16A depicts an assembled view of a support structure with a separable thoracic plate according to embodiments.
Figure 16B:
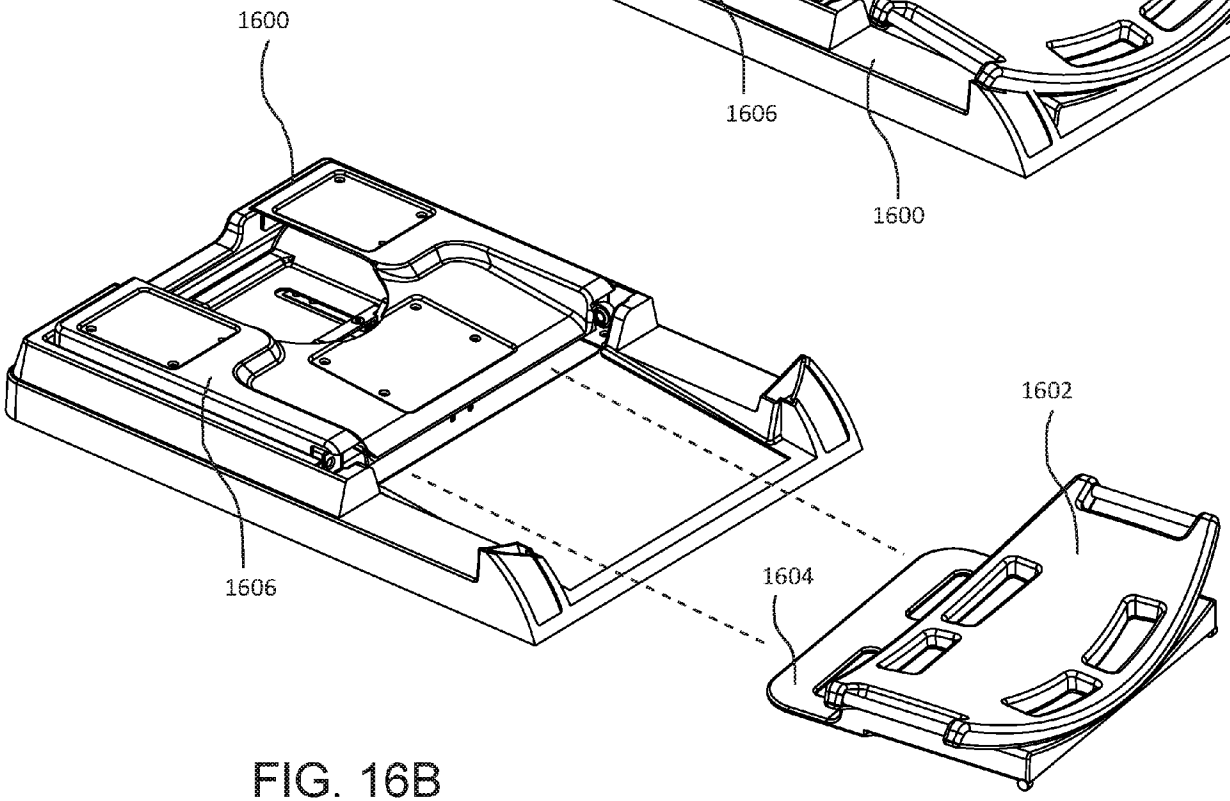
FIG. 16B depicts an exploded view of the support structure of FIG. 16A according to embodiments
Figure 16C:
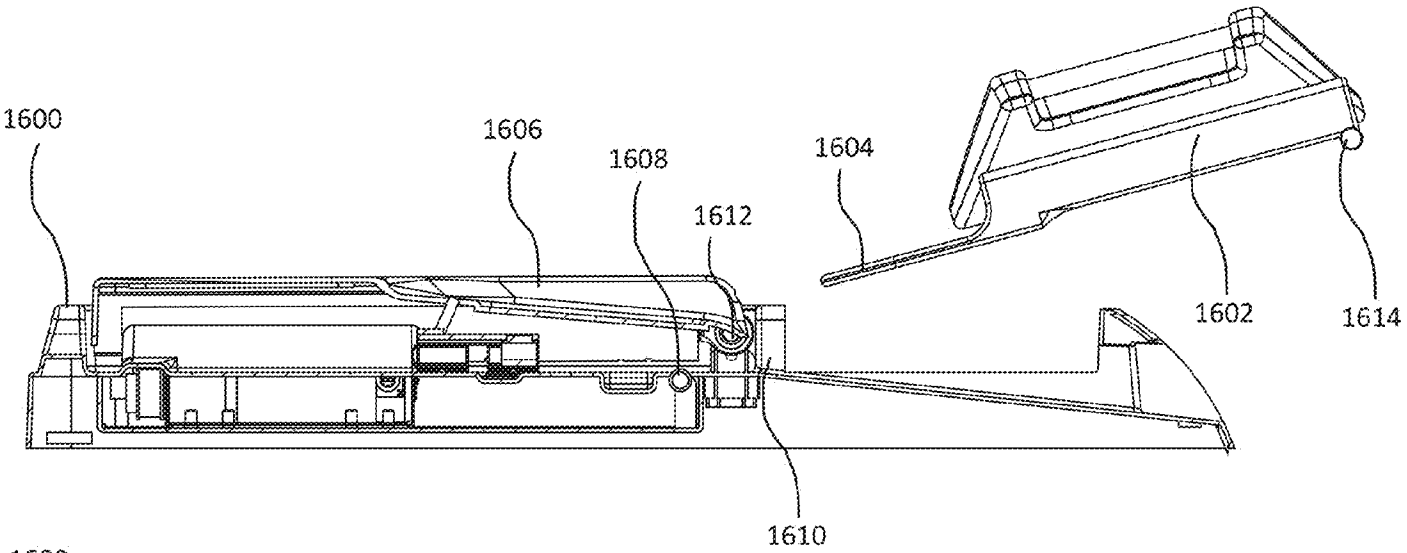
FIG. 16C depicts a cross sectional side view of the support structure of FIG. 16A showing a thoracic plate removed from the support structure according to embodiments.
Figure 16D:
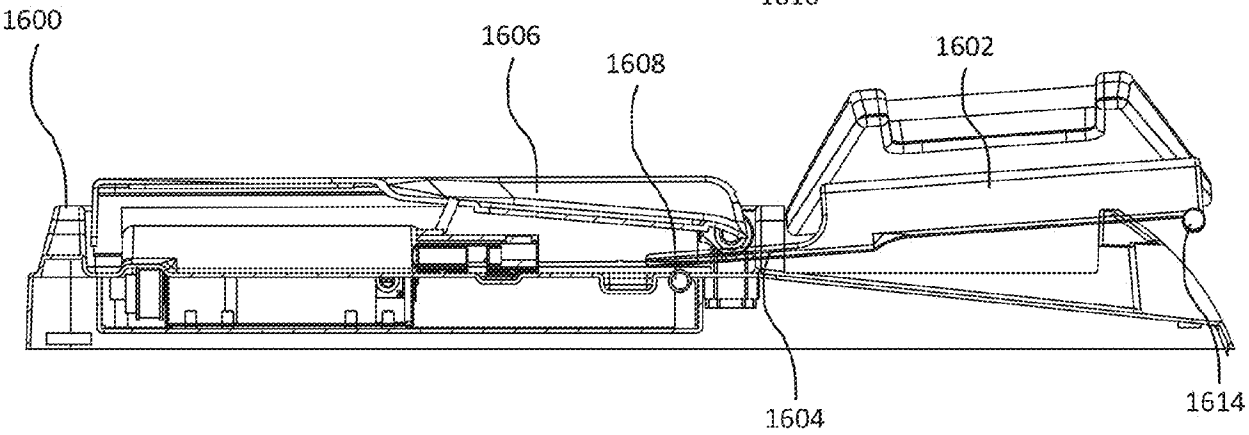
FIG. 16D depicts a cross sectional side view of the support structure of FIG. 16A showing a thoracic plate inserted below an upper support and atop a roller of the support structure according to embodiments.
Figure 16E:
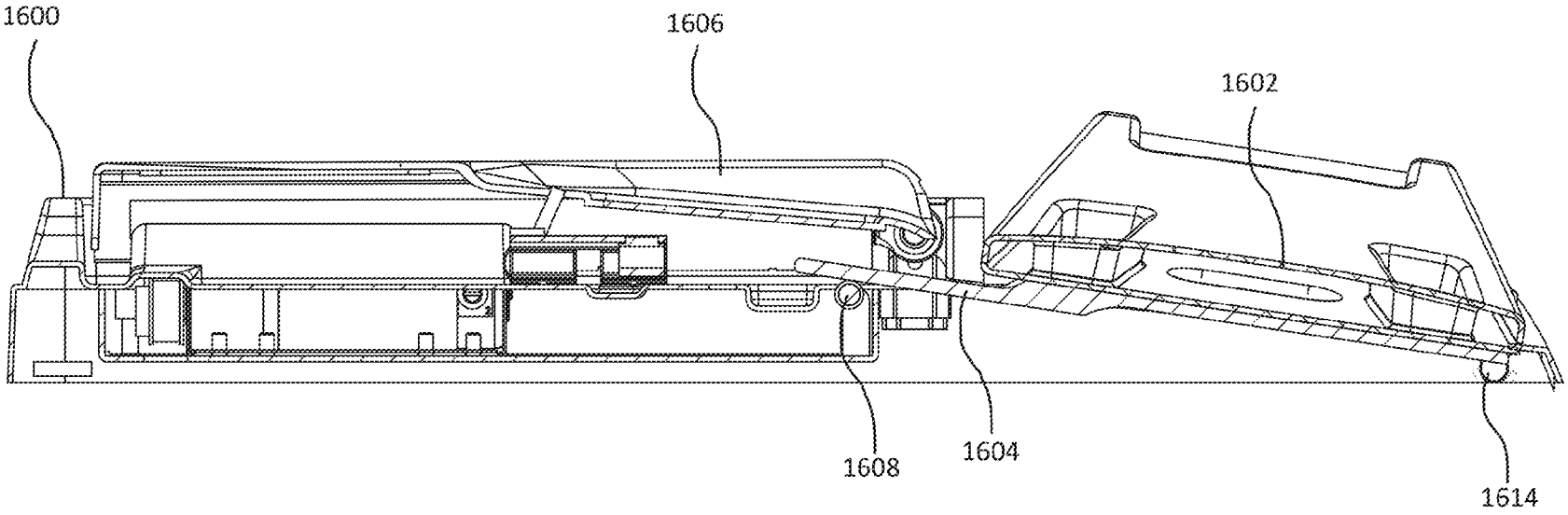
FIG. 16E depicts a cross sectional side view of the support structure of FIG. 16A showing a thoracic plate secured below an upper support and atop a roller of the support structure according to embodiments.
Figure 16F:
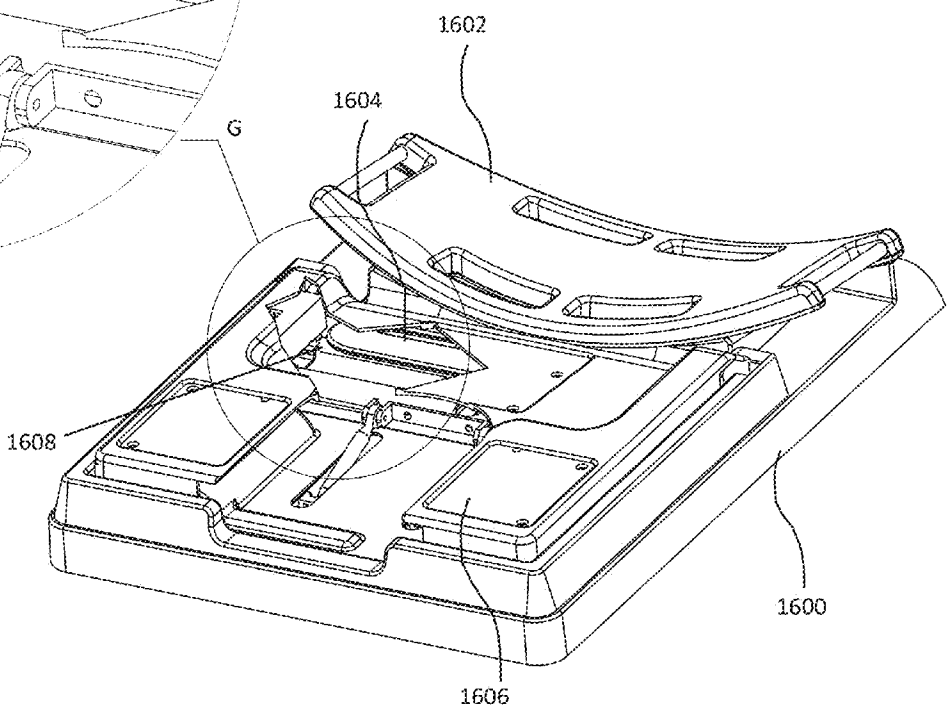
FIG. 16F depicts a rear isometric view of the support structure of FIG. 16A in a lowered position showing a thoracic plate secured below an upper support and atop a roller of the support structure according to embodiments.
Figure 16G:
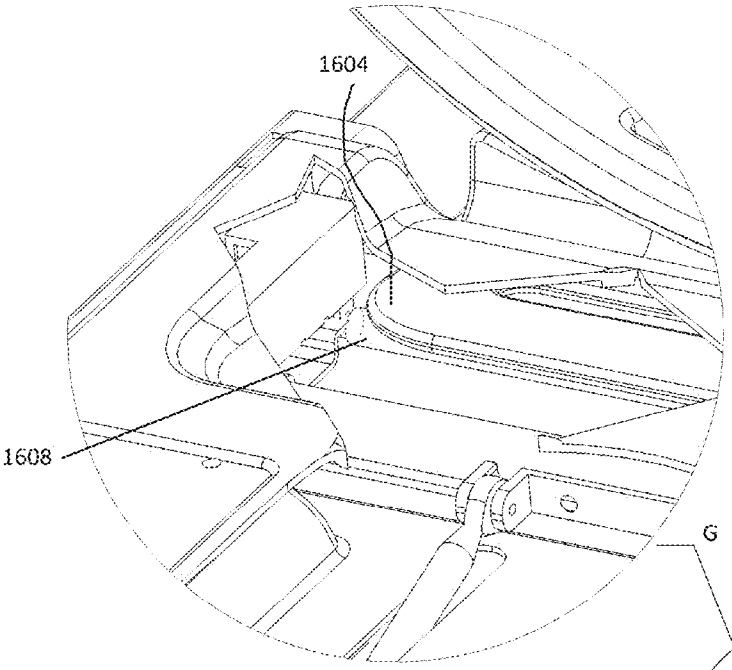
FIG. 16G depicts a zoomed in rear isometric view of the support structure of FIG. 16A in a lowered position showing a thoracic plate secured below an upper support and atop a roller of the support structure according to embodiments.
Figure 16H:
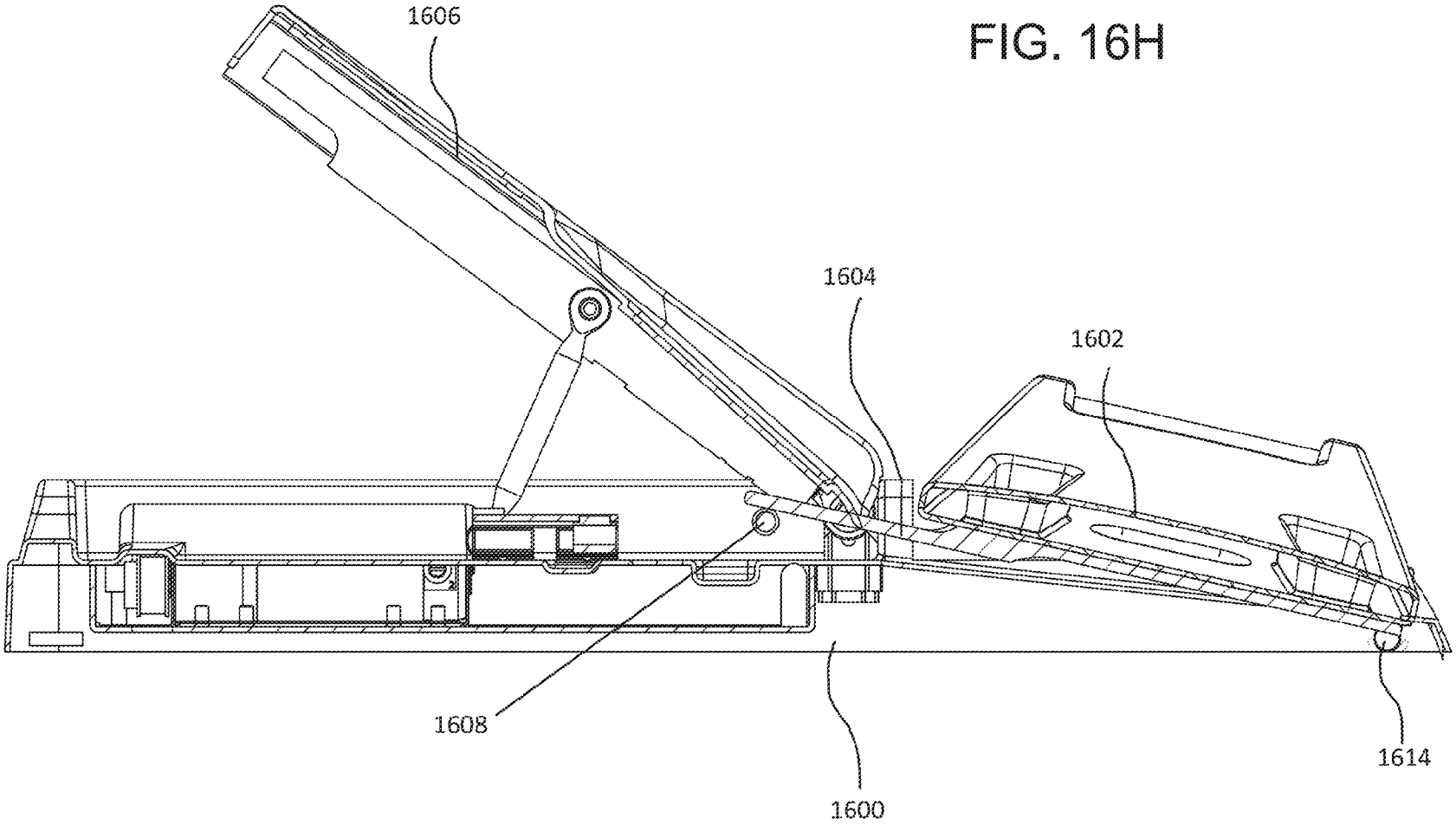
FIG. 16H depicts a cross sectional side view of the support structure of FIG. 16A in an elevated position according to embodiments.

FIGS. 16A-16J depict another embodiment of a mechanism for coupling the thoracic plate to the support structure. Such mechanisms may be used with any of the support structures described herein. Here, a thoracic plate 1602 includes a plate or rail 1604 that may removably engage with corresponding mating features on a support structure 1600 to secure the thoracic plate 1602 as shown in FIG. 16A. FIGS. 16B and 16C show a perspective view and a side view of the thoracic plate 1602 separated from the support structure 1600. Rail 1604 may be configured to be slid under an upper support 1606, where the rail 1604 may engage a roller 1608 as shown in FIG. 16D. Roller 1608 may be attached to a bottom of the upper support 1606 such that the roller 1608 is elevated along with the upper support 1606. When engaged with the roller 1608, rail 1604 may be positioned atop the roller 1608 and below a bottom surface of the upper support 1606. Roller 1608 may be configured to elevate along with the upper support 1606. In FIG. 16E, the upper support 1606 is in a lowered position with rail 1604 of the thoracic plate 1602 positioned atop roller 1608. FIGS. 16F and 16G show a rear view of the support structure 1600 in the lowered position, with rail 1604 sitting atop roller 1608. As the upper support 1606 is raised, as shown in FIG. 16H, the roller 1608 also raises, lifting the rail 1604 upward as the rail 1604 rolls along roller 1608 and toward the upper support 1606.

Figure 16I:
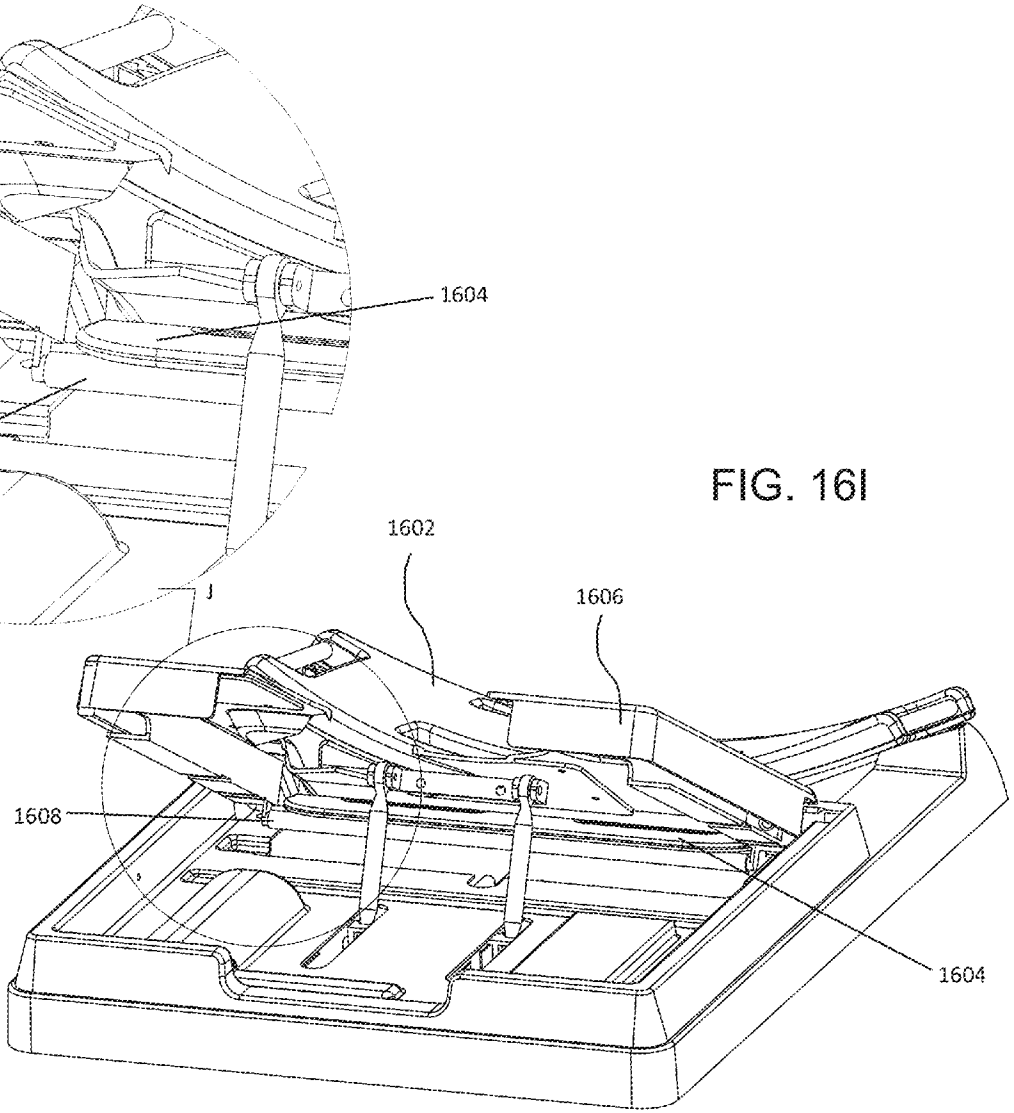
FIG. 16I depicts a rear isometric view of the support structure of FIG. 16A in an elevated position according to embodiments.
Figure 16J:
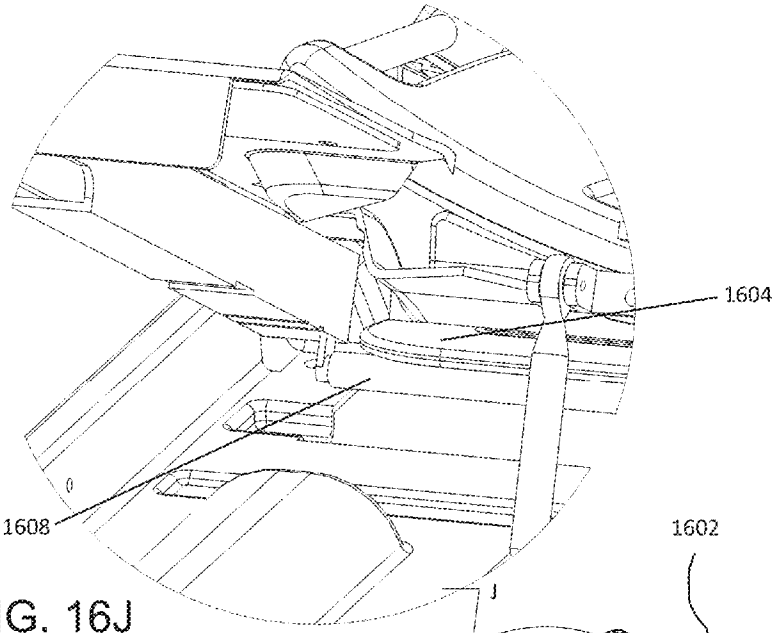
FIG. 16J depicts a zoomed in rear isometric view of the support structure of FIG. 16A in an elevated position showing a thoracic plate secured below an upper support and atop a roller of the support structure according to embodiments.

FIGS. 16I and 16J show a rear view of the support structure 1600 in the raised or elevated position, with rail 1604 sitting atop roller 1608. The lifting of rail 1604 causes a back or top side of the thoracic plate 1602 to raise, thereby causing the thoracic plate 1602 to tilt forward. Thus, the engagement of rail 1604 and roller 1608 results in a linked motion that lifts or tilts the thoracic plate 1602 in conjunction with the upper support 1606. The corresponding thoracic plate tilt tracks with the patient thoracic shift mentioned in the discussion related to FIGS. 5A-6E. The magnitude of the tilt is determined by the physical geometry of the design and could be user adjustable if required, however the test data described herein has shown that there exists a specific region of geometry that correctly tracks with virtually all patient body types. In some embodiments, the elevation of the upper support 1606 and the tilting of the thoracic plate 1602 are each achieved by pivoting the component at a single pivot point. For example, the upper support may elevate and pivot about an upper support pivot 1612 that may be fixed or coupled with a base 1610 of the support structure 1600, while the thoracic plate 1602 may pivot and tilt about thoracic plate pivot 1614. Thoracic plate pivot 1614 may be secured to and/or sit atop base 1610 when the thoracic plate 1602 is engaged with the support structure 1602. While the upper support 1606 and thoracic plate 1602 may be pivoted simultaneously, the amount of pivot may be significantly different based on the different pivot points. For example, the upper support 1606 may be pivoted from between 0° and 30° relative to horizontal, while the thoracic plate 1602 may be tilted between about 0° and 7°. Additionally, the upper support 1606 may be elevated to heights as described in other embodiments, such as between about 10 and 30 cm above the starting supine point of the upper support 1606. In some embodiments, when elevated, the upper support 1606 may also extend away from the thoracic plate 1602 along a length of the support structure 1600 such as described in other embodiments.

Such an embodiment also allows for easy cleaning of the thoracic plate 1602 and the support structure 1600. The thoracic plate 1602 may include clips that allow for easy engagement with the upper support 1606 and engagement with a front edge of a pocket between the upper support 1606 and the base 1610 of the support structure 1600 that creates a fixed point and a lifting/sliding point. A further advantage of this is that the thoracic plate 1602 can be readily exchanged as required for various medical reasons. In this embodiment, the rail 1604 and/or any clips may be formed of metal plates and screws, however in some embodiments plastic or radio-transparent materials can be used to allow for x-ray fluoroscopy.

Figure 17A:
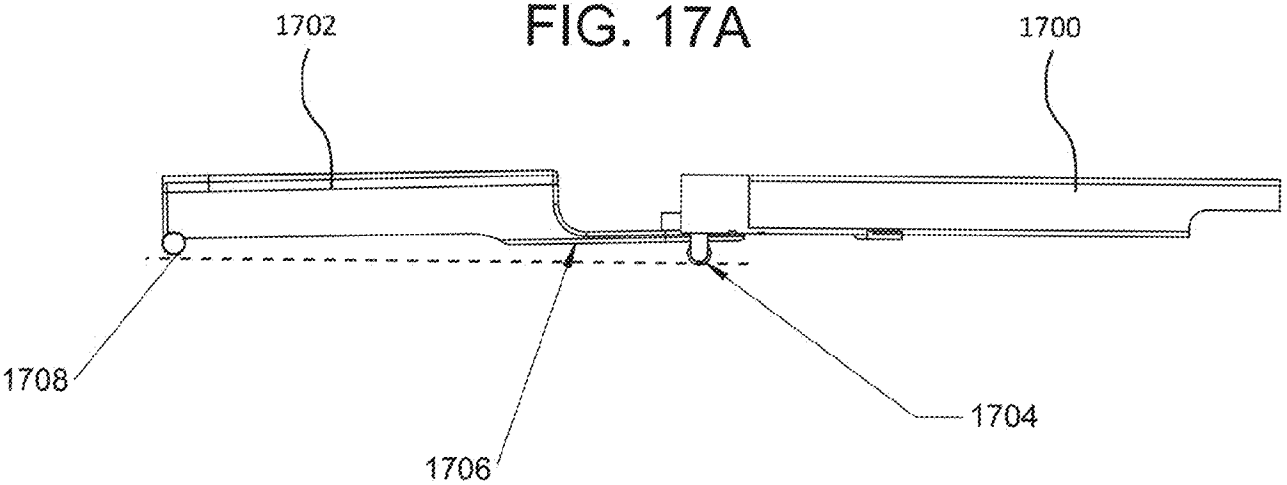
FIG. 17A shows a simplified view of an elevation/tilt mechanism of a support structure in a lowered position according to embodiments.
Figure 17B:
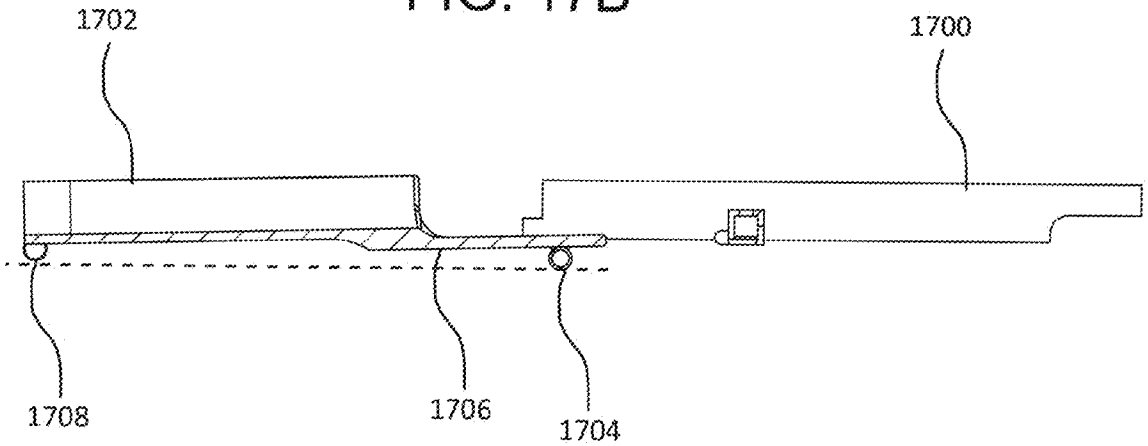
FIG. 17B shows a simplified cross sectional view of an elevation/tilt mechanism of the support structure of FIG. 17A in a lowered position according to embodiments.
Figure 17C:
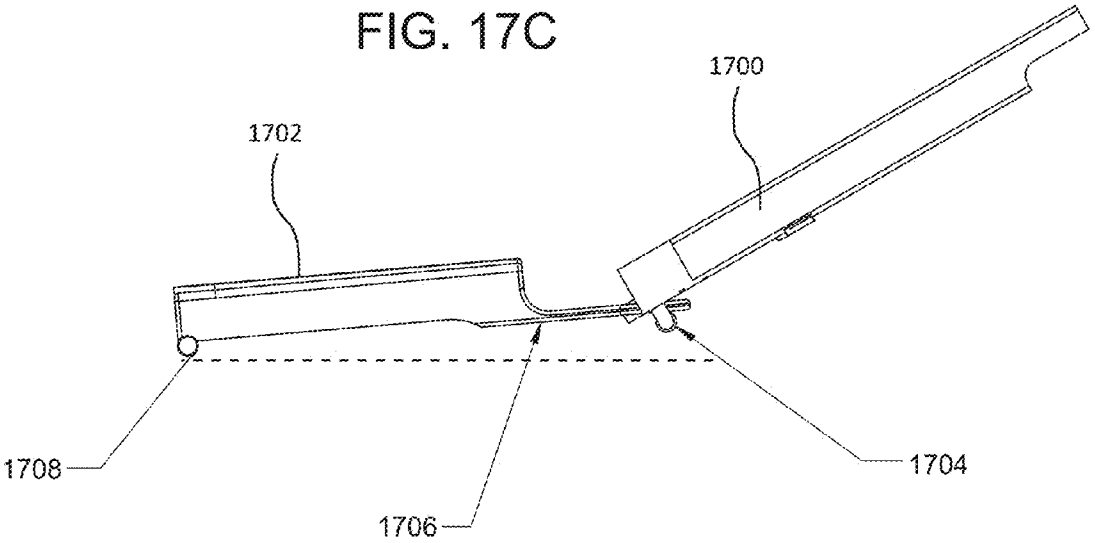
FIG. 17C shows a simplified view of the elevation/tilt mechanism of the support structure of FIG. 17A in an elevated position according to embodiments.
Figure 17D:
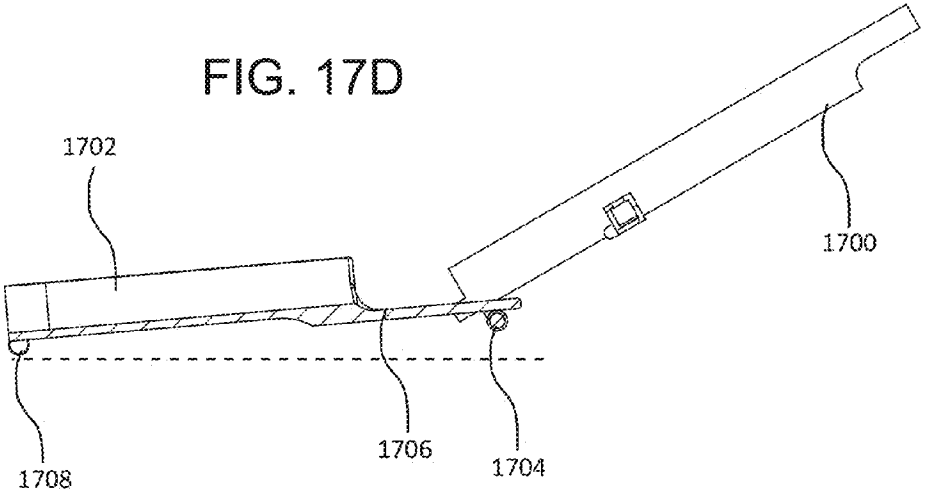
FIG. 17D shows a simplified cross sectional view of the elevation/tilt mechanism of the support structure of FIG. 17A in an elevated position according to embodiments.

FIGS. 17A-17D provide a simplified view of a tilt/elevation mechanism similar to that used in support structure 1600. FIG. 17A shows an upper support 1700 and thoracic plate 1702 in a lowered, horizontal position. Upper support 1700 includes a roller 1704 that extends downward from an underside of the upper support 1700. Thoracic plate 1702 includes a rail or extension 1706 that extends toward the upper support 1700 and is supported atop the roller 1704 as best seen in FIG. 17B. When the upper support 1700 is elevated, as shown in FIG. 17C, roller 1704 is also elevated. Roller 1704 lifts the extension 1706, while the front edge 1708 of the thoracic plate 1702 remains stationary, serving as a pivot point as seen in FIG. 17D. This allows the thoracic plate 1702 to tilt away from the upper support 1700 during elevation of the upper support 1700, thereby combating any effects of thoracic shift that result from the elevation.

Figure 18A:
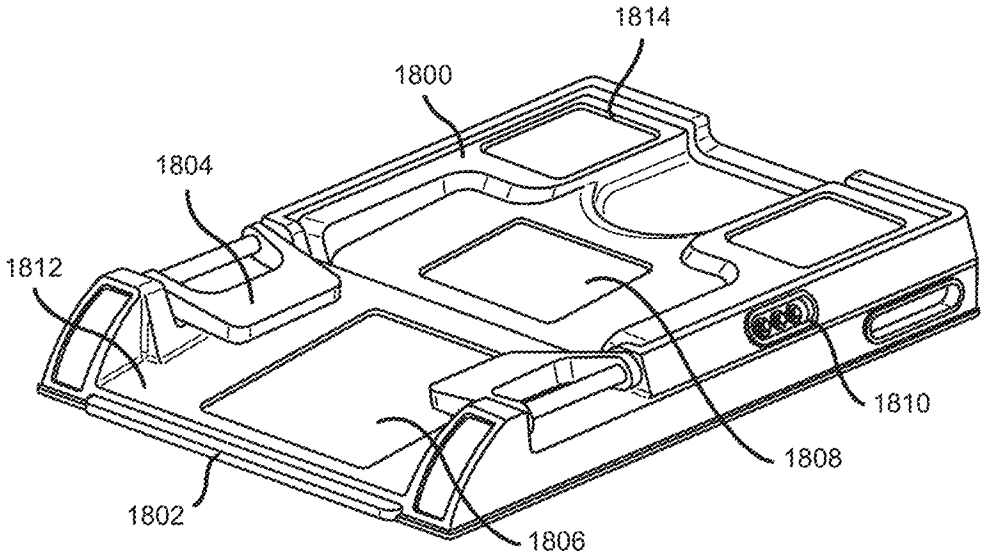
FIG. 18A shows a support structure having stabilizing features according to embodiments.

FIGS. 18A-18D depict one embodiment of a support structure 1800 having stabilizing elements. These stabilizing elements ensure that the patient is maintained in a proper position throughout the administration of head and thorax up CPR. FIG. 18A shows support structure 1800 in a closed position. An underbody stabilizer 1802 may be slid within a recess of the support structure 1800 for storage. The underbody stabilizer 1802 may be configured to support a lower body of a patient. One or more armpit stabilizers 1804 may be included on the support structure 1800. Armpit stabilizers 1804 may be pivoted to be positioned under a patient's underarms and may help prevent the patient sliding down the support structure 1800 due to effects from gravity and/or the administration of chest compressions. In the closed position, armpit stabilizers 1804 may be folded toward a surface of the support structure 1800. In some embodiments, armpit stabilizers 1804 may include mounting features, such as those used to couple a chest compression device with the support structure 1800. In some embodiments, the stabilizer could be extended and modified to include handles so that the entire structure (not shown) could be used as a transport device or stretcher so the patient could be moved with ongoing CPR from one location to another.

Support structure 1800 may also include non-slip pads 1806 and 1808 that further help maintain the patient in the correct position without slipping. Non-slip pad 1806 may be positioned on a lower or thorax support 1812, and non-slip pad 1808 may be positioned on an upper or head and neck support 1814. While not shown, it will be appreciated that a neck support, such as described elsewhere herein, may be included in support structure 1800. Support structure 1800 may also include motor controls 1810. Motor controls 1810 may allow a user to control a motor to adjust an angle of elevation and/or height of the lower support 1812 and/or upper support 1814. For example, an up button may raise the elevation angle, while a down button may lower the elevation angle. A stop button may be included to stop the motor at a desired height, such as an intermediate height between fully elevated and supine. It will be appreciated that motor controls 1810 may include other features, and may be coupled with a computing device and/or sensors that may further adjust an angle of elevation and/or a height of the lower support 1812 and/or the upper support 1814 based on factors such as a type of CPR, a type of ITP regulation, a patient's body size, measurements from flow and pressure sensors, and/or other factors.

Figure 18B:
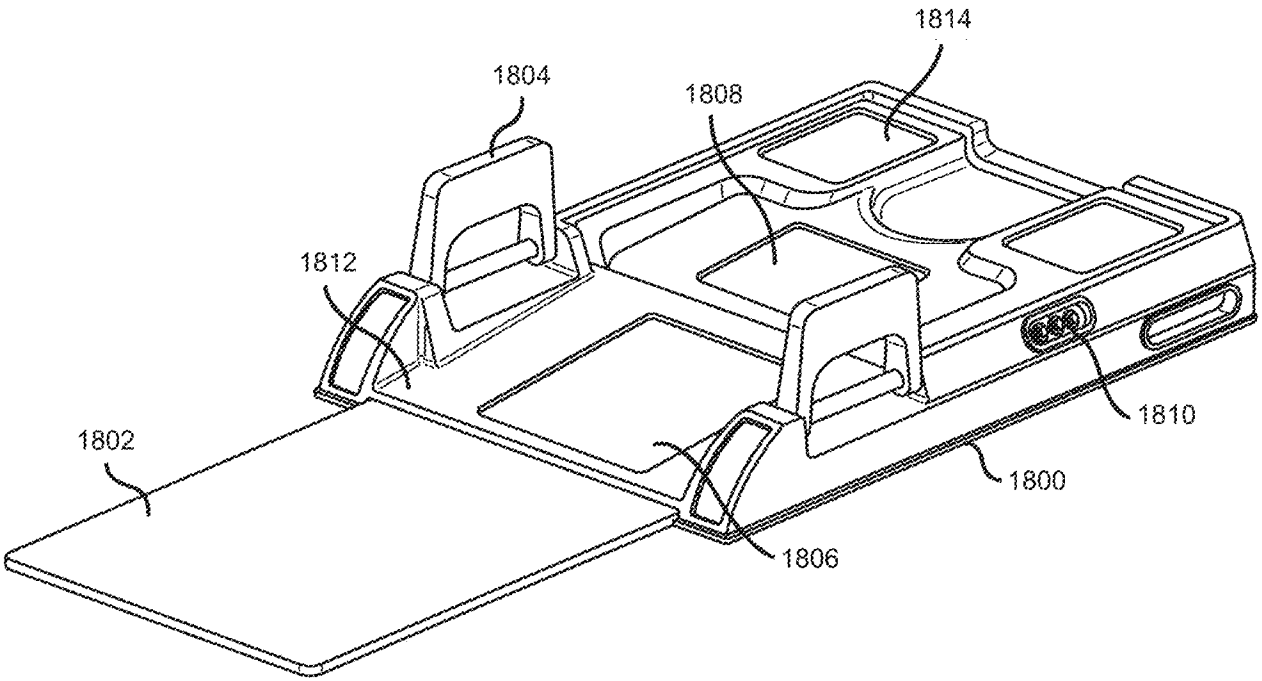
FIG. 18B shows another view of the support structure of FIG. 18A according to embodiments.
Figure 18C:
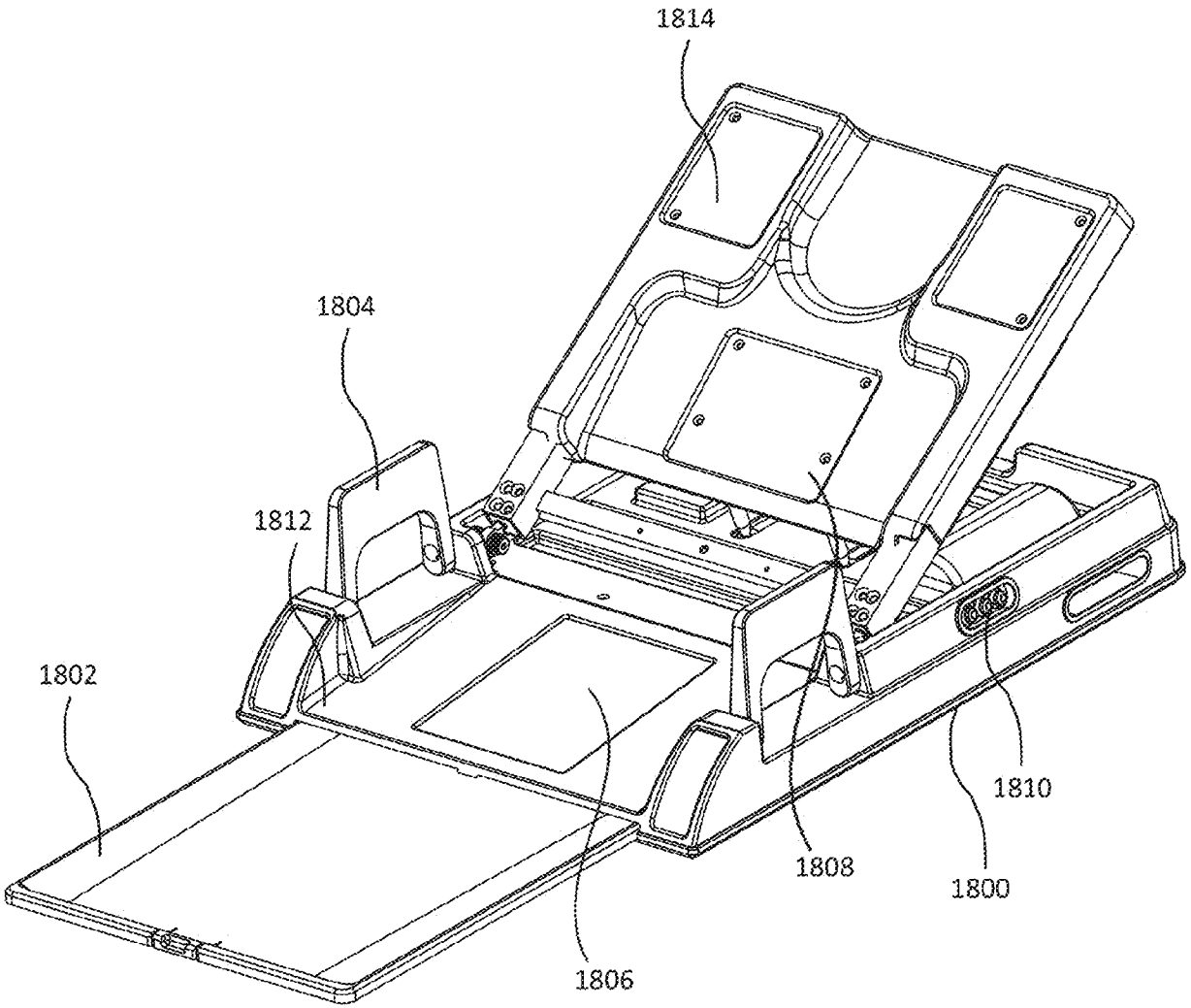
FIG. 18C depicts the support structure of FIG. 18A according to embodiments.
Figure 18D:
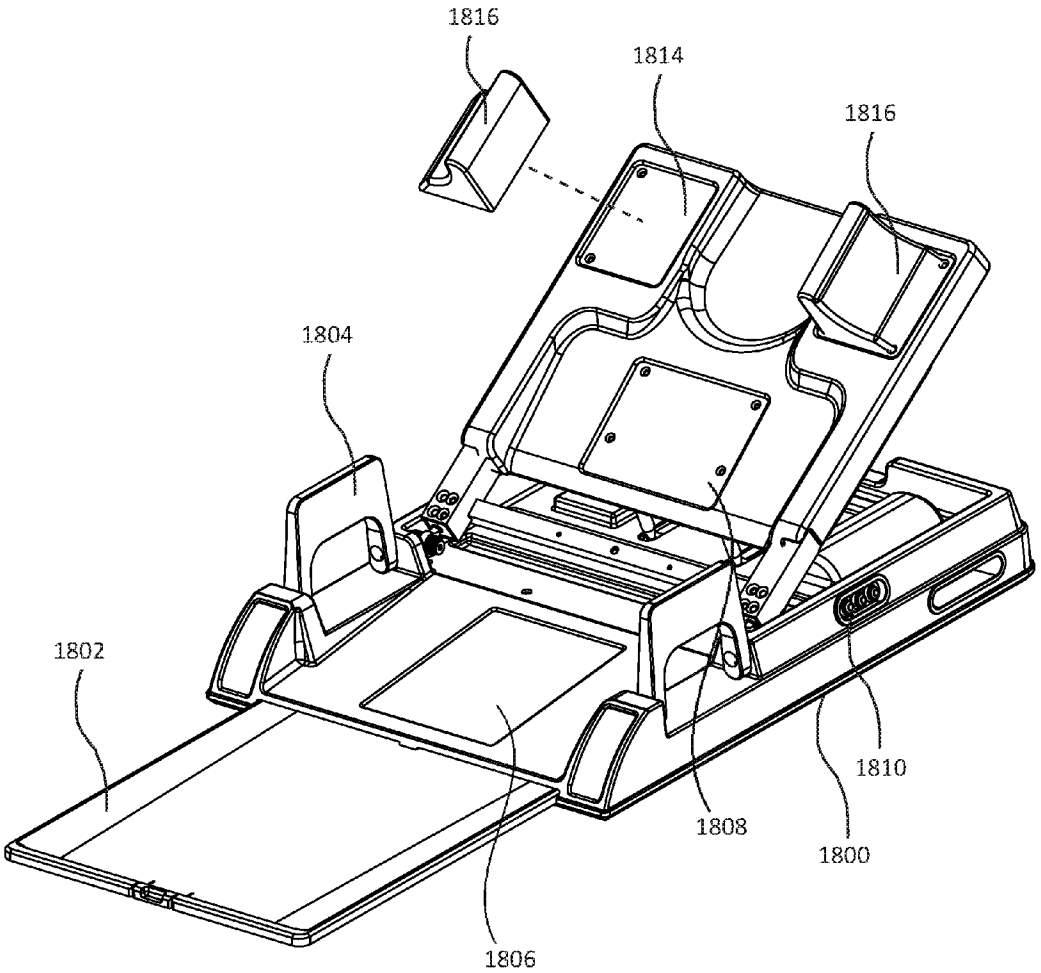
FIG. 18D shows the support structure of FIG. 18A according to embodiments.

FIG. 18B depicts support structure 1800 in an extended, but relatively flat position. Here, underbody stabilizer 1802 is extended from support structure 1800 such that at least a portion of a lower body of the patient may be supported by underbody stabilizer 1802. Armpit stabilizers 1804 may be rotated into alignment with a patient's underarms such that a portion of the armpit stabilizers 1804 closest to the head may engage the patient's underarms to maintain the patient in the correct position during administration of CPR. In some embodiments, the armpit stabilizers 1804 may be mounted to a lateral expansion element that may be adjusted to accommodate different patient sizes. FIG. 18C shows the support structure 1800 in an extended and elevated position. Here, the upper support 1814 and/or lower support 1812 may be elevated above a horizontal plane, such as described herein. For example, upper support 1814 may be elevated by actuation of the motor (not shown) due to a user interacting with motor controls 1810. The elevation may be between about 15° and 45° above a substantially horizontal plane in which the patient's lower body is positioned. In some embodiments, the support structure 1800 may include one or more head stabilizers 1816. The head stabilizers 1816 may be removably coupled with the upper support 1814, such as using a hook and loop fastener, magnetic coupling, a snap connector, a reusable adhesive, and/or other removable fastening techniques. In some embodiments, the head stabilizers 1816 may be coupled after a patient has been positioned on support structure 1800. This allows the spacing between the head stabilizers 1816 to be customized such that support structure 1800 may be adapted to fit any size of patient.

It will be appreciated that the components of the elevation systems described herein may be interchanged with other embodiments. For example, although some systems are not shown in connection with a feature to lengthen or elongate the upper support, such a feature may be included. As another example, the various head stabilizers, neck positioning structures, positioning motors, and the like may be incorporated within or interchanged with other embodiments.

Figure 19A:
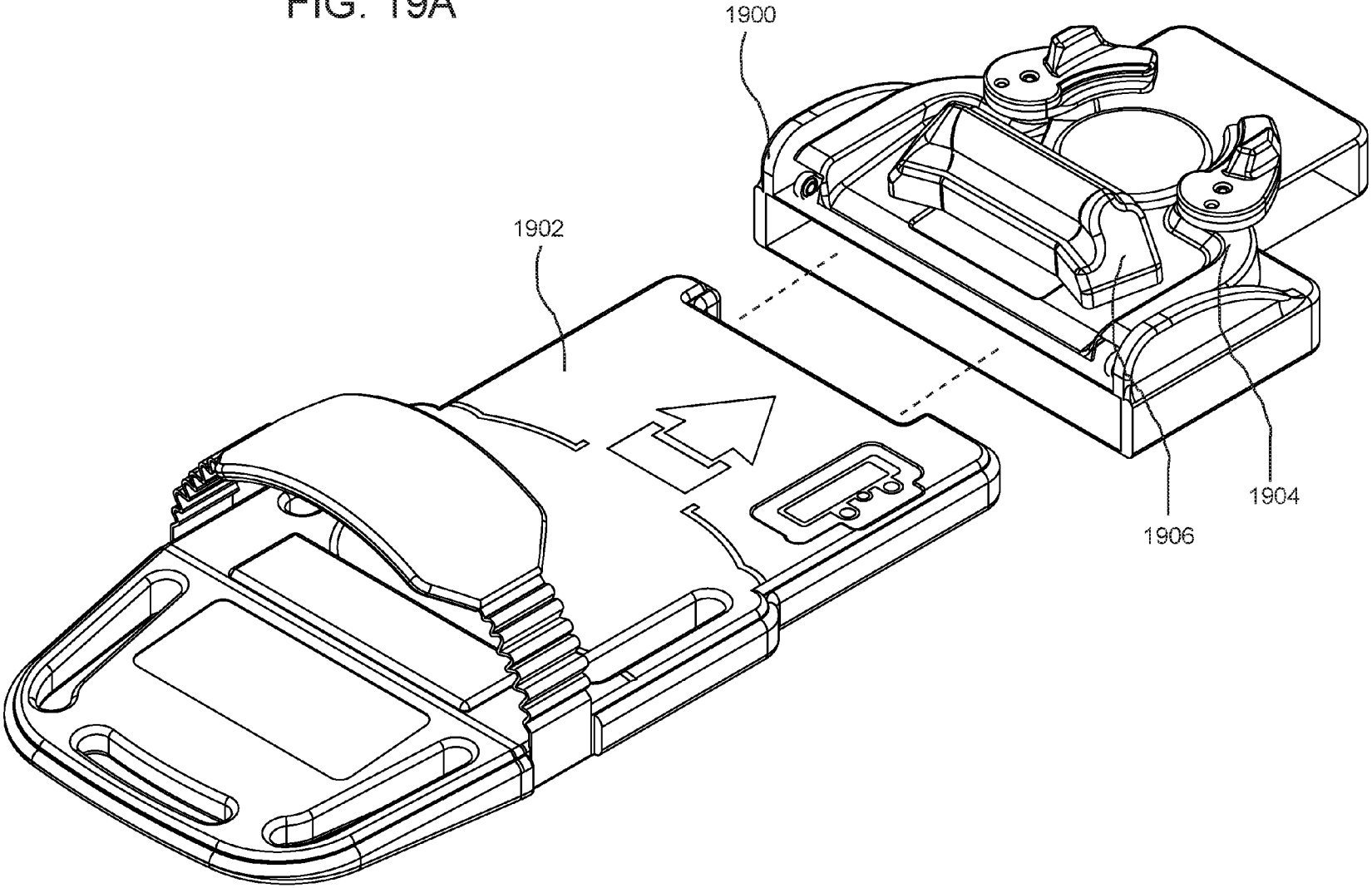
FIG. 19A depicts a support structure with a separable base according to embodiments.
Figure 19B:
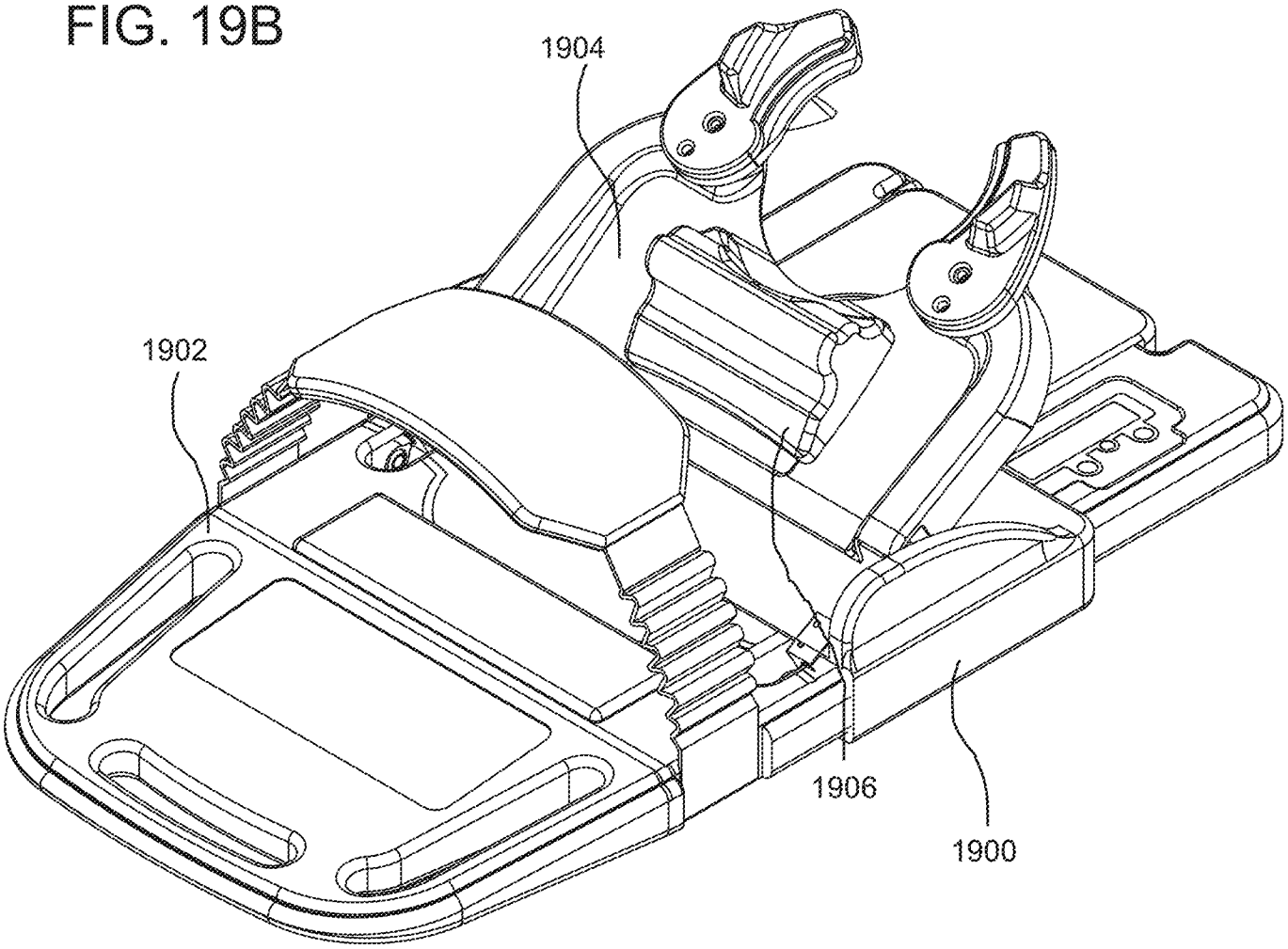
FIG. 19B depicts the support structure with a separable base of FIG. 19A coupled as a single unit according to embodiments.

FIGS. 19A and 19B depict an embodiment of a support structure 1900 having a removable base 1902. Support structure 1900 may be similar to the support structures described above, however rather than having a thoracic plate the support structure 1900 may have a channel that receives the base 1902 or other back plate that may support at least a portion of the patient's torso and/or upper body. Base 1902 may be a wedge or other shape that may be made of foam, plastic, metal, and/or combinations thereof. Base 1902 may be completely separable from support structure 1900 as shown in FIG. 19A. Base 1902 may be configured to slide within the channel of support structure 1900 when head up CPR is desired. When outside of the channel, base 1902 may be used to couple a load-distributing band to the patient during supine CPR. If head up CPR is needed, the patient's head, neck, and shoulders may be lifted, the base 1902 may be slid into the channel, and the head, neck, and shoulders may be lowered onto an upper support 1904 of the support structure 1900. In some embodiments, the support structure 1900 may include clamps or locks that secure the base 1902 in position such that the base 1902 does not slide during performance of CPR. When coupled as shown in FIG. 19B, support structure 1900 and base 1902 form a support structure with similar functionality as those described herein, with the base 1902 supporting part of the patient's torso and providing a point of coupling for a CPR assist device, while support structure 1900 includes an upper support 1904 and neck pad 1906 that may be elevated and expanded along a length of the support structure 1900 to maintain the patient's head, neck, and shoulders in a proper position, such as the sniffing position, during elevation and head up CPR. By having a support structure 1900 separate from the base 1902, it is possible to use various chest compression devices with the support structure 1900.

Figure 20:
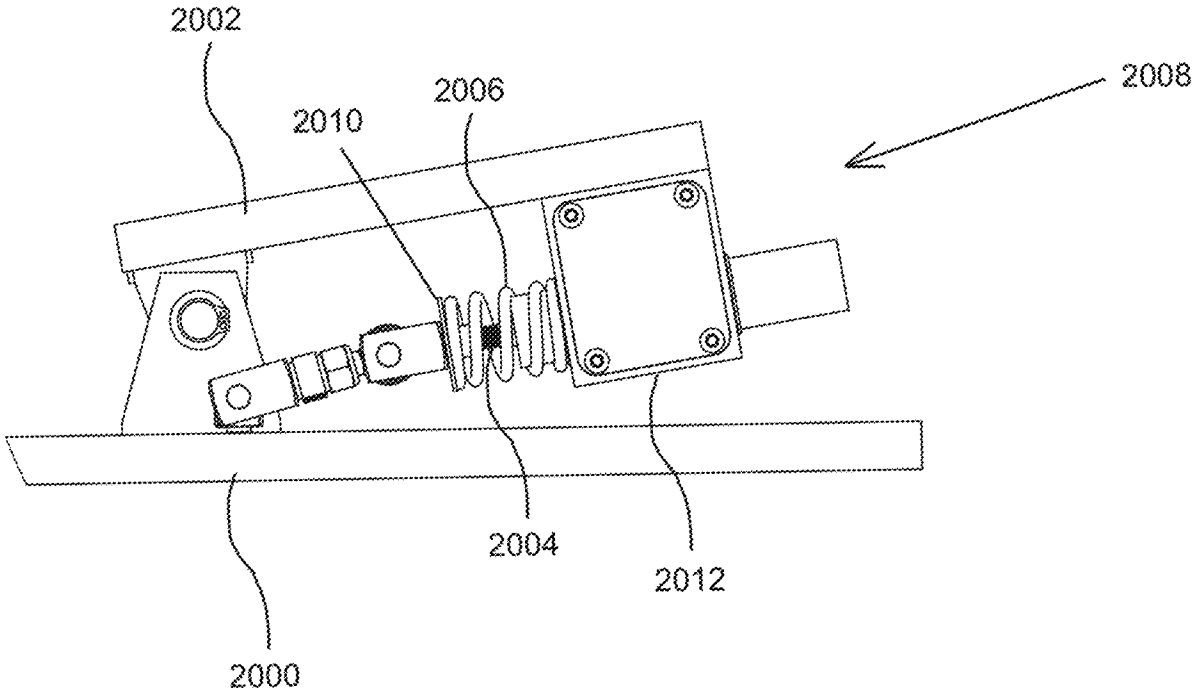
FIG. 20 depicts a spring-assisted motor mechanism of a support structure according to embodiments.

FIG. 20 depicts one embodiment of a spring-assisted motor assembly 2008 for a support structure 2000. Support structure 2000 and motor assembly 2008 may operate similar to the motor 808 of FIG. 8. For example, support structure 2000 may include a base and an upper support 2002. The upper support 2002 may be elevated using motor assembly 2008, which may be battery powered and/or include a power cable. During operation, motor assembly 2008 may raise, lower, and/or maintain a position of the upper support 2002. Here, the motor assembly 2008 operates through a gearbox to generate right angle linear motion. This occurs by the motor shaft having a worm gear attached to it. This worm gear drives a right angle worm wheel that has a lead nut pressed into it. The rotation of the worm wheel/lead nut assembly causes a lead screw 2004 to move in a direction perpendicular to the original motor shaft. As lead screw 2004 extends, it pushes against a fixed linkage that has pivots at each end, thereby forcing the elevation of the upper support by pivoting about a joint to raise and lower the upper support 2002. A spring 2006 may be positioned concentrically with the lead screw 2004. Spring 2006 is configured to store potential energy when the spring 2006 is compressed, such as when the motor assembly 2008 is used to lower the upper support 2002. This occurs as lead screw 2004 contracts, a spring stop 2010 and a motor assembly housing 2012 (or another spring stop) are drawn toward one another. Spring 2006 is positioned between the spring stop 2010 and the motor assembly housing 2012, with the ends of spring 2006 coupled with and/or positioned against the spring stop 2010 and/or motor assembly housing 2012. The drawing of the spring stop 2010 toward the motor assembly housing 2012 thereby forces spring 2006 to compress. As the motor assembly 2008 is used to elevate the upper support 2002, the motor assembly housing 2012 is drawn away from spring stop 2010, allowing the spring 2006 to expand and release some or all of the stored potential energy in a direction matching the direction of extension of lead screw 2004, thereby providing additional force to aid the motor assembly 2008 in lifting the upper support 2002. This reduces the electrical energy requirement (batteries or other electrical power source) on the motor assembly 2008, allowing the support structure 2000 to operate with a lower energy cost, as well as reducing the strain on the motor assembly 2008, which may allow a less powerful motor to be used.

Figure 21:
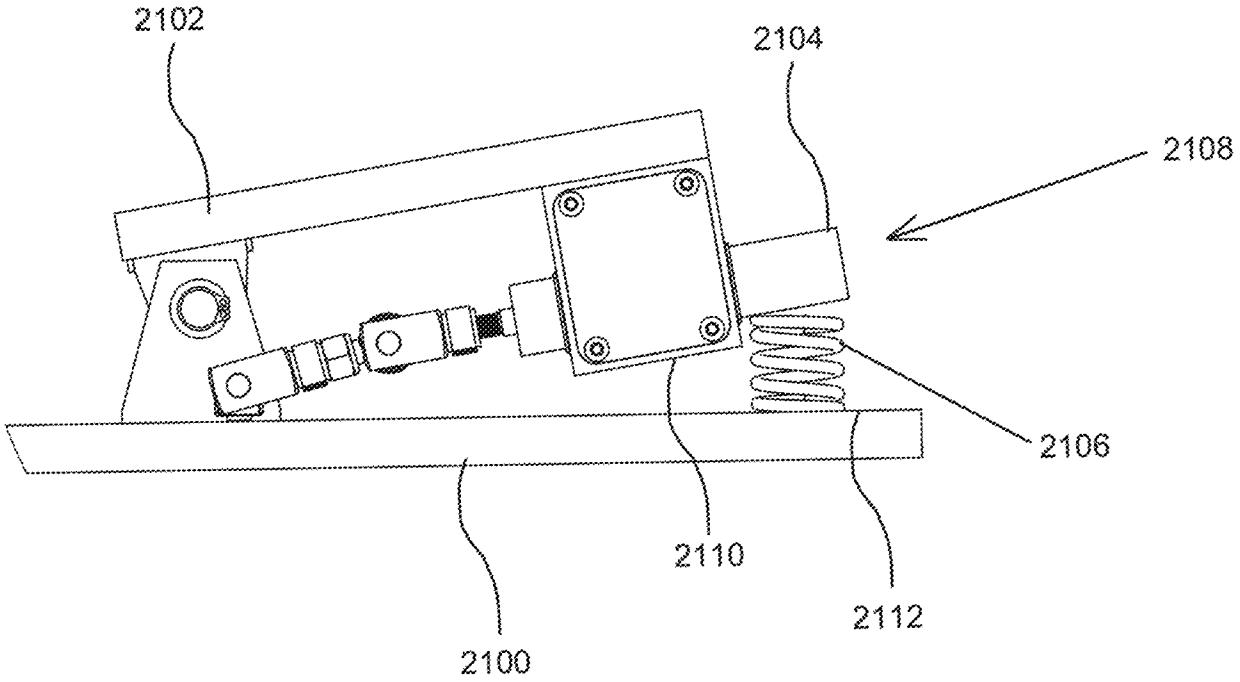
FIG. 21 depicts a spring-assisted motor mechanism of a support structure according to embodiments.

FIG. 21 depicts another embodiment of a spring-assisted motor assembly 2108 for a support structure 2100. Support structure 2100 and motor assembly 2108 may operate similar or identical to support structure 2000 and motor assembly 2008 described above. For example, support structure 2100 may include a base and an upper support 2102. The upper support 2102 may be elevated using motor assembly 2108, which may be battery powered and/or include a power cable.

During operation, motor assembly 2108 may raise, lower, and/or maintain a position of the upper support 2102. Here, the motor assembly 2108 operates through a gearbox to generate right angle linear motion. This occurs by the motor shaft having a worm gear attached to it. This worm gear drives a right angle worm wheel that has a lead nut pressed into it. The rotation of the worm wheel/lead nut assembly causes a lead screw to move in a direction perpendicular to the original motor shaft. As lead screw extends, it pushes against a fixed linkage that has pivots at each end, thereby forcing the elevation of the upper support by pivoting about a joint to raise and lower the upper support 2102. A spring 2006 may be positioned between a base 2112 of the support structure 2100 and one or both of an extension 2104 or a motor assembly housing 2110. Spring 2106 is configured to store potential energy when the spring 2106 is compressed, such as when the motor assembly 2108 is used to lower the upper support 2102. This occurs as the upper support 2102 is lowered, the extension 2104 and motor assembly housing 2110 are also lowered, drawing the components toward the base 2112 and forcing spring 2106 to compress. As the motor assembly 2108 is used to elevate the upper support 2102, the motor assembly housing 2110 and extension 2104 are drawn away from base 2112, allowing the spring 2106 to expand and release some or all of the stored potential energy in an upward direction, thereby providing additional force to aid the motor assembly 2108 in lifting the upper support 2102. This reduces the electrical energy requirement (batteries or other electrical power source) on the motor assembly 2108, allowing the support structure 2100 to operate with a lower energy cost, as well as reducing the strain on the motor assembly 2108, which may allow a less powerful motor to be used.

FIG. 22 depicts a process 2200 for performing CPR. Process 2200 may be similar to the other processes of performing CPR described herein, and may include elevating the patient to similar heights and angles as described elsewhere herein. The process 2000 typically begins with the patient flat, and CPR is started as soon as possible. CPR is performed flat initially at block 2202. At block 2204, an individual is positioned on an elevation device in a stable selected position, such as the "sniffing position" or other position defined by a relationship between the head, neck, and chest, to elevate the individual's heart and head. The elevation device may be as described herein and may include a base and an upper support pivotably coupled to the base. The upper support may be configured to receive and support a user's upper back, shoulders, and head. At block 2206, the upper support is pivoted to further elevate the head of the individual. At block 2208, the upper support is expanded lengthwise to maintain the individual in the stable selected position throughout elevation of the upper back, shoulders, and head. In some embodiments, the upper support includes an upper back plate and at least one track that is pivotably coupled with the base. In such cases, expanding the upper support may include sliding the upper back plate relative to the track using a sliding mechanism. In some embodiments, process 2200 includes engaging a lock mechanism to maintain the upper support in a desired expanded position. At block 2210 one or more of a type of CPR or a type of intrathoracic pressure regulation is performed while elevating the heart and the head. If clinically indicated, the head and thorax can be reduced to the flat or horizontal plane at any time during the CPR procedure with the elevation device. During manual CPR, a person performs chest compressions using their hands or by holding an effector such as an ACD device. During this process the person is actively involved in the CPR process and compensates automatically for any minor changes in body physiology based on the persons capabilities and/or training. During automated CPR, an automated device, put in place by a trained person and coupled with the thoracic plate, performs chest compressions/CPR. This automated device cannot perform any required compensation automatically. The trained person, (a paramedic/an EMT), supervises the operation of the automated CPR device and may perform adjustments to the position of the device and/or thoracic plate during operation.

In some embodiments, the elevation device further includes a thoracic plate operably coupled with the base. The thoracic plate may be configured to receive a chest compression device, which may include an active compression-decompression device and/or a device configured only to deliver chest compressions. In some embodiments, process 2200 may include pivoting the thoracic plate relative to the base, thereby adjusting an orientation of the chest compression device. In some embodiments, the thoracic plate may be slid lengthwise relative to the base, thereby adjusting a position of the chest compression device. In other embodiments, expanding the upper support causes a corresponding adjustment of the thoracic plate such that the chest compression device is in a proper orientation and in which the chest compression device is properly aligned with the individual's heart, such as at a substantially orthogonal angle relative to the individual's sternum. The corresponding adjustment may include a change in angle of the thoracic plate relative to a horizontal plane.

For example, the upper support may slide or extend from an initial position over an excursion distance (measured from the initial position) of between about 0 and 2 inches, which may depend on various factors, such as the amount of elevation and/or the size of the individual. The initial position may be measured from a fixed point, such as a pivot point of the upper support. The initial position of the upper support may vary based on the height of the individual, as well as other physiological features of the individual.

Additional information and techniques related to head up CPR may be found in Debaty G, et al. "Tilting for perfusion: Head-up position during cardiopulmonary resuscitation improves brain flow in a porcine model of cardiac arrest." *Resuscitation.* 2015: 87: 38-43. Print., the entire contents of which is hereby incorporated by reference. Further reference may be made to Lurie, Keith G. (2015) "The Physiology of Cardiopulmonary Resuscitation," Anesthesia & Analgesia, doi:10.1513/ANE. 0000000000000926, in Ryu, et. al. "The Effect of Head Up Cardiopulmonary Resuscitation on Cerebral and Systemic Hemodynamics." *Resuscitation.* 2016: 102: 29-34. Print., and in Khandelwal, et. al. "Head-Elevated Patient Positioning Decreases Complications of Emergent Tracheal Intubation in the Ward and Intensive Care Unit." *Anesthesia & Analgesia.* April 2016: 122: 1101-1107. Print, the entire contents of which are hereby incorporated by reference. Moreover, any of the techniques and methods described therein may be used in conjunction with the systems and methods of the present invention.

Example 1

An experiment was performed to determine whether cerebral and coronary perfusion pressures will remain elevated over 20 minutes of CPR with the head elevated at 15 cm and the thorax elevated at 4 cm compared with the supine position. A trial using female farm pigs was performed, modeling prolonged CPR for head-up versus head flat during both conventional CPR (C-CPR) and ACD+ITD CPR. A porcine model was used and focus was placed primarily on observing the impact of the position of the head on cerebral perfusion pressure and ICP.

Approval for the study was obtained from the Institutional Animal Care Committee of the Minneapolis Medical Research Foundation, the research foundation associated with Hennepin County Medical Center in Minneapolis, Minn. Animal care was compliant with the National Research Council's 1996 Guidelines for the Care and Use of Laboratory Animals, and a certified and licensed veterinarian assured protocol performance was in compliance with these guidelines. This research team is qualified and has extensive combined experience performing CPR research in Yorkshire female farm pigs.

The animals were fasted overnight. Each animal received intramuscular ketamine (10 mL of 100 mg/mL) for initial sedation, and were then transferred from their holding pen to the surgical suite and intubated with a 7-8 French endotracheal tube. Anesthesia with inhaled isoflurane at 0.8%-1.2% was then provided, and animals were ventilated with room air using a ventilator with tidal volume 10 mL/kg. Arterial blood gases were obtained at baseline. The respiratory rate was adjusted to keep oxygen saturation above 92% and end tidal carbon dioxide ($ETCO_2$) between 36 and 40 mmHg. Central aortic blood pressures were recorded continuously with a micromanometer-tipped catheter placed in the descending thoracic aorta via femoral cannulation at the level of the diaphragm. A second Millar catheter was placed in the right external jugular vein and advanced into the superior vena cava, approximately 2 cm above the right atrium for measurement of right atrial (RA) pressure. Carotid artery blood flows were obtained by placing an ultrasound flow probe in the left common carotid artery for measurement of blood flow (ml $min^{-1}$). Intracranial pressure (ICP) was measured by creating a burr hole in the skull, and then insertion of a Millar catheter into the parietal lobe. All animals received a 100 units/kg bolus of heparin intravenously and received a normal saline bolus for a goal right atrial pressure of 3-5 mmHg. $ETCO_2$ and oxygen saturation were recorded with a $CO_2$SMO Plus®.

Continuous data including electrocardiographic monitoring, aortic pressure, RA pressure, ICP, carotid blood flow, $ETCO_2$ was monitored and recorded. Cerebral perfusion pressure (CerPP) was calculated as the difference between mean aortic pressure and mean ICP. Coronary perfusion pressure (CPP) was calculated as the difference between aortic pressure and RA pressure during the decompression phase of CPR. All data was stored using a computer data analysis program.

When the preparatory phase was complete, ventricular fibrillation (VF) was induced with delivery of direct intracardiac electrical current from a temporary pacing wire placed in the right ventricle. Standard CPR and ACD+ITD CPR were performed with a pneumatically driven automatic piston device. Standard CPR was performed with uninterrupted compressions at 100 compressions/min, with a 50% duty cycle and compression depth of 25% of anteroposterior chest diameter. During standard CPR, the chest wall was allowed to recoil passively. ACD+ITD CPR was also performed at a rate of 100 per minute, and the chest was pulled upwards after each compression with a suction cup on the skin at a decompression force of approximately 20 lb and an ITD was placed at the end of the endotracheal tube. If randomization called for head and thorax elevation CPR (HUP), the head and shoulders of the animal were elevated 15 cm on a table specially built to bend and provide CPR at different angles while the thorax at the level of the heart was elevated 4 cm. While moving the animal into the head and thorax elevated position, CPR was able to be continued. Positive pressure ventilation with supplemental oxygen at a flow of 10 L $min^{-1}$ were delivered manually. Tidal volume was kept at 10 mL/kg and respiratory rate at 10 breaths per minute. If the animal was noted to gasp during the resuscitation, time at first gasp was recorded, and then succinylcholine was administered to facilitate ventilation after the third gasp.

After 8 minutes of untreated ventricular fibrillation 2 minutes of automated CPR was performed in the 0° supine (SUP) position. Pigs were then randomized to CPR with 30° head and thorax up (HUP) versus SUP without interruption for 20 minutes. In group A, all pigs received C-CPR, randomized to either HUP or SUP, and in Group B, all pigs received ACD+ITD CPR, again randomized to either HUP or SUP. After 22 total minutes of CPR, all pigs were then placed in the supine position and defibrillated with up to three 275 J biphasic shocks. Epinephrine (0.5 mg) was also given during the post CPR resuscitation. Animals were then sacrificed with a 10 ml injection of saturated potassium chloride.

The estimated mean cerebral perfusion pressure was 28 mmHg in the HUP ACD+ITD group and 19 mmHg in the SUP ACD+ITD group, with a standard deviation of 8. Assuming an alpha level of 0.05 and 80% power, it was calculated that roughly 13 animals per group were needed to detect a 47% difference.

Descriptive statistics were used as appropriate. An unpaired t-test was used for the primary outcome comparing CerPP between HUP and SUP CPR. This was done both for the ACD+ITD CPR group and also the C-CPR group at 22 minutes. All statistical tests were two-sided, and a p value of less than 0.05 was required to reject the null hypothesis. Data are expressed as mean±standard error of mean (SEM). Secondary outcomes of coronary perfusion pressure (CPP, mmHg), time to first gasp (seconds), and return of spontaneous circulation (ROSC) were also recorded and analyzed.

Results

Group A:

Table 2A below summarizes the results for group A.

TABLE 2A

Group of Conventional Cardiopulmonary Resuscitation (CPR) (Mean ± SEM)

| | Head-up | | Supine | | |
|---|---|---|---|---|---|
| | BL | 20 minutes | BL | 20 minutes | P value |
| SBP | 99 ± 4 | 20 ± 2 | 91 ± 7 | 19 ± 2 | 0.687 |
| DBP | 68 ± 3 | 12 ± 2 | 59 ± 5 | 13 ± 2 | 0.665 |
| ICP max | 25 ± 1 | 14 ± 1 | 27 ± 1 | 23 ± 1 | <0.001* |
| ICP min | 20 ± 1 | 15 ± 1 | 21 ± 1 | 20 ± 1 | <0.001* |
| RA max | 9 ± 1 | 28 ± 5 | 12 ± 1 | 26 ± 2 | 0.694 |
| RA min | 2 ± 1 | 5 ± 1 | 3 ± 1 | 9 ± 1 | 0.026* |
| ITP max | 3.3 ± 0.2 | 0.9 ± 0.2 | 3.2 ± 0.2 | 1.3 ± 0.3 | 0.229 |
| ITP min | 2.4 ± 0.1 | 0.2 ± 0.1 | 2.3 ± 0.2 | −0.1 ± 0.1 | 0.044* |
| EtCO2 | 38 ± 0 | 5 ± 1 | 38 ± 1 | 4 ± 1 | 0.153 |
| CBF max | 598 ± 25 | 85 ± 33 | 529 ± 28 | 28 ± 12 | 0.132 |
| CBF min | 183 ± 29 | −70 ± 22 | 94 ± 43 | −19 ± 9 | 0.052 |
| CPP calc | 65 ± 3 | 6 ± 2 | 56 ± 5 | 3 ± 2 | 0.283 |
| CerPP calc | 59 ± 3 | 6 ± 3 | 60 ± 6 | −5 ± 3 | 0.016* |

DBP = diastolic blood pressure

Both HUP and SUP cerebral perfusion pressures were similar at baseline. Seven pigs were randomized to each group. For the primary outcome, after 22 minutes of C-CPR, CerPP in the HUP group was significantly higher than the SUP group (6±3 mmHg versus −5±3 mmHg, p=0.016).

Elevation of the head and shoulders resulted in a consistent reduction in decompression phase ICP during CPR compared with the supine controls. Further, the decompression phase right atrial pressure was consistently lower in the HUP pigs, perhaps because the thorax itself was slightly elevated. Coronary perfusion pressure was 6±2 mmHg in the HUP group and 3±2 mmHg in the SUP group at 20 minutes (p=0.283) (Table 1A). None of the pigs treated with C-CPR, regardless of the position of the head, could be resuscitated after 22 minutes of CPR.

Time to first gasp was 306±79 seconds in the HUP group and 308±37 in the SUP group (p=0.975). Of note, 3 animals in the HUP group and 2 animals in the SUP group were not observed to gasp during the resuscitation.

Group B:

Table 2B below summarizes the results for group B.

TABLE 2B

| Group of ACD + ITD-CPR (Mean ± SEM) | | | | | |
|---|---|---|---|---|---|
| | Head-up | | Supine | | |
| | BL | 20 minutes | BL | 20 minutes | P value |
| SBP | 106 ± 5 | 70 ± 9 | 108 ± 3 | 47 ± 5 | 0.036* |
| DBP | 68 ± 5 | 40 ± 6 | 70 ± 2 | 28 ± 4 | 0.129 |
| ICP max | 26 ± 2 | 20 ± 2 | 24 ± 1 | 26 ± 2 | 0.019* |
| ICP min | 20 ± 2 | 15 ± 1 | 19 ± 1 | 20 ± 1 | <0.001* |
| RA max | 8 ± 2 | 59 ± 13 | 8 ± 1 | 56 ± 7 | 0.837 |
| RA min | 1 ± 1 | 4 ± 1 | 0 ± 1 | 8 ± 1 | 0.026* |
| ITP max | 3.4 ± 0.2 | 0.6 ± 0.3 | 3.3 ± 0.2 | 0.6 ± 0.2 | 0.999 |
| ITP min | 2.5 ± 0.1 | −3.1 ± 0.8 | 2.3 ± 0.1 | −3.4 ± 0.3 | 0.697 |
| EtCO2 | 40 ± 1 | 36 ± 2 | 38 ± 1 | 34 ± 2 | 0.556 |
| CBF max | 527 ± 51 | 50 ± 34 | 623 ± 24 | 35 ± 25 | 0.722 |
| CBF min | 187 ± 30 | −24 ± 17 | 206 ± 17 | −5 ± 8 | 0.328 |
| CPP calc | 67 ± 5 | 32 ± 5 | 69 ± 2 | 19 ± 5 | 0.074 |
| CerPP calc | 62 ± 5 | 51 ± 8 | 65 ± 2 | 20 ± 5 | 0.006* |

Both HUP and SUP cerebral perfusion pressures were similar at baseline. Eight pigs were randomized to each group. For the primary outcome, after 22 minutes of ACD+ITD CPR, CerPP in the HUP group was significantly higher than the SUP group (51±8 mmHg versus 20±5 mmHg, p=0.006). The elevation of cerebral perfusion pressure was constant over time with ACD+ITD plus differential head and thorax elevation. This is shown in FIG. 23. These findings demonstrate the synergy of combination optimal circulatory support during CPR with differential elevation of the heart and brain.

In pigs treated with ACD+ITD, the systolic blood pressure was significantly higher after 20 minutes of CPR in the HUP position compared with controls and the decompression phase right atrial pressures were significantly lower in the HUP pigs. Further, the ICP was significantly reduced during ACD+ITD CPR with elevation of the head and shoulders compared with the supine controls.

Coronary perfusion pressure was 32±5 mmHg in the HUP group and 19±5 mmHg in the SUP group at 20 minutes (p=0.074) (Table 1B). Both groups had a similar ROSC rate; 6/8 swine could be resuscitated in both groups.

Time to first gasp was 280±27 seconds in the head up tilt (HUT) group and 333±33 seconds in the SUP group (p=0.237).

The primary objective of this study was to determine if elevation of the head by 15 cm and the heart by 4 cm during CPR would increase the calculated cerebral and coronary perfusion pressure after a prolonged resuscitation effort. The hypothesis stated that elevation of the head would enhance venous blood drainage back to the heart and thereby reduce the resistance to forward arterial blood flow and differentially reduce the venous pressure head that bombards the brain with each compression, as the venous vasculature is significantly more compliance than the arterial vasculature. The hypothesis further included that a slight elevation of the thorax would result in higher systolic blood pressures and higher coronary perfusion pressures based upon the following physiological concepts. A small elevation of the thorax, in the study 4 cm, was hypothesized to create a small but important gradient across the pulmonary vascular beds, with less congestion in the cranial lung fields since elevation of the thorax would cause more blood to pool in the lower lung fields. This would allow for better gas exchange in the upper lung fields and lower pulmonary vascular resistance in the congested upper lung fields, allowing more blood to flow from the right heart through the lungs to the left ventricle when compared to CPR in the flat or supine position. In contrast to a previous study with the whole body head up tilt, where there was a concern about a net decrease in central blood volume over time in greater pooling of venous blood over time in the abdomen and lower extremities, it was hypothesized that the small 4 cm elevation of the thorax with greater elevation of the head would provide a way to increase coronary pressure (by lower right atrial pressure) and greater cerebral perfusion pressure (by lowering ICP) while preserving central blood volume and thus mean arterial pressure.

It has been previously reported that whole body head tilt up at 30° during CPR significantly improves cerebral perfusion pressure, coronary perfusion pressure, and brain blood flow as compared to the supine, or 0° position or the feet up and head down position after a relatively short duration of 5 minutes of CPR. Over time these effects were observed to decrease, and we hypothesized diminished effect over time was secondary to pooling of blood in the abdomen and lower extremities. The new results demonstrate that after a total time of 22 minutes of CPR, the absolute ICP values and the calculated CerPP were significantly higher in the head and shoulders up position versus the supine position for both automated C-CPR and ACD+ITD groups. The absolute HUP effect was modest in the C-CPR group, unlikely to be clinically significant, and none of the animals treated with C-CPR could be resuscitated. By contrast, differential elevation of the head by 15 cm and the thorax at the level of the heart by 4 cm in the ACD+ITD group resulted in a nearly 3-fold higher increase in the calculated CerPP and a 50% increase in the calculated coronary perfusion pressure after 22 minutes of continuous CPR. The new finding of increased coronary and CerPP in the HUP position during a prolonged ACD+ITD CPR effort is clinically important, since the average duration of CPR during pre-hospital resuscitation is often greater than 20 minutes and average time from collapse to starting CPR is often >7 minutes.

Other study endpoints included ROSC and time to first gasp as an indicator of blood flow to the brain stem. No pigs could be resuscitated after 22 minutes in the C-CPR group. ROSC rates were similar in Group B, with 6/8 having ROSC in both HUP and SUP groups.

From a physiological perspective, these findings are similar to those in the first whole body head up tilt CPR study. While ICP decreases with the HUP position, it is critical to maintain enough of an arterial pressure head to pump blood upwards to the elevated brain during HUP CPR. In a previous HUP study, removal of the ITD from the circuit resulted in an immediate decrease in systolic blood pressure. In the current study, the arterial pressures were lower in pigs treated with C-CPR versus ACD+ITD, both in the SUP and HUP positions. It is likely that the lack of ROSC in the pigs treated with C-CPR is a reflection of the limitations of conventional CPR where coronary and cerebral perfusion is far less than normal. As such, the absolute ROSC rates in the current study are similar to previous animal studies with ACD+ITD CPR and C-CPR.

Gasping during CPR is positive prognostic indicator in humans. While time to first gasp within Groups A and B was not significant, the time to first gasp was the shortest in the ACD+ITD HUP group of all groups. All 16 animals treated with ACD+ITD group gasped during CPR, whereas only 5/16 pigs gasped in the C-CPR group during CPR (3 HUP, 2 SUP).

Differential elevation of the head and thorax during C-CPR and ACD+ITD CPR increased cerebral and coronary perfusion pressures. This effect was constant over a prolonged period of time. In the absence of any vasopressor drugs, such as adrenaline, CerPP in the pigs treated with ACD+ITD CPR and the HUP position was nearly 50 mmHg, strikingly higher than the ACD+ITD SUP controls. In addition, the coronary perfusion pressure increased by about 50%, to levels known to be associated with consistently higher survival rates. By contrast, the modest elevation in CerPP in the C-CPR treated animals is likely clinically insignificant, as no pig treated with C-CPR could be resuscitated after 22 minutes of CPR. These observations provide strong support of the benefit of the combination of ACD+ITD CPR with differential elevation of the head and thorax. Using the same model of prolonged CPR as described by Ryu et. al, it was subsequently observed that adrenaline (epinephrine), administered at the end of the prolonged period of CPR to help resuscitate the pigs, increased CerPP in animals treated with ACD+ITD and 30° head up to higher levels than those treated with ACD+ITD and head flat.

Figure 24:
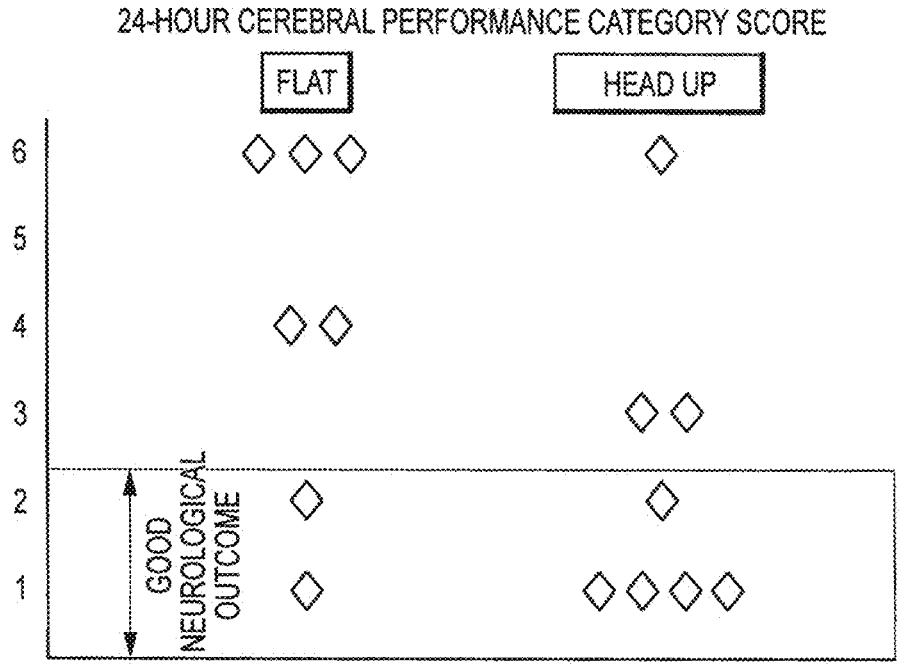
FIG. 24 is a chart depicting 24 hour porcine survival data from head and thorax up ACD+ITD CPR vs. flat or supine CPR and the cerebral performance category scores according to embodiments.

A separate study was performed to better understand the potential to increase neurologically intact 24-hour survival in pigs with head up ACD+ITD CPR, as shown in FIG. 24. The methods were similar to those described in in Ryu, et. al. "The Effect of Head Up Cardiopulmonary Resuscitation on Cerebral and Systemic Hemodynamics." *Resuscitation.* 2016: 102: 29-34, the contents of which are hereby incorporated by reference. After resuscitation, animals were cared for for up to 24 hours and using the neurological scoring system shown in FIG. 24, their brain function was assess by a veterinarian blinded to the method of CPR used. A majority of pigs (5/7) who had flat or supine CPR administered had poor neurological outcomes. Notably, two of the pigs had very bad brain function and three of the pigs were dead. In contrast, a majority of pigs (5/8) receiving head and thorax up CPR had favorable neurological outcomes, with four pigs being normal and another pig suffering only minor brain damage. In the head and thorax up group, only a single pig was dead and two others had moderate brain damage. Thus, there was a much greater change that a pig survived with good brain function if head and thorax up CPR was administered rather than supine CPR.

Example 2

Figure 25:
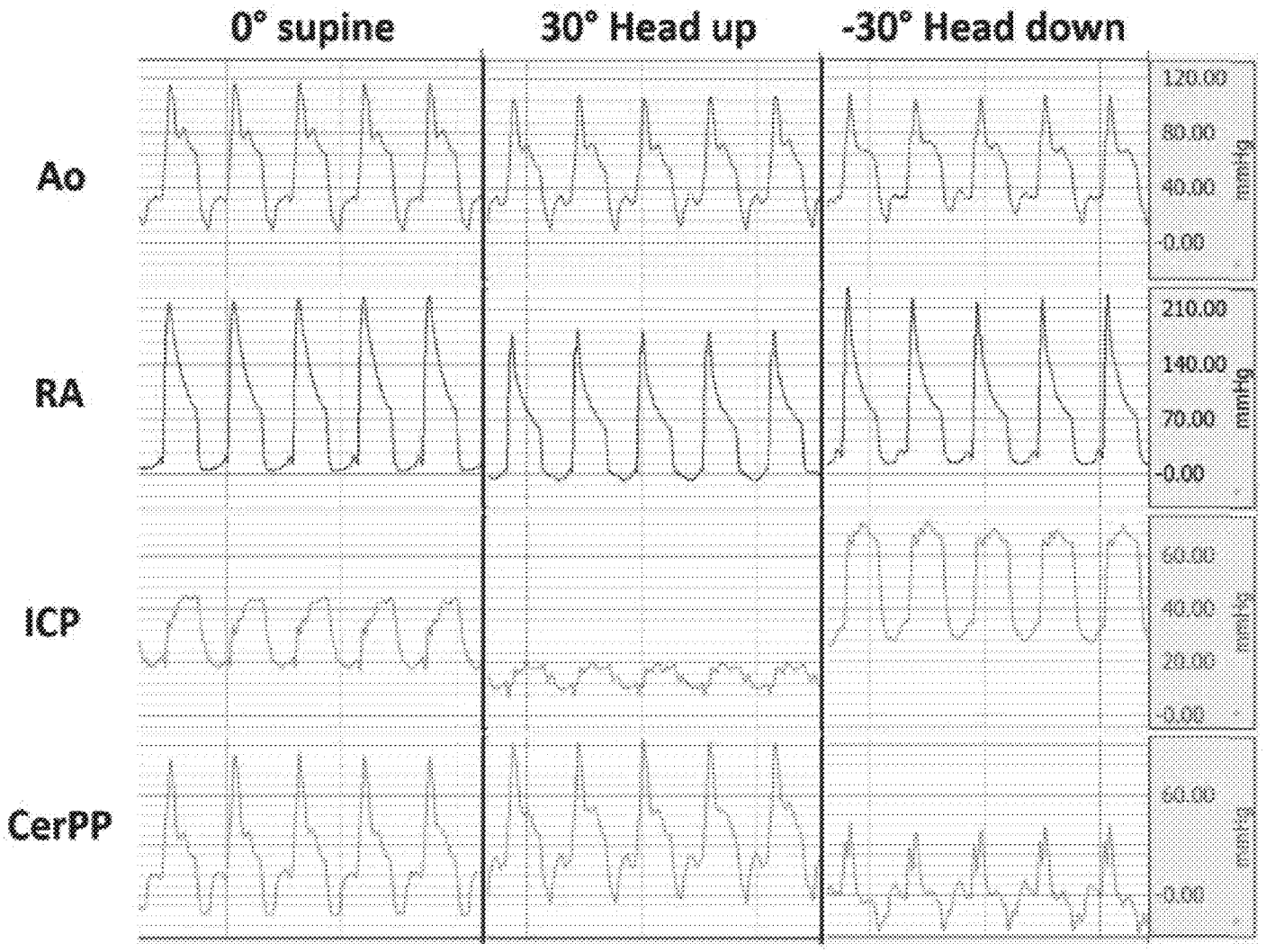
FIG. 25 is a chart depicting ICP measured during CPR in a pig using the LUCAS plus ITD in various whole body tilt positions according to embodiments.

CPR was administered on pigs with various positions of the head and body according to the methodology described by Debaty G, et al. in "Tilting for perfusion: Head-up position during cardiopulmonary resuscitation improves brain flow in a porcine model of cardiac arrest." *Resuscitation.* 2015: 87: 38-43. Specifically CPR was administered to pigs in the supine position, in a 30° head up position, and in a 30° head down position using the combination of the LUCAS 2 device to perform chest compressions at 100 compressions per minute and a depth of 2 inches along with an ITD. The data collected demonstrates that elevation of the head during CPR has a profound beneficial effect on ICP, CerPP, and brain blood flow when compared with the traditional supine horizontal position. With the body supine and horizontal, each compression is associated with the generation of arterial and venous pressure waves that deliver a simultaneous high pressure compression wave to the brain. With a pig's head up, gravity drains venous blood from the brain back to the heart, resulting in a greater refilling of the heart after each compression, strikingly lower compression and decompression phase ICP, and a higher compression and decompression phase cerebral perfusion pressure (CerPP). By contrast, CPR with the patient's feet up and head down resulted in a marked decrease in CerPP with a simultaneous increase in ICP as shown in FIG. 25. As shown in cardiac arrest studies in pigs, elevation of the head results in an immediate decrease in ICP and an increase in CerPP. There is an immediate and clinically important effect of changing from the 0° horizontal to a 30° head up on key hemodynamic parameters during CPR with the ITD. Head-up CPR is ultimately dependent on the ability to maintain adequate forward flow. These benefits are realized only when an ITD is present; when the ITD is removed from the airway in these studies, systolic blood pressure and coronary and CerPP decrease rapidly. This was also shown in the same study by Debaty et al.

Example 3

Figure 26:
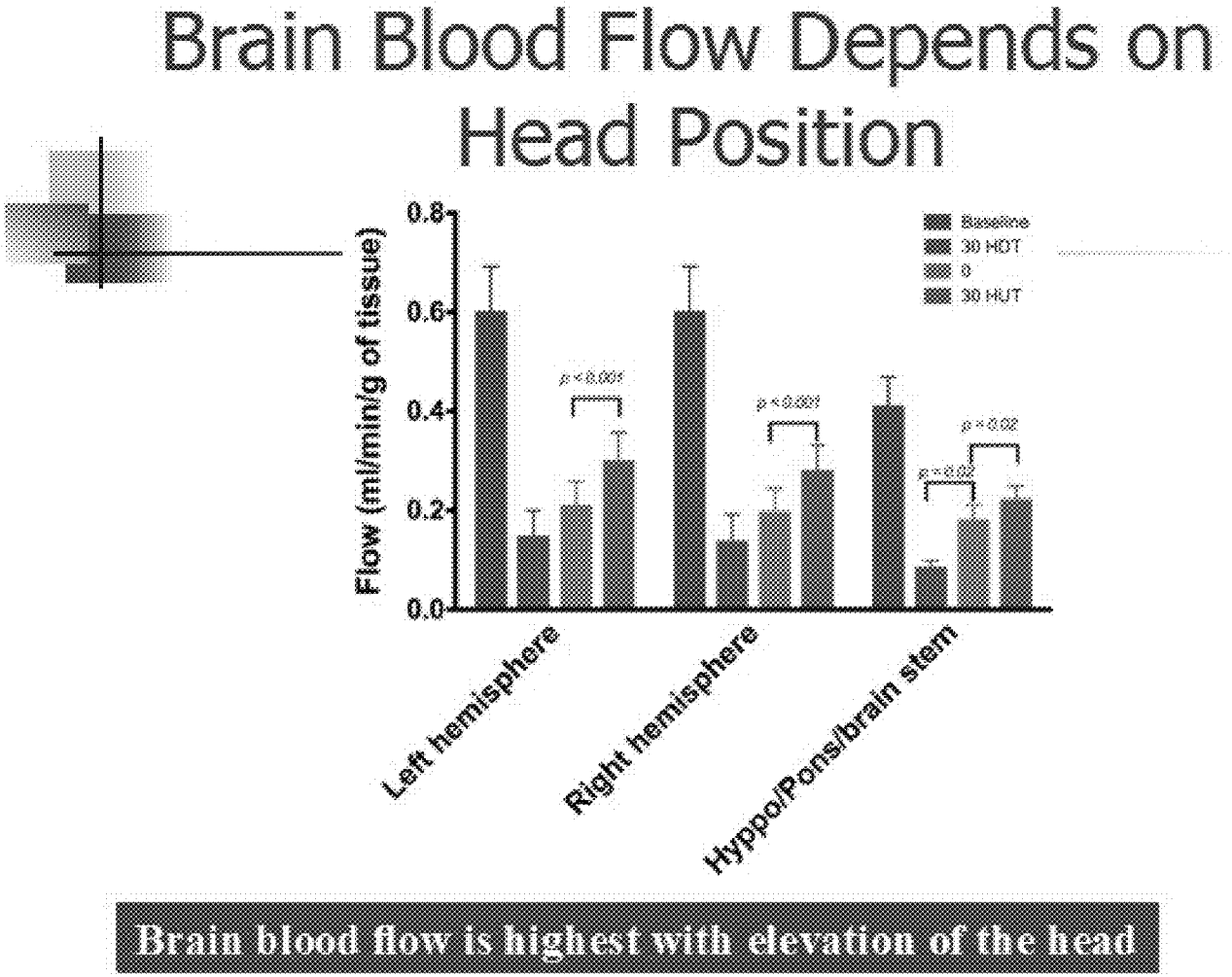
FIG. 26 is a chart depicting blood flow measured in the brain during CPR performed with the LUCAS device and an ITD in pigs in various body positions according to embodiments.

Blood flow to the brain was assessed during CPR using the LUCAS device and the ITD when pigs were on a tilt table in the flat (supine) position, and in the 30 degree head up tilt and 30 degree head down tilt position. The methods were described in the article by Debaty et al, referenced above. The findings are shown in FIG. 26. There was a marked decrease in blood flow to the brain with the head down tilt (HDT) and a marked increase in blood flow to the brain with the head up tilt (HUT). In this study, the ITD was needed to maintain blood pressure, as reported by Debaty et al. This study demonstrates the benefits of head up CPR when CPR is performed with the LUCAS device and the ITD.

Example 4

Another study was performed with head up CPR using the same protocol and device as described by Drs. Ryu et al in Resuscitation, previously incorporated by reference. In this study, blood flow to the heart and brain of pigs was examined using microspheres 5 and 15 minutes after CPR was started. CPR was performed with the ACD+ITD device with just the head and thorax elevated. The microsphere technique was similar to the reported by Debaty et al, previously incorporated by reference. The protocol started by injecting a baseline microsphere. Ventricular fibrillation (VF) was induced and left untreated for 8 minutes. Automated ACD+ITD was performed for 2 minutes with the pigs (n=2) flat. The head and thorax were elevated, per the paper by Ryu et al, and ACD+ITD CPR was continued in the head up position for a total of 20 minutes. After 5 minutes of automated ACD+ITD CPR, the second microsphere injection was made. After 15 minutes of ACD+ITD CPR, the third microsphere injection was made. The animals were shocked back after 20 minutes.

Figure 27:
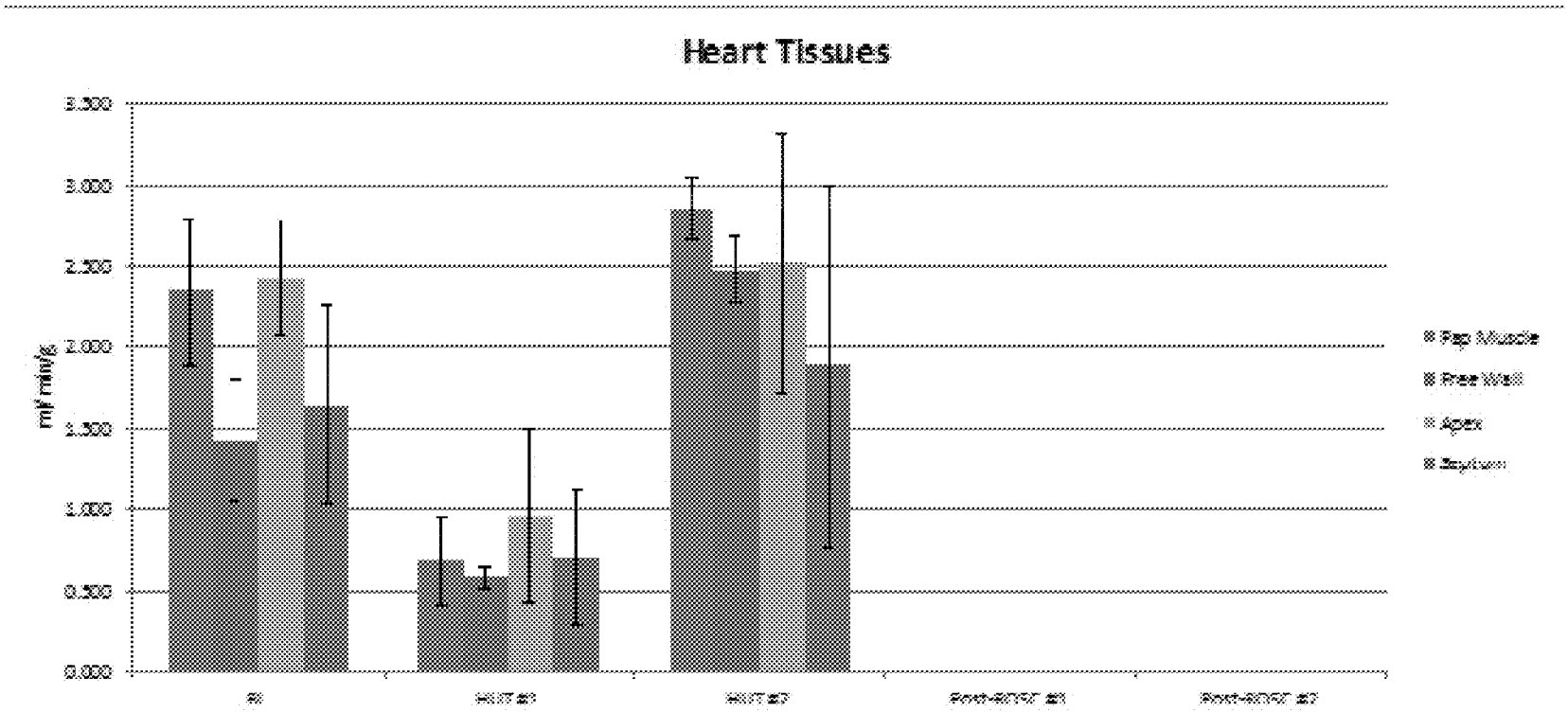
FIG. 27 is a chart depicting blood flow to the heart measured in pigs before cardiac arrest, during CPR after 5 minutes of head up tilt and 15 minutes of head up tilt when performed with ACD+ITD CPR.
Figure 28:
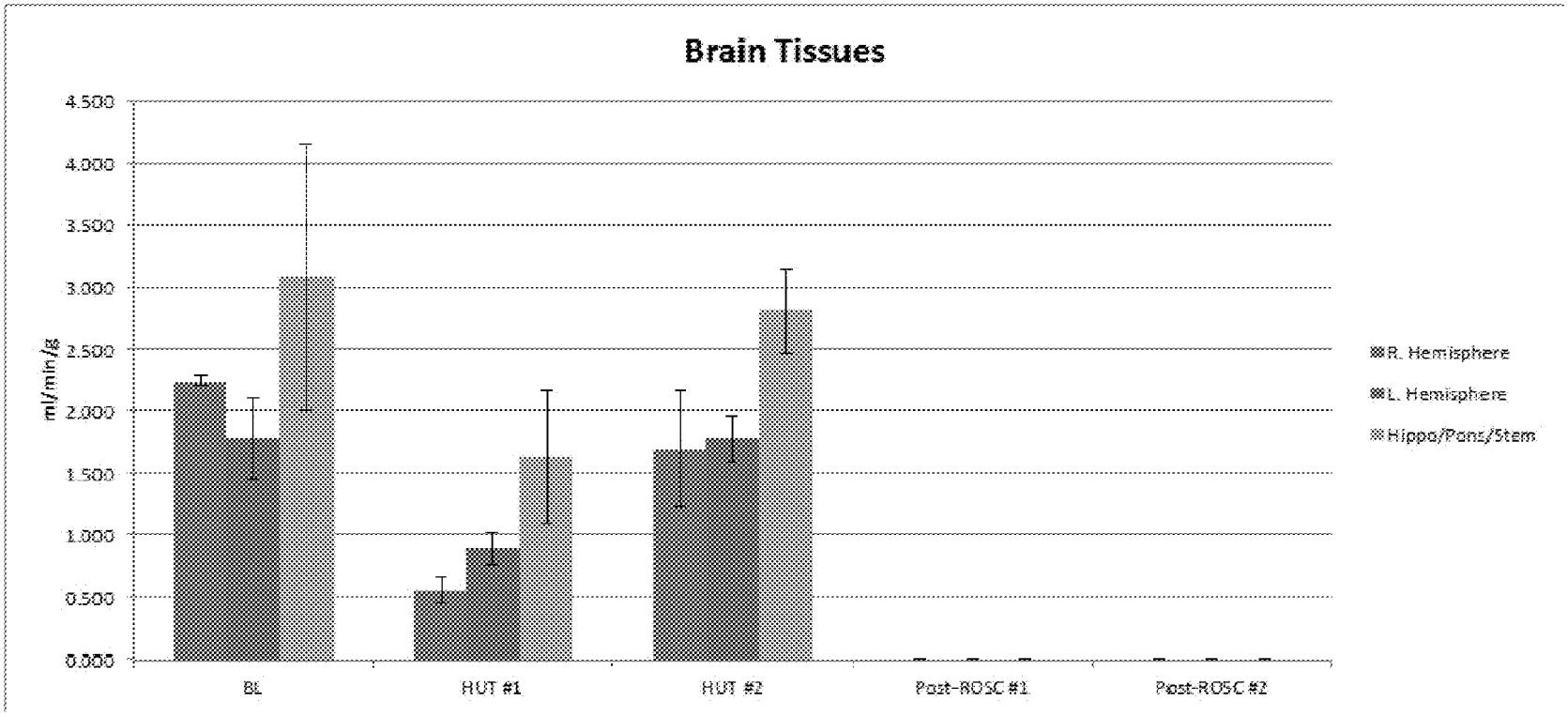
FIG. 28 is a chart depicting brain blood flow measured in pigs before cardiac arrest, during CPR after 5 minutes of head up tilt and 15 minutes of head up tilt when performed with ACD+ITD CPR.

Strikingly, the blood flow to the heart and brain increased over the time that ACD+ITD CPR was performed. As shown in FIGS. 27 and 28, blood flow to the heart and brain were essentially at baseline with this approach as at the 15 minute time point. These striking findings demonstrate the importance of this invention. Typically blood flow to the heart and brain are markedly lower after 5 minutes of CPR and flow typically goes down over time. This did not happen with the new invention. With the new invention blood flow to the brain and heart was essentially normal after 15 minutes of ACD+ITD+head up CPR.

Example 5

To show head up CPR as described in the multiple embodiments in this application, a human cadaver model was used. The body was donated for science. The cadaver was less than 36 hours old and had never been embalmed or frozen. It was perfused with a saline with a clot disperser solution that breaks up blood clots so that when the head up CPR technology was evaluated there were no blood clots or blood in the blood vessels. In these studies we used either the combination of ACD+ITD or LUCAS+ITD to perform CPR both in the flat and head up positions.

Figure 29:
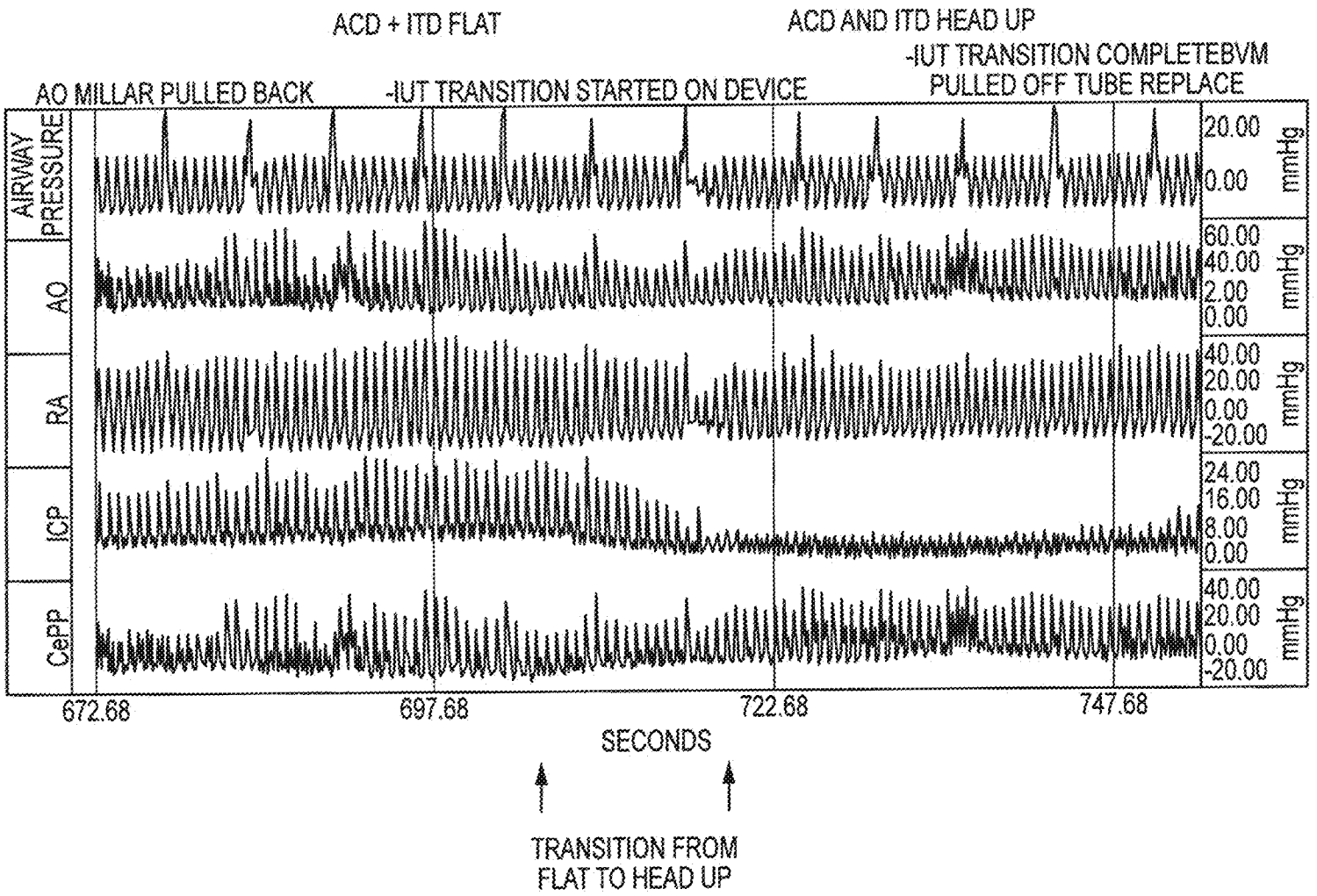
FIG. 29 is a chart depicting pressures measured in a human cadaver perfused with a clot-busting solution prior to performing manual CPR and ACD CPR plus ITD in a flat position and in a head up position according to embodiments.
Figure 30:
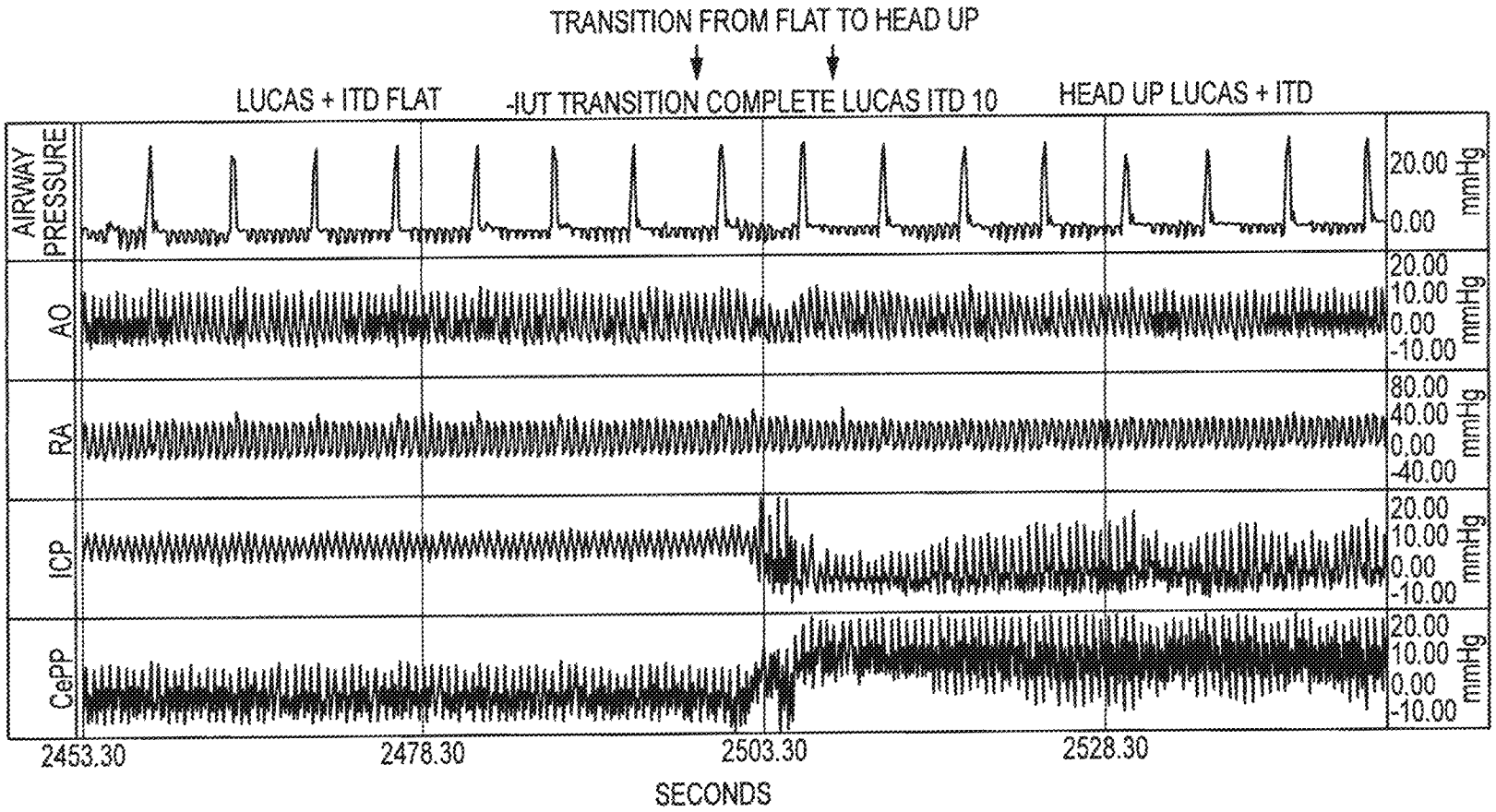
FIG. 30 is a chart depicting pressures measured in a human cadaver perfused with a clot-busting solution prior to performing CPR with an automated chest compression device (LUCAS) plus ITD in a flat position and in a head up position according to embodiments.

Right atrial, aortic, and intracranial pressure transducers were inserted into the body into the right atria, aorta, and the brain through an intracranial bolt. These high fidelity transducers were then connected to a computer acquisition system (Biopac). CPR was performed with a ACD+ITD CPR in the flat position and then with the head elevated with the device shown in FIGS. 6A-D. The aortic pressure, intracranial pressure and the calculated cerebral perfusion pressure with CPR flat and with the elevation of the head as shown in FIG. 29. With elevation of the head cerebral perfusion pressures (CerPP) increased as shown in the lower tracings, with the transition from flat to head up the decompression phase CerPP (lower aspect of each tracing) is higher. This is also shown in FIG. 30, where the intracranial pressure falls and the CerPP increases with head up, demonstrating the striking improvement in cerebral perfusion pressure with this invention. The abbreviations are as follows: AO=aortic pressure, RA=right atrial pressure, ICP=intracranial pressure, CePP=cerebral perfusion pressure.

Then, the Lucas device plus ITD was applied to the cadaver and CPR was performed with the cadaver flat and with head up with a device similar to the device shown in FIGS. 6A-D. With elevation of the head cerebral perfusion pressures (CerPP) increased as shown in FIG. 28 in the lower tracing.

Example 6

Figure 31:
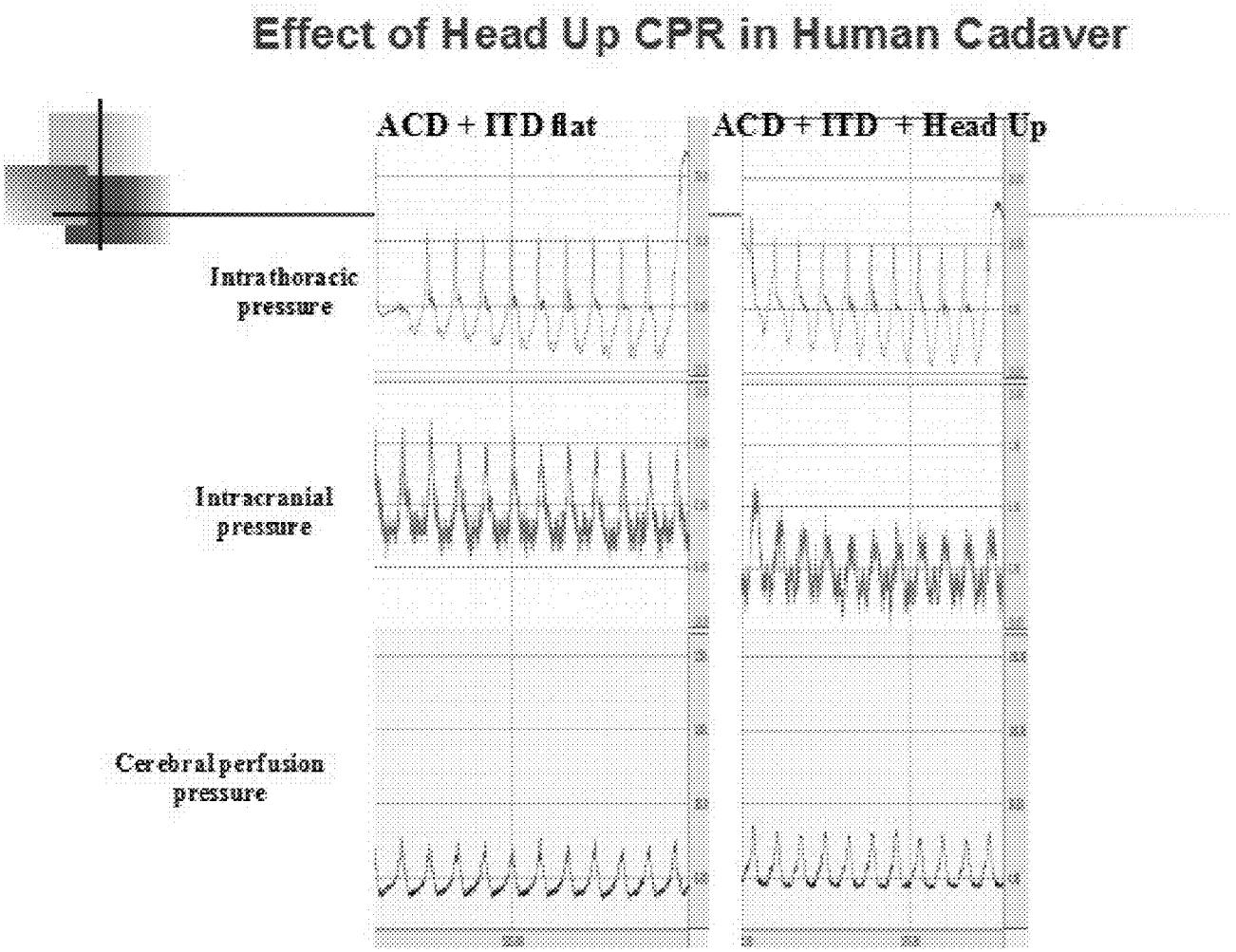
FIG. 31 is a chart depicting ITP, ICP, and cerebral perfusion pressure measured in a human cadaver perfused with a clot-busting solution prior to performing ACD-ITD CPR with the body flat and then with the head, shoulder, and heart elevated with the embodiment shown in FIG. 18D.

ACD+ITD CPR was performed on 3 human cadavers that were donated to the University of Minnesota (UMN) Anatomy Bequest Program. The bodies were perfused with a clot-busting solution Metaflow. Bilateral femoral arterial and venous access was obtained, the cadaver was intubated, and high fidelity pressure transducer (Millar) catheters were placed in the brain via a burr hole to monitor intracranial pressure (ICP) and in the aorta and right atrium to assess arterial and venous pressures. Manual ACD+ITD CPR was performed in the supine (SUP) and head up (HUP) positions, with each cadaver serving as her/his own control. The same device shown in FIGS. 6A-6E was used in this study. With elevation of the head and heart during ACD+ITD CPR there was an immediate decrease in ICP as shown in FIG. 31. In the cadavers, the cerebral perfusion pressure (CerPP) was higher in the HUP position as shown in Table 3 below.

TABLE 3

Data from a human cadaver ACD + ITD CPR model with 3 cadavers. Data are presented as means ± SD, all pressures are in mmHg

| | Head Up ACD + ITD CPR | Supine ACD + ITD CPR |
|---|---|---|
| Cerebral Perfusion Pressure | 6.5 ± 0.75 | −3.7 ± 2.5 |
| Intracranial Pressure | −2.7 ± 3.7 | 2.3 ± 3.9 |
| Aortic Pressure | 3.8 ± 4.5 | −0.19 ± 4.8 |

Specific details are given in the description to provide a thorough understanding of example configurations (including implementations). However, configurations may be practiced without these specific details. For example, well-known processes, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process that is depicted as a flow diagram or block diagram. Although each may describe the operations as a sequential process, many of the operations may be performed in parallel or concurrently. In addition, the order of the operations may be rearranged. A process may have additional steps not included in the figure.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for performing cardiopulmonary resuscitation (CPR), comprising:

providing an elevation device comprising: a base; and an upper support pivotably coupled to the base, wherein the upper support is configured to support solely an individual's back, shoulders, and head and to elevate the individual's upper back, shoulders and head when pivoted, and wherein the upper support comprises; a neck pad;

an upper portion configured to support the individual's back, shoulder, and head; and a lower portion operably coupled with the upper portion and the base, wherein the upper portion and the lower portion are configured to be movable to a same angular position relative to the base; positioning an individual on the elevation device such that the neck pad supports a spine of the individual in a region of C7 and C8 vertebrae of the individual;

pivoting the upper support, including the upper portion and the lower portion, to further elevate the head of the individual while the neck pad continues supporting the individual's spine in the region of the individual's C7 and C8 vertebrae;

expanding the upper support lengthwise such that the upper portion extends away from both the base and a lower end of the lower portion to maintain a position of the individual with the neck pad supporting the individual's spine in the region of the individual's C7 and C8 vertebrae, wherein during elevation of the upper support an upper body of the individual causes the upper portion to extend away from the lower portion to assist in preventing the individual from curling forward; and performing one or more of CPR or intrathoracic pressure regulation while elevating the heart and the head.

2. The method of performing cardiopulmonary resuscitation (CPR) of claim 1, wherein:

the neck pad is configured to maintain the individual in a sniffing position throughout the pivoting and expanding of the upper support.

3. The method for performing cardiopulmonary resuscitation (CPR) of claim 1, wherein:

the elevation device further comprises a thoracic plate operably coupled to the base and further comprising coupling a chest compression device with the thoracic plate.

4. The method for performing cardiopulmonary resuscitation (CPR) of claim 3, further comprising:

pivoting the thoracic plate relative to the base, thereby adjusting an orientation of the chest compression device.

5. The method for performing cardiopulmonary resuscitation (CPR) of claim 3, wherein:

expanding the upper support causes a corresponding adjustment of the thoracic plate such that the chest compression device is in a proper orientation in which the chest compression device is appropriately aligned with an anterior chest wall of the individual.

6. The method of performing cardiopulmonary resuscitation (CPR) of claim 1, wherein:

the upper support comprises an upper back plate and at least one track that is pivotably coupled with the base; and expanding the upper support comprises sliding the upper back plate relative to the track using a sliding mechanism.

7. A method for performing cardiopulmonary resuscitation (CPR), comprising:

providing an elevation device comprising: a base; and an upper support pivotably coupled to the base, wherein the upper support is configured to support solely an individual's back, shoulders, and head and to elevate the individual's upper back, shoulders and head when pivoted, and wherein the upper support comprises:

an upper portion configured to support the individual's back, shoulder, and head; and a lower portion operably coupled with the upper portion and the base, wherein the upper portion and the lower portion are configured to be movable to a same angular position relative to the base:

positioning an individual on the elevation device;

pivoting the upper support, including the upper portion and the lower portion, to further elevate the head of the individual;

expanding the upper support lengthwise such that the upper portion extends away from both the base and a lower end of the lower portion, wherein during elevation of the upper support the individual's upper body causes the upper portion to extend away from the lower portion to assist in preventing the individual from curling forward; and performing CPR or intrathoracic pressure regulation while elevating the heart and the head.

8. The method for performing cardiopulmonary resuscitation (CPR) of claim 7, further comprising:

coupling a thoracic plate to the base.

* * * * *